US008622652B1

(12) United States Patent
Happel

(10) Patent No.: US 8,622,652 B1
(45) **Date of Patent: *Jan. 7, 2014**

(54) OVERFLOW AND UNDERFLOW DOORS

(76) Inventor: Tom Happel, Cocoa, FL (US)

( * ) Notice: Subject to any disclaimer, the term of this patent is extended or adjusted under 35 U.S.C. 154(b) by 314 days.

This patent is subject to a terminal disclaimer.

(21) Appl. No.: 13/096,456

(22) Filed: Apr. 28, 2011

Related U.S. Application Data

(63) Continuation-in-part of application No. 12/533,806, filed on Jul. 31, 2009, now Pat. No. 8,393,827, and a continuation-in-part of application No. 12/823,727, filed on Jun. 25, 2010, now Pat. No. 8,425,150.

(51) Int. Cl.
*E02B 7/28* (2006.01)

(52) U.S. Cl.
USPC ..... 405/104; 405/90; 405/103; 405/105; 251/326

(58) Field of Classification Search
USPC ..... 405/36, 80, 87, 90, 103–106; 251/326, 251/204; 49/209, 216, 218, 219; 210/162, 210/170.03; 137/630, 630.12
See application file for complete search history.

(56) References Cited

U.S. PATENT DOCUMENTS 2,360,961 A * 10/1944 Mayo ..... 405/105
3,237,915 A * 3/1966 Palmer et al. ..... 251/158
4,278,190 A * 7/1981 Oory et al. ..... 222/561
6,270,663 B1 8/2001 Happel
6,428,692 B2 8/2002 Happel
6,797,162 B2 9/2004 Happel
6,869,525 B1 3/2005 Happel
6,979,148 B2 12/2005 Happel
7,153,417 B2 12/2006 Happel
7,270,747 B2 9/2007 Happel
7,294,256 B2 11/2007 Happel
7,785,464 B2 8/2010 Happel
7,846,327 B2 12/2010 Happel

OTHER PUBLICATIONS

Rising and Non-Rising Stern, Telescoping Valves, Halliday Products, 4 pgs, online, retrieved on Jun. 15, 2009, retrieved from www.hallidayproducts.com/ssq.html.
Aluminum Slide and Weird Glass, Water and Waste Water Valves and Gates, 10 pages, online, retrieved on Jun. 15, 2009, retrieved from www.//ncvg.netproducts/alumSlideWeir.html.

* cited by examiner

*Primary Examiner* — Sean Andrish
(74) *Attorney, Agent, or Firm* — Brian S. Steinberger; Law Offices of Brian S. Steinberger, P.A.

(57) ABSTRACT

Systems, devices, apparatus, and methods of moving a door, over a water conveyances. Locking the door can be by rotating bolt heads attached to cams. Rotating heads causes cams to press the door against tracks. A strip can be compressed between the door and track to prevent flow. Slidable doors can move to allow water overflow. The door can slide so water can flow underneath. A secondary door can slide within an opening in a door. A half panel can have an upper opening located in a wall, to close or allow water flow. A channel can have grooves in sides of an opening, where a door can slide to different heights to close or allow flow.

16 Claims, 61 Drawing Sheets

380
350
340
330
120
200
80
90

330
50
120
90
180
80
320

380
330
350
340
200
80
90

50
120
90
180
330
80
320

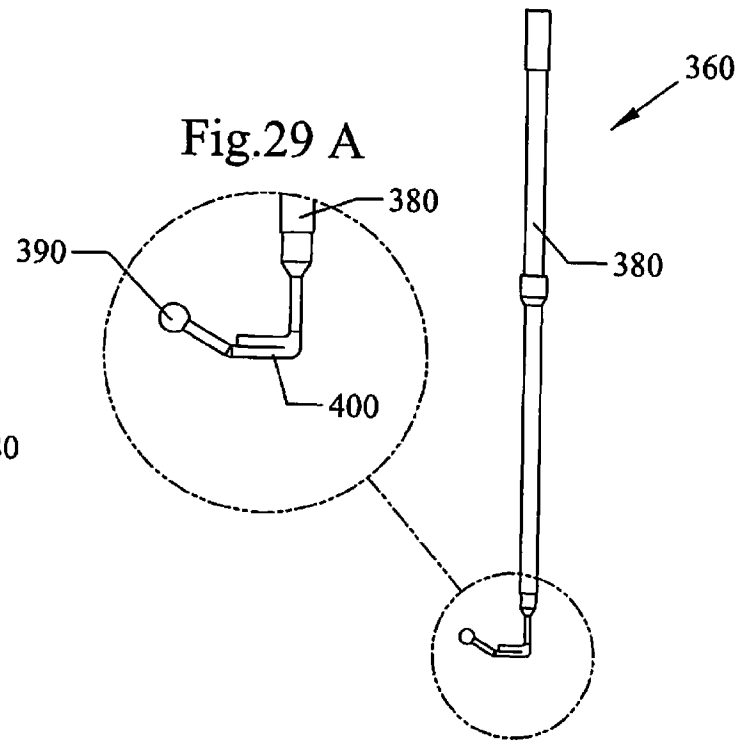
Fig.29 A
Fig.29
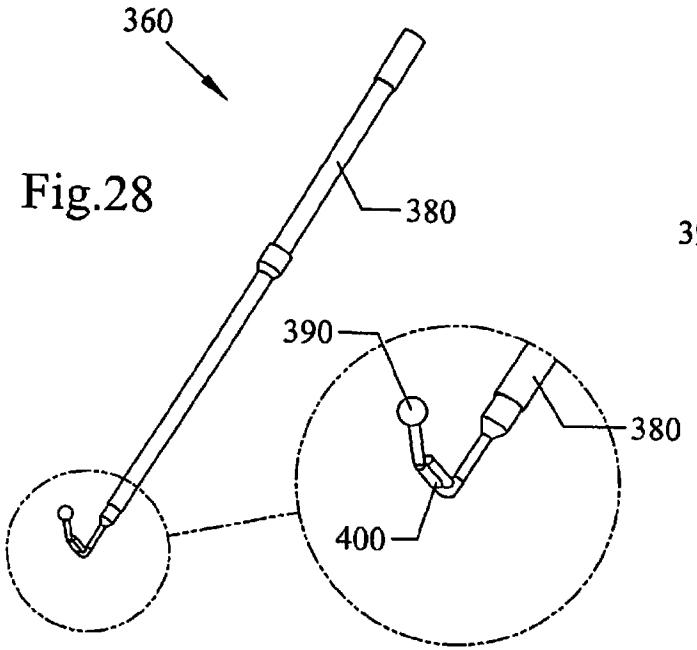
Fig.28
Fig.28 A

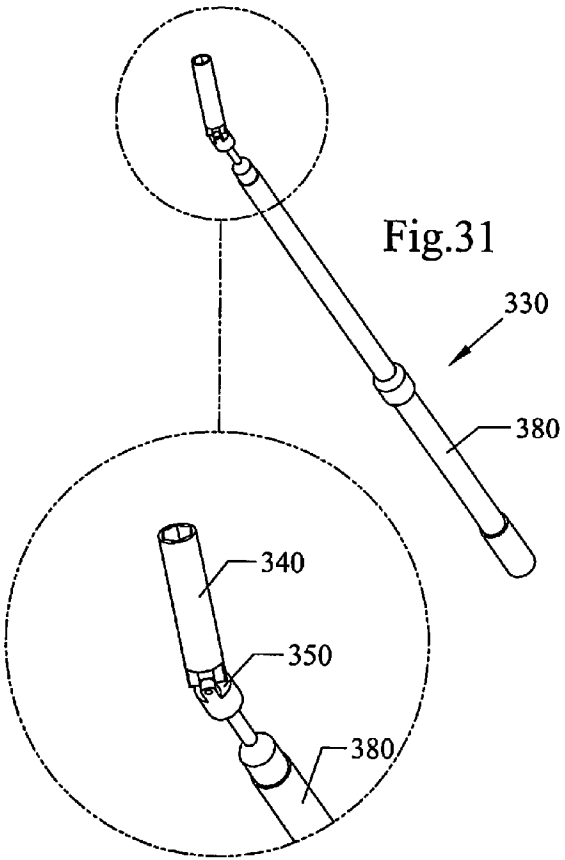
Fig.31
Fig.31 A
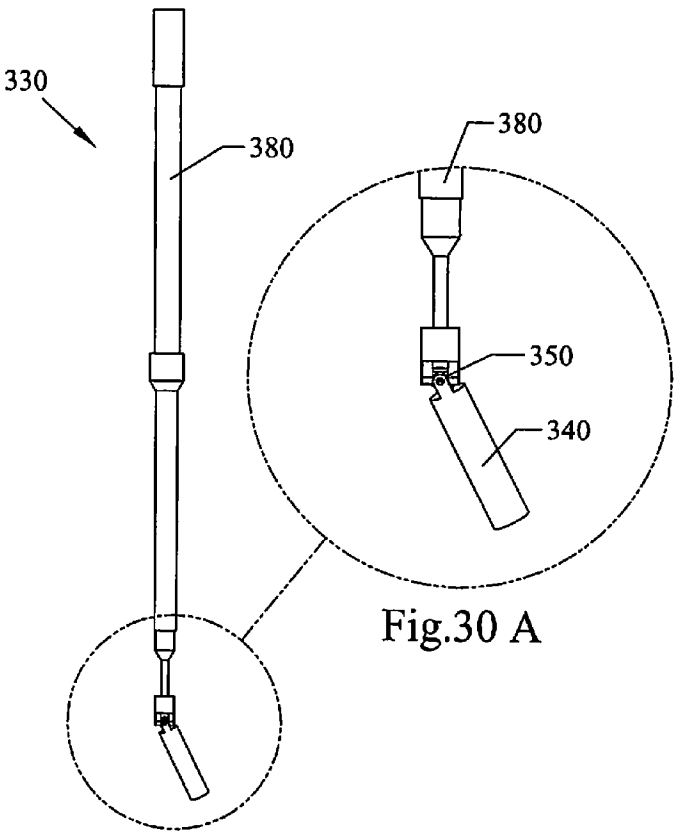
Fig.30
Fig.30 A

OVERFLOW AND UNDERFLOW DOORS

This invention is a Continuation-In-Part of U.S. patent application Ser. No. 12/823,727 filed Jun. 25, 2010, now U.S. Pat. No. 8,425,150, which is a Continuation-In-Part of U.S. patent application Ser. No. 12/533,806 filed Jul. 31, 2009, now U.S. Pat. No. 8,393,827. The entire disclosure of each of the applications listed in this paragraph are incorporated herein by specific reference thereto.

FIELD OF THE INVENTION

This invention relates to water damper controls for storm water treatment systems, manmade ponds and pools, natural lakes, ponds, actuaries and other water ways, and in particular to devices, apparatus, systems and methods of using a damper panel system to isolate a water treatment control structure from unwanted water inflow where a slidable doors can be sealed in place with rotatable cams pushing one side of the door against portions of the tracks, so that operators can unlock the sealed doors and pull out the individual doors by hand when needed, where the doors can slide upward to different height positions, and slide downward to different height position.

BACKGROUND AND PRIOR ART

There are federal clean water requirements that require water bodies such as lakes and rivers must meet strict minimal water quality specifications. To achieve these requirements, stormwater drainage pipes often require treatment before conveying stormwater into receiving water bodies. As a result, a wide variety of technologies have been developed to treat stormwater and improve the water quality. A common variety of stormwater treatment systems are hydrodynamic separators such as baffle type boxes and vortex systems. However, over time stormwater treatment systems often will fill with collected debris and will require service to remove the collected debris.

The servicing of a stormwater treatment structure typically requires the use of a vacuum truck that will suck out the collected solids and water within the structure. After the vacuum truck removes the debris and water from the stormwater structure, the vacuum truck transfers those contents to a processing facility for proper disposal. However, servicing stormwater structures is often complicated by unwanted water flow running into the stormwater structures during the service procedure. This unwanted water flow typically originates from high water levels in lakes and rivers adjacent to the treatment structure, or from an upstream base flow.

While the vacuum truck is removing water and debris from the treatment structure, water sometimes continues to flow in. Often the amount of water flowing into the treatment structure during servicing exceeds the rate at which the vacuum truck can remove the water. Having water enter the stormwater structure during servicing procedure reduces the effectiveness and efficiency of the service procedure and results with having the vacuum truck to dispose of additional water.

There have been attempts over the years to try to use various damper or gate type systems, such as the aluminum slide and weir gates manufactured by Northcoast Valve & Gate Inc., and slide gates manufactured by Halliday Products Inc. The common problem with damper or gate systems used in the prior art is that they are either difficult to install and use, or they leak badly. Additionally, these gates are too heavy and cumbersome for a single person to unlock and lift, and instead usually require two or more persons to operate which adds extra expenses and time.

Thus, the need exists for solutions to the above problems with the prior art.

SUMMARY OF THE INVENTION

A primary objective of the present invention is to provide devices, apparatus, systems and methods of using door damper systems to isolate waterways, such as storm water treatment systems, manmade ponds and pools, natural lakes, ponds, actuaries and other water ways from unwanted water inflow so that gates can be easily opened when needed.

A secondary objective of the present invention is to provide devices, apparatus, systems and methods of using door damper systems in a storm water treatment systems, manmade ponds and pools, natural lakes, ponds, actuaries and other water ways, that will reduce service treatment time and increase the effectiveness of services which will improve the removal efficiency of treatment systems and reduce servicing costs.

A third objective of the present invention is to provide devices, apparatus, systems and methods of using door damper systems in a storm water treatment systems, manmade ponds and pools, natural lakes, ponds, actuaries and other water ways, that are easy to install and use, and will not leak.

A fourth objective of the present invention is to provide devices, apparatus, systems and methods of using door damper systems in a storm water treatment systems, manmade ponds and pools, natural lakes, ponds, actuaries and other water ways, that can be used by a single person to lock and unlock.

A fifth objective of the present invention is to provide devices, apparatus, systems and methods of using door damper systems in a storm water treatment systems, manmade ponds and pools, natural lakes, ponds, actuaries and other water ways, using doors in slidable tracks that dramatically reduce friction to allow the door to be lifted and removed by a single person.

A sixth objective of the present invention is to provide devices, apparatus, systems and methods of using door damper systems in a storm water treatment systems, manmade ponds and pools, natural lakes, ponds, actuaries and other water ways, where slidable doors allow for overflow of water over the door(s).

A seventh objective of the present invention is to provide devices, apparatus, systems and methods of using door damper systems in a storm water treatment systems, manmade ponds and pools, natural lakes, ponds, actuaries and other water ways, where slidable doors allow for underflow of water under the door(s).

An eighth objective of the present invention is to provide devices, apparatus, systems and methods of using door damper systems in a storm water treatment systems, manmade ponds and pools, natural lakes, ponds, actuaries and other water ways, where a half panel door allows for overflow of water over the door.

A ninth objective of the present invention is to provide devices, apparatus, systems and methods of using door damper systems in a storm water treatment systems, manmade ponds and pools, natural lakes, ponds, actuaries and other water ways, where a slidable door can be inserted to slide within a concrete channel opening for overflow and underflow applications.

The novel damper system can include a track that attaches to the inside wall of a separator that is used in storm water treatment systems, manmade ponds and pools, natural lakes, ponds, actuaries and other water ways, with a damper panel that rotatably slides in place.

The external housing of the stormwater vault or treatment structure is commonly made of concrete, fiberglass, or plastic. The damper system track can be installed so that it makes a kind of frame around the inflow and/or outflow pipes and is attached to the inside surface of the treatment structure. A track system can be ideally sized to accommodate the damper panel.

The damper panel can be made of metal, fiberglass, or plastic, combinations thereof, and the like, can have a cam system mechanism along the vertical edges of the panel on one side. On the other side of the panel a rubber seal is continuous along the edge of the panel, going down one side, then across the bottom, and then up the other side. When the damper panel is lowered into the track system to block the pipe it is very loose and does not bind along the track system. When the cams are rotated the mechanism can then force the panel to wedge into the track and compress the rubber seal along the inside surface of the track. Once the cams have wedged the damper panel in place and the rubber seal is compressed against the track, the panel is locked in place and it will not leak water from the pipe into the storm water vault.

The cams can be rotated to either lock the damper panel in place or release the damper panel. The cams can be either rotated by a lever attached to the top of the cam system, or a wrench, or other tools such as but not limited to pliers, pipes, and the like. The wrench can be either hand held or socket attached to the end of a hand held pole. The advantage of attaching the socket to the end of a long pole is that a person does not need to enter the vault to rotate the cams.

The damper panel can have a special lifting point attachment that allows the panel to be lowered into the track system without having to enter the vault. The lifting point would have a slot that would sized to receive an approximately 1" diameter ball such as a metal sphere attached to the end of a thin rod, and the rod would be attached to a hand held pole. The damper panel would hang vertically on the end of the hand held pole and the geometry of the sphere in the slot would allow the damper panel to freely articulate on the end of the pole without binding. By this method the damper panel can be easily lowered into the vault and placed into the damper track.

A plurality of wheels on each side of the panel assembly can allow for the panel assembly to easily ride up and down in the tracks.

The separate rotatable cams in each of the tracks can be replaced by single elongated cams that can have paddle or wedge shapes. Alternatively, the invention can use removable wedges that when driven into place compress and water seal the damper panel in place.

A preferred embodiment of a damper system for storm water treatment vault structures, can include a frame attached to an inner wall of a vault structure, the frame having an opening therethrough, tracks attached to the frame about the opening, a door having wheels along outer side edges, the wheels of the door being slidably received within the tracks, the door having an open position for allowing water to flow into the vault structure and a closed position for preventing water from passing into the vault structure, and moveable members along one side face of the door for pushing the door against portions of the track to seal the door against water intrusion.

The moveable members can include rotatable cams along perimeters of side edges of the door, the cams having an unlocked position where the door is loosely seated in the tracks and a locked position where the door is pushed against one side of the tracks, wherein the locked position prevents water from passing about edges of the door.

The removable tool can be a hand wrench for rotating the cams from the unlocked to the locked position. The removable tool can be a socket wrench for rotating the cams from the unlocked to the locked position.

The moveable members can be a single elongated rotatable cam on each side edge of the door. Alternatively, the moveable members can include a plurality of rotatable cams on each side edge of the door.

An elongated seal members between perimeter edges of the door and the one side of the track, can be used wherein the cams in the locked position causes the door to compress the elongated sealing members against the one side of the track so that water is sealed and prevented from entering about the edges of the door.

A handle can be attached to the door for raising and lowering the door. An elongated tool having an end portion can attach to and detach to the handle. The elongated tool can have a hook end, wherein lifting the handle raises the door from the tracks, and allows the storm water to enter into the vault structure.

A preferred method of locking and unlocking slidable doors in a storm water vault structure in order to service the vault structure, can include the steps of providing a door having wheels on sides of the door, sliding the wheels within tracks against an inlet wall of a storm water structure, providing the sides of the door with rotatable cams, locking the door in the tracks by rotating the rotatable cams so that the cams push one side of the door against a portion of the tracks, and unlocking the door rotating the rotatable cams in a counter direction so that the door against loosely sits in the tracks.

The method can further include the steps of providing elongated gasket members along side edges of the door, and sealing the door against the tracks by the locking of the door which compresses the elongated gasket members.

The method can further include the step of removing storm water in the vault structure after the door is sealed in place with as vacuum truck before physically servicing the interior of the vault structure.

The method can further include the step of selectively locking the door in a lower position wherein water flows over the door. The method can further include the step of selectively locking the door in an upper position wherein water flows under the door.

Another embodiment of the damper system for storm water treatment vault structures, can include a frame attached to an inner wall of a vault structure, the frame having an opening therethrough, tracks attached to the frame about the opening, a slidable door having outer side edges being slidably received within the tracks, the slidable door having a lower position for allowing water to flow over the door into the vault structure and an upper position for allowing the water to flow under the door into the vault structure, and the door having closed position for preventing the water from flowing into the vault, and a member for raising and lowering and closing the slidable door.

The system can include rollers on each of the side edges of the slidable door. The system can include cams for locking the door into different height positions within the tracks.

The slidable door can include a door in door version with a primary door that slides in tracks, and a secondary door smaller than the primary door, the secondary door slides up and down in tracks on the primary door.

Another version can use a half panel door allows for overflow of water over the door.

A still another version can allow for a slidable door can be inserted to slide within a concrete channel opening for overflow and underflow applications.

Further objects and advantages of this invention will be apparent from the following detailed description of the presently preferred embodiments which are illustrated schematically in the accompanying drawings.

BRIEF DESCRIPTION OF THE FIGURES

FIG. 28 is a perspective view of a hook tool used in FIG. 24.

FIG. 28A is an enlarged view of the hook end and ball on the hook tool of FIG. 28.

FIG. 29 is a side view of hook tool of FIG. 28.

FIG. 29A is an enlarged view of the hook end and ball on the hook tool of FIG. 29.

FIG. 30 is a side view of the remote socket wrench tool used in FIGS. 22, 22A, 23 and 23A.

FIG. 30A is an enlarged view of the socket part of the tool of FIG. 30.

FIG. 31 is a perspective view of the remote socket wrench tool of FIG. 30.

FIG. 31A is an enlarged view of the socket part of the tool of FIG. 31.

Primary and Secondary Doors with Underflow and Overflow

Figure 40:
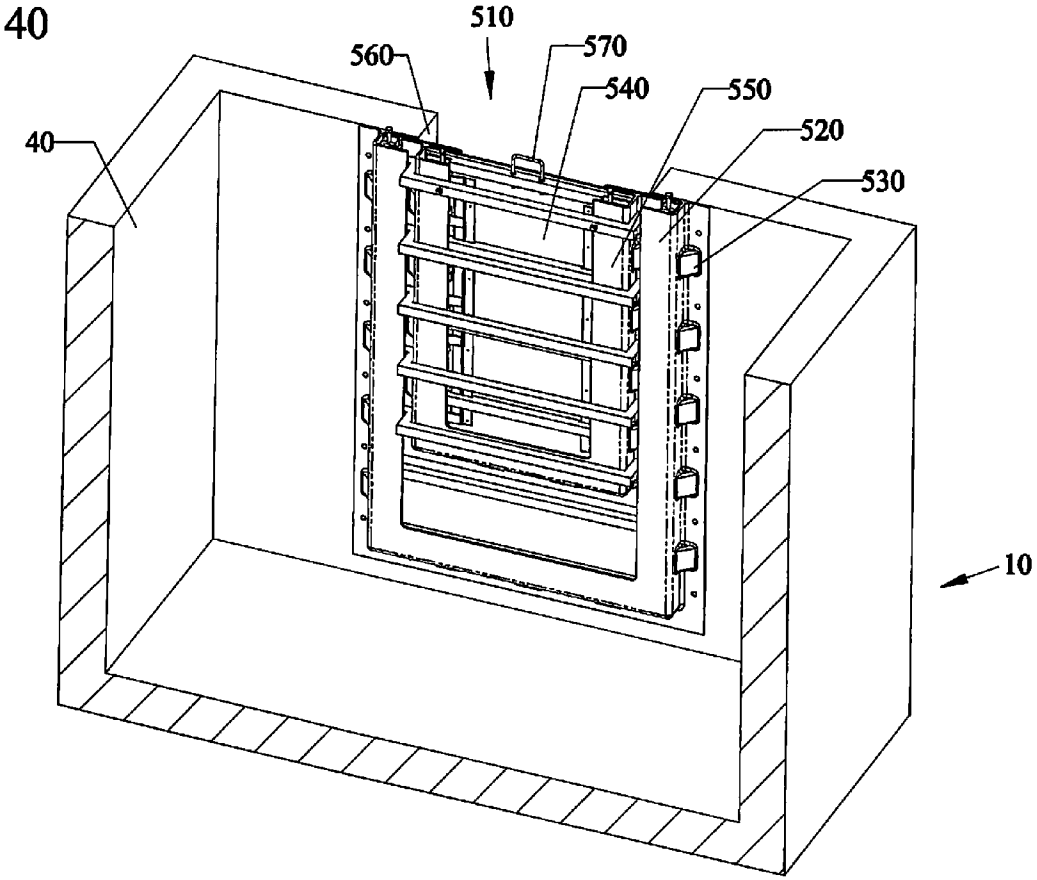

FIG. 40 is a front perspective of Inflow outflow (I.O.) vault with primary and secondary door assemblies.

Figure 41:
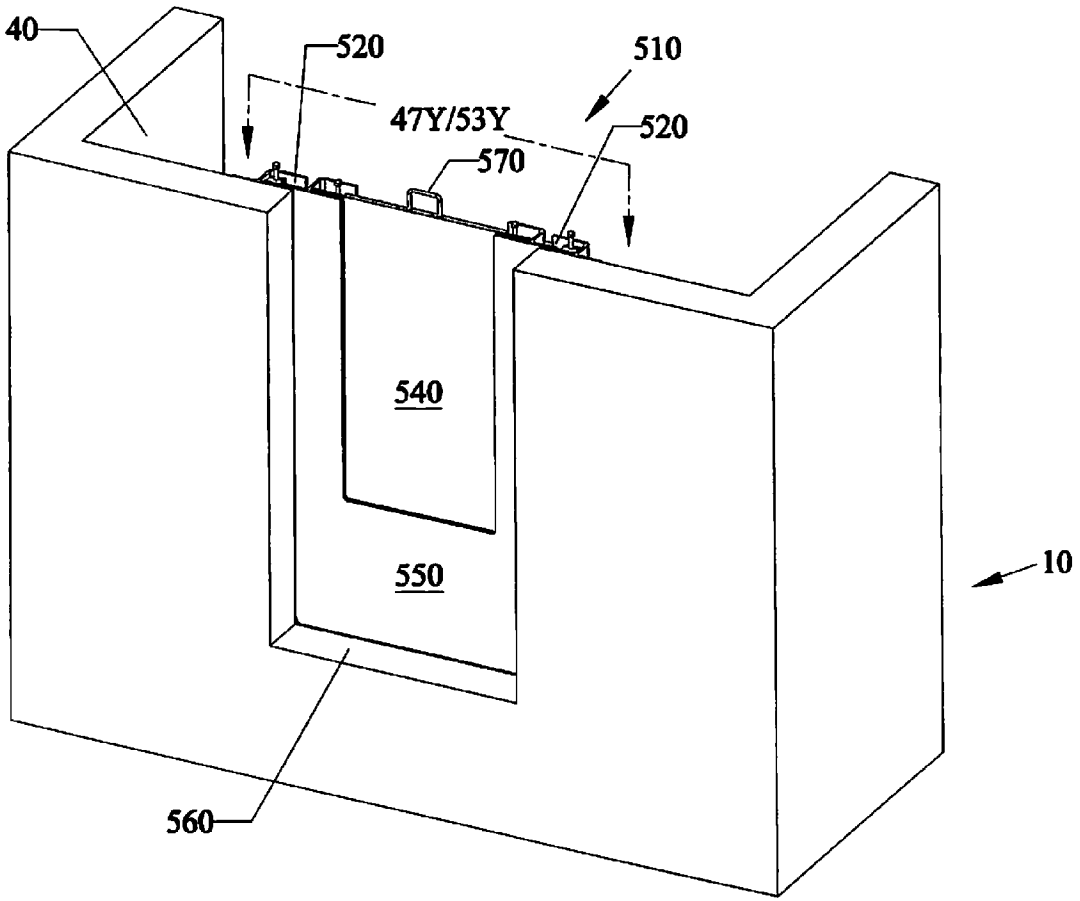

FIG. 41 is a rear perspective view of the primary and secondary door assemblies installed in the vault of FIG. 40.

Figure 42:
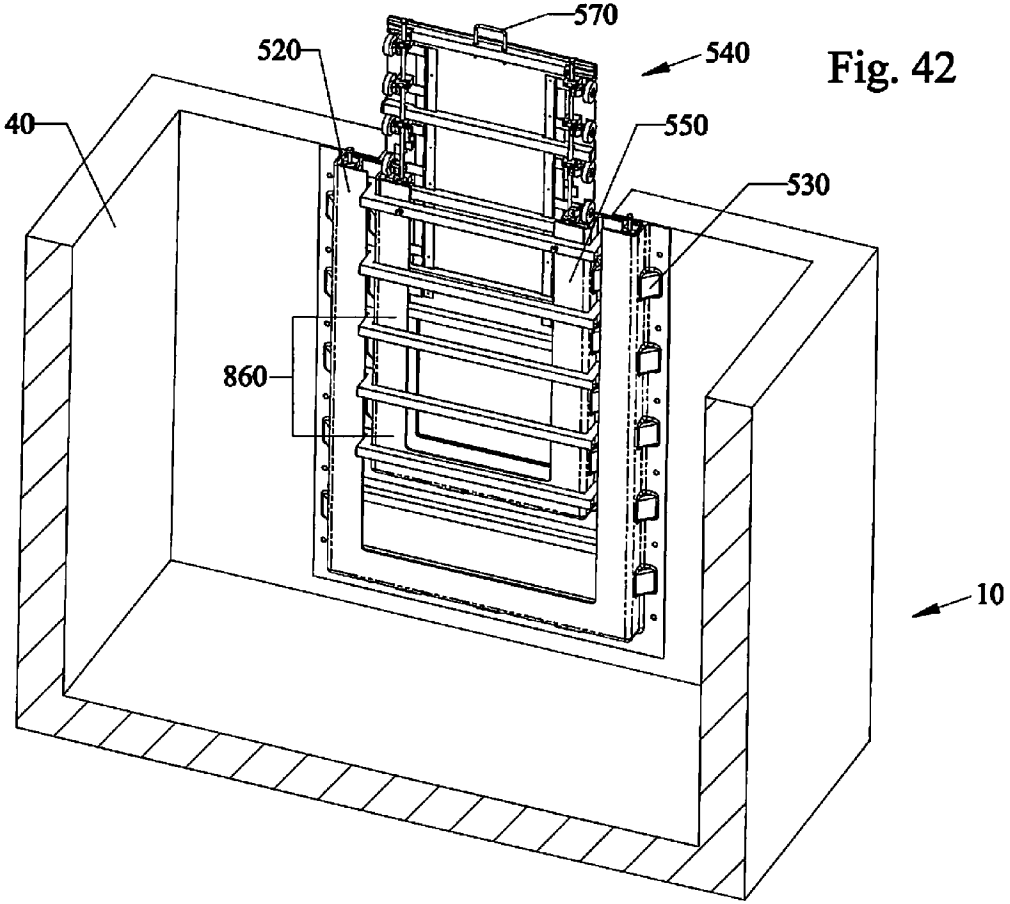

FIG. 42 is a front perspective view of the vault of FIG. 40 with the primary door assembly locked half open to reveal an underflow passage for storm water flow.

Figure 43:
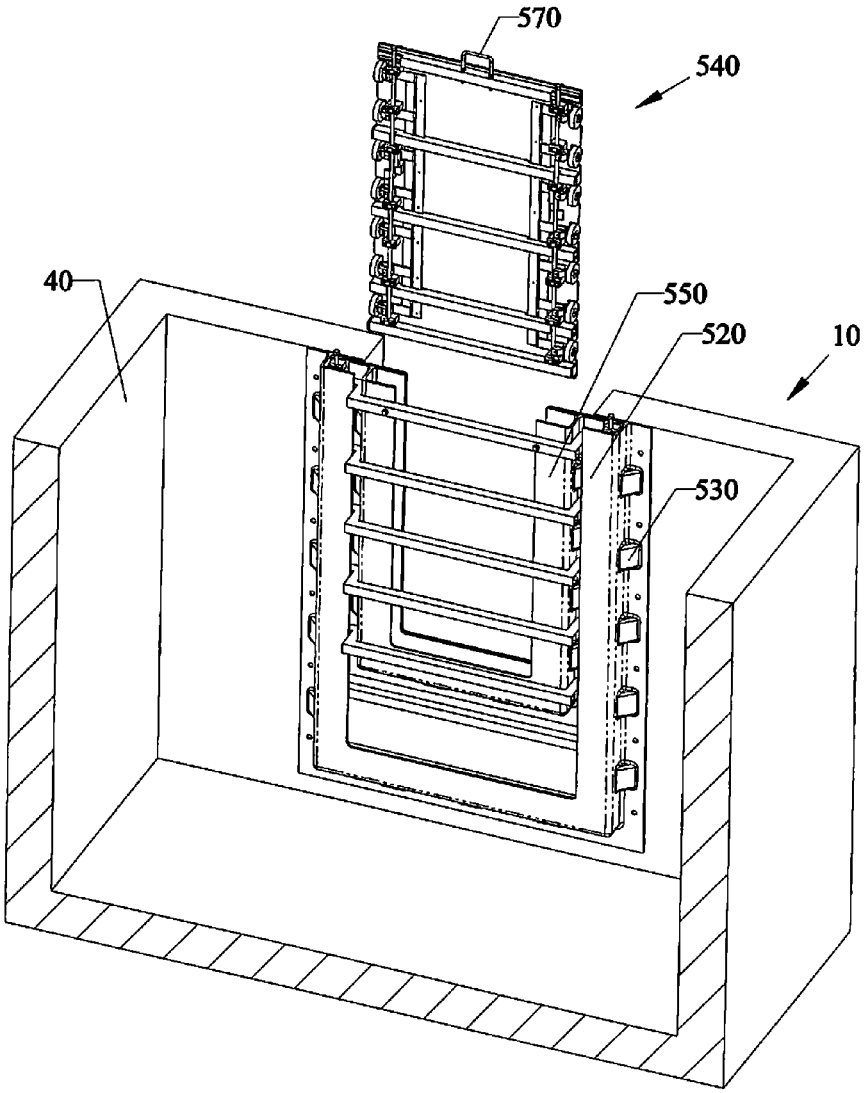

FIG. 43 is a front perspective view of the vault of FIG. 40 with the primary door assembly removed.

Figure 44:
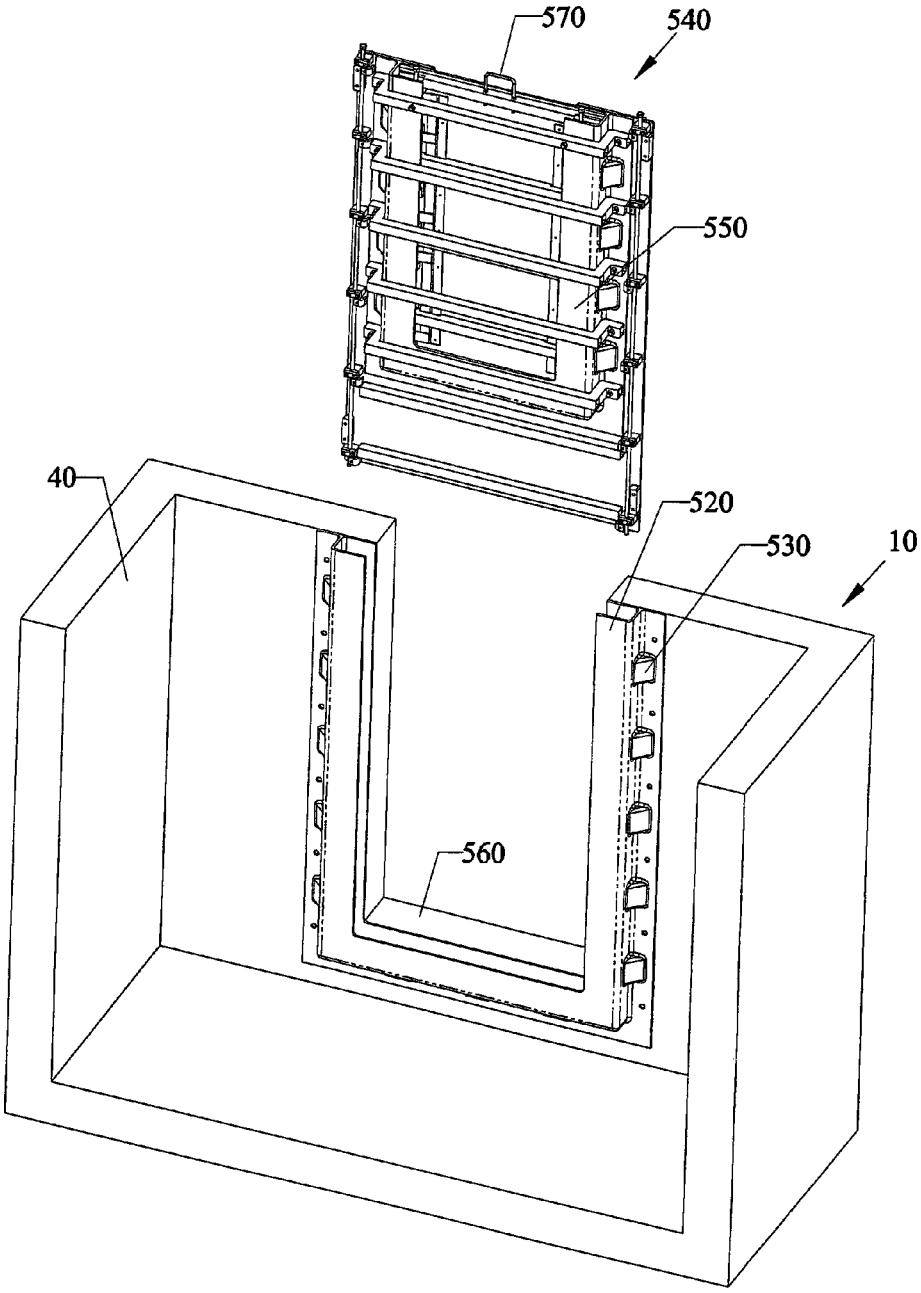

FIG. 44 is a front perspective view of the vault of FIG. 40 with the combined primary and secondary door assemblies removed.

Figure 45:
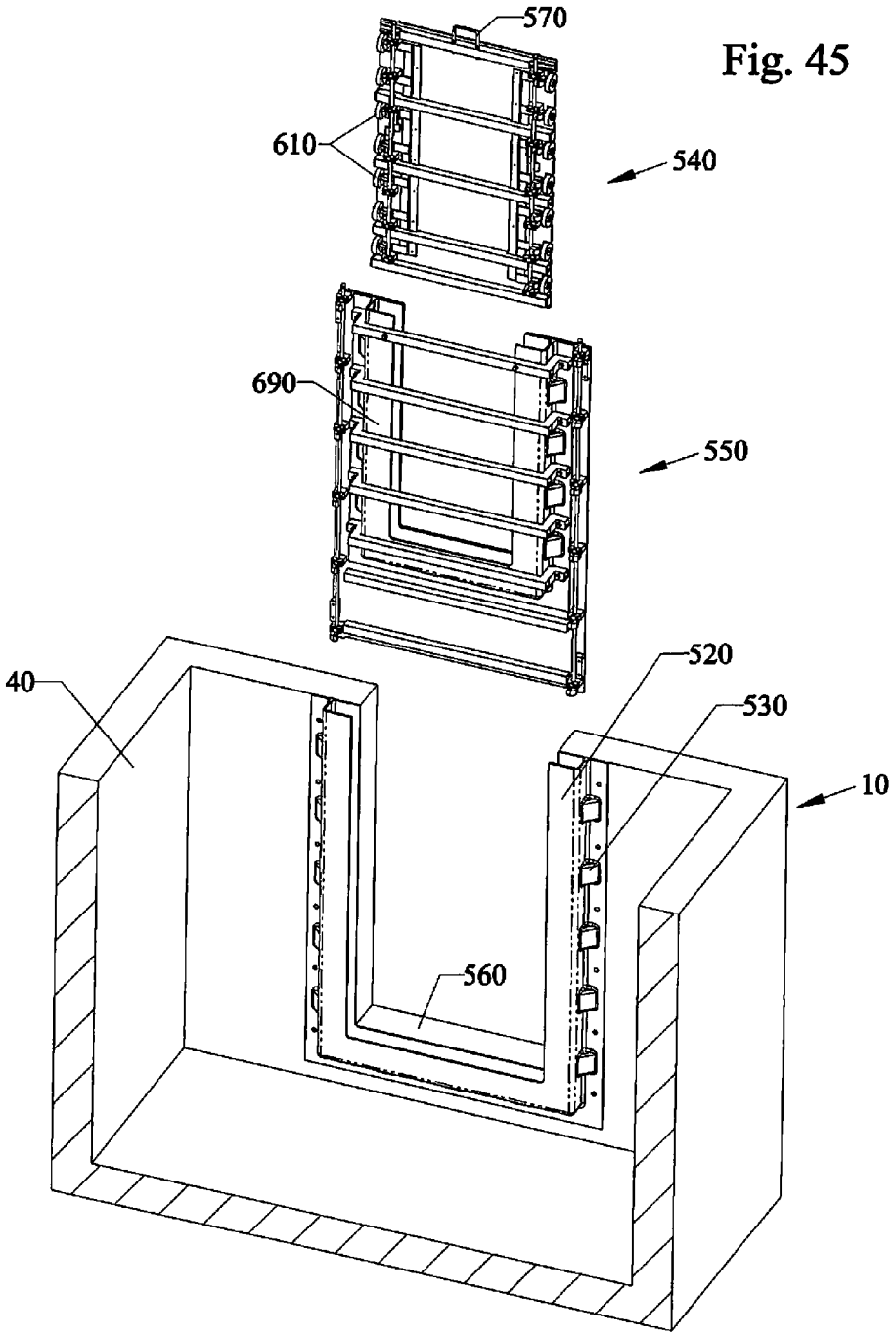

FIG. 45 is a front perspective exploded view of the vault with the primary and secondary door assemblies removed and separated.

Figure 1:
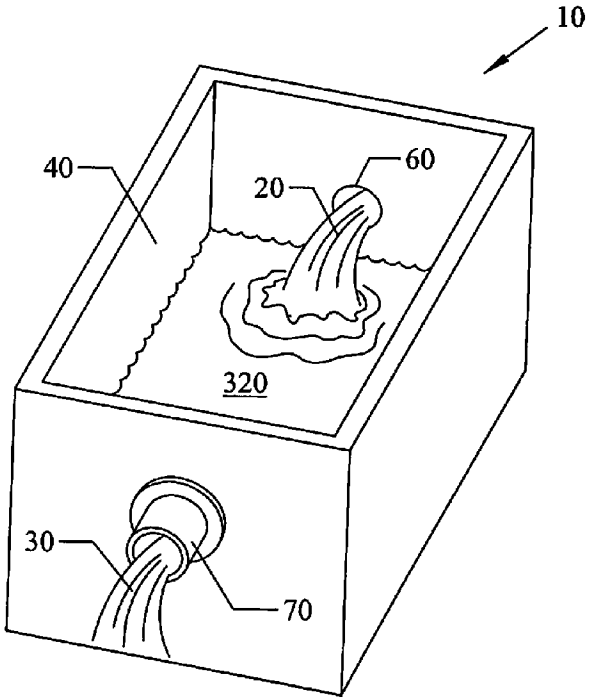
Fig.1 (Prior Art)
FIG. 1 is a top perspective view of a prior art concrete storm water handling vault.
Figure 46:
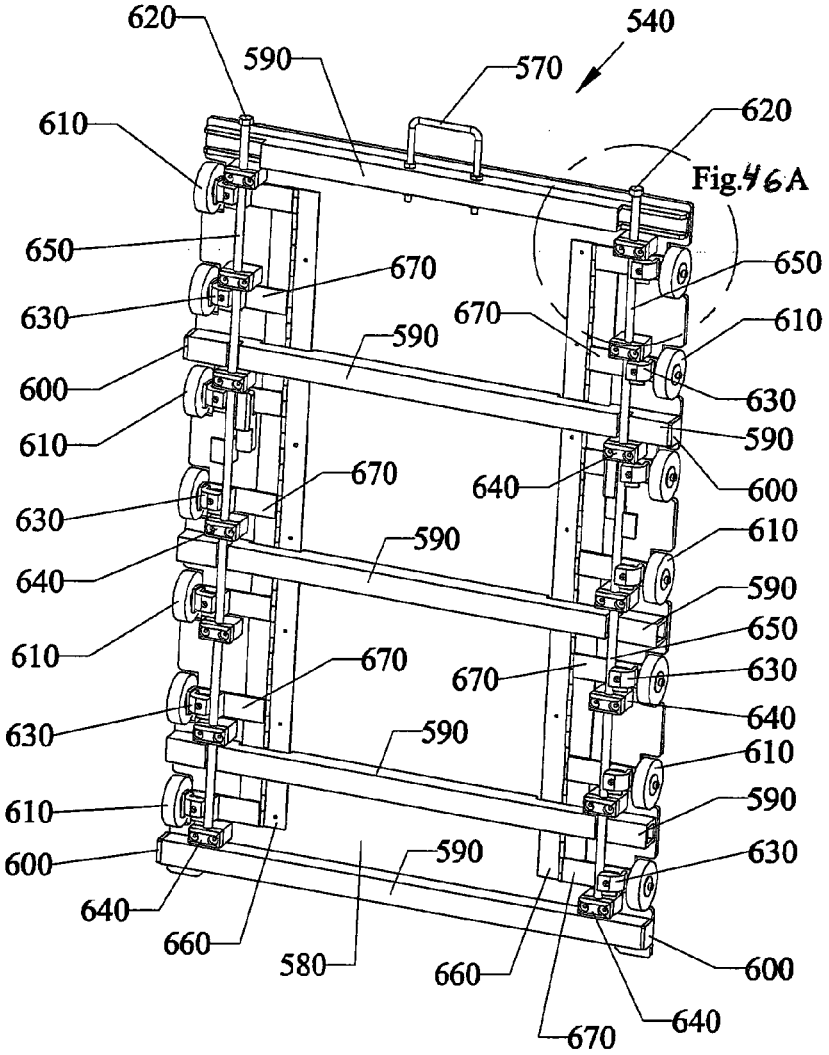

FIG. 46 is a front perspective view of the primary door assembly of FIG. 1.

Figure 46A:
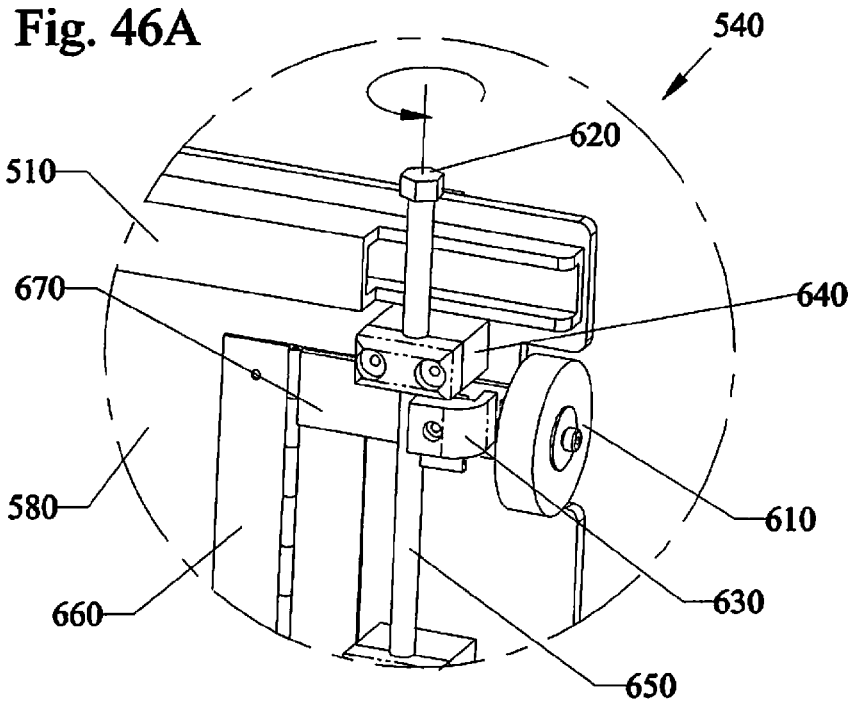

FIG. 46A is an enlarged view of the lock and wheel mechanism detail of the primary door of FIG. 46 in a "wheels locked/door unsealed" condition.

Figure 46B:
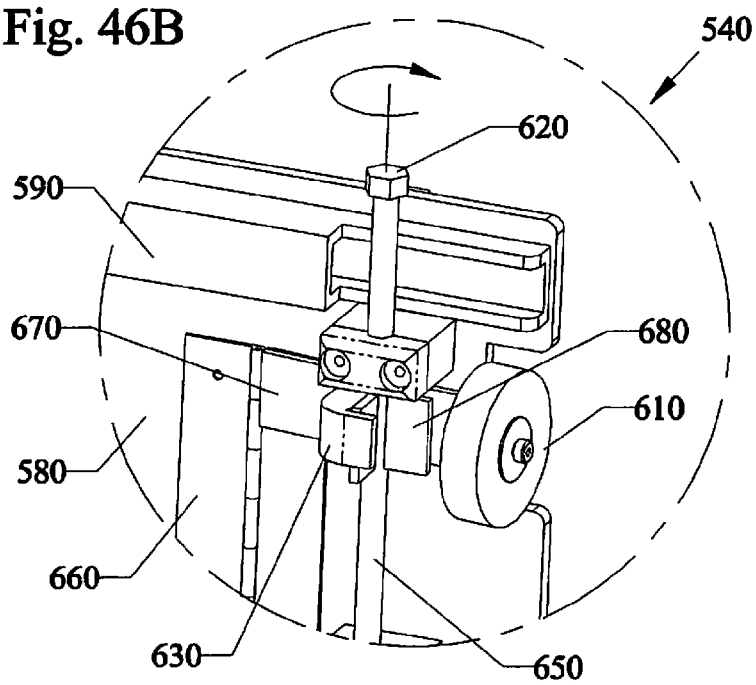

FIG. 46B is an enlarged view of the lock and wheel mechanism detail of the primary door of FIG. 46 in a "wheels unlocked/door sealed" condition.

Figure 47:
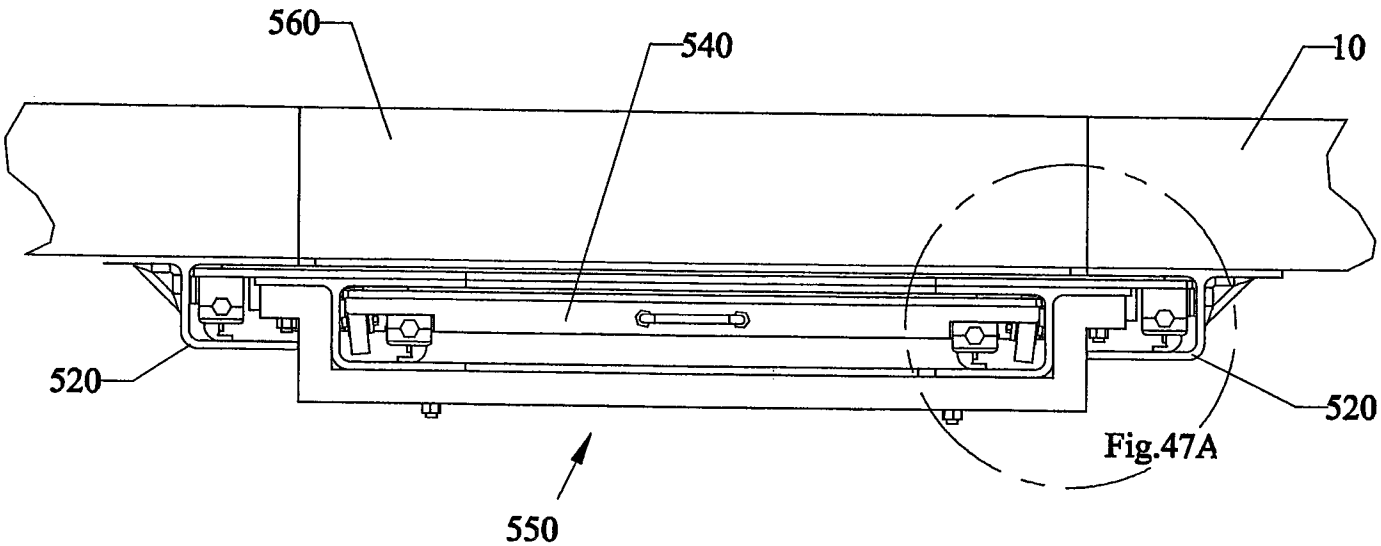

FIG. 47 is a top view of FIG. 41 along arrow 47Y of the primary and secondary door assemblies installed into the secondary door frame which is attached to the vault.

Figure 47A:
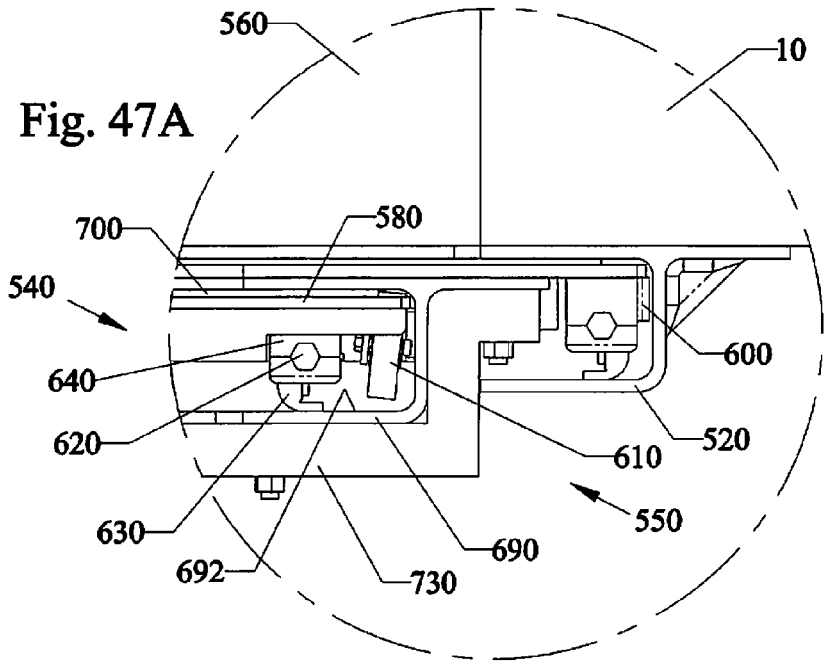

FIG. 47A is an enlarged view of the lock mechanism detail of the primary door assembly of FIG. 47 shown with cam locks engaged and foam rubber seal pressed against the inside of the frame.

Figure 47B:
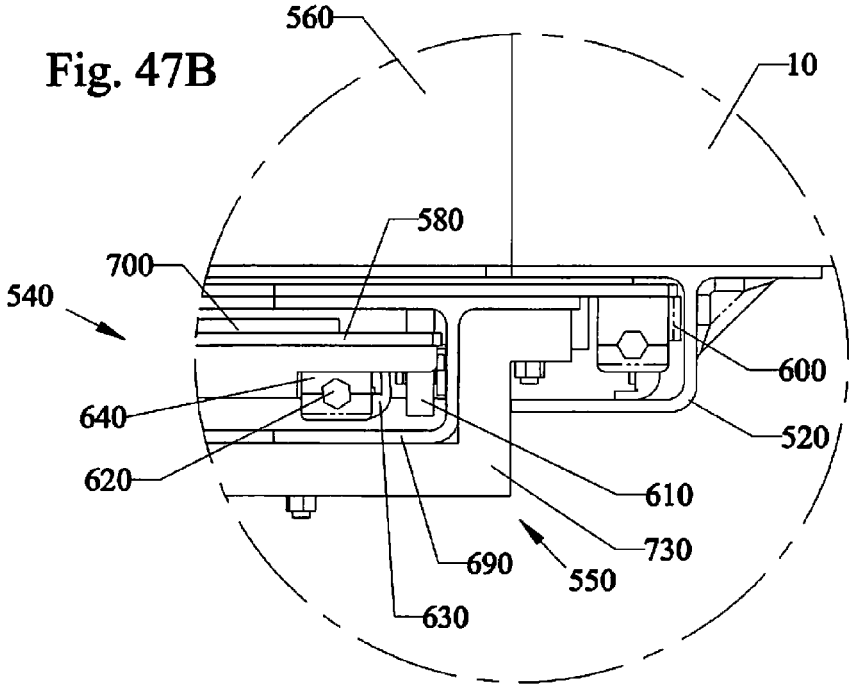

FIG. 47B is an enlarged view of the lock mechanism detail of the primary door assembly of FIG. 47 shown with wheels locked and engaged with the frame for ease of door removal.

Figure 48:
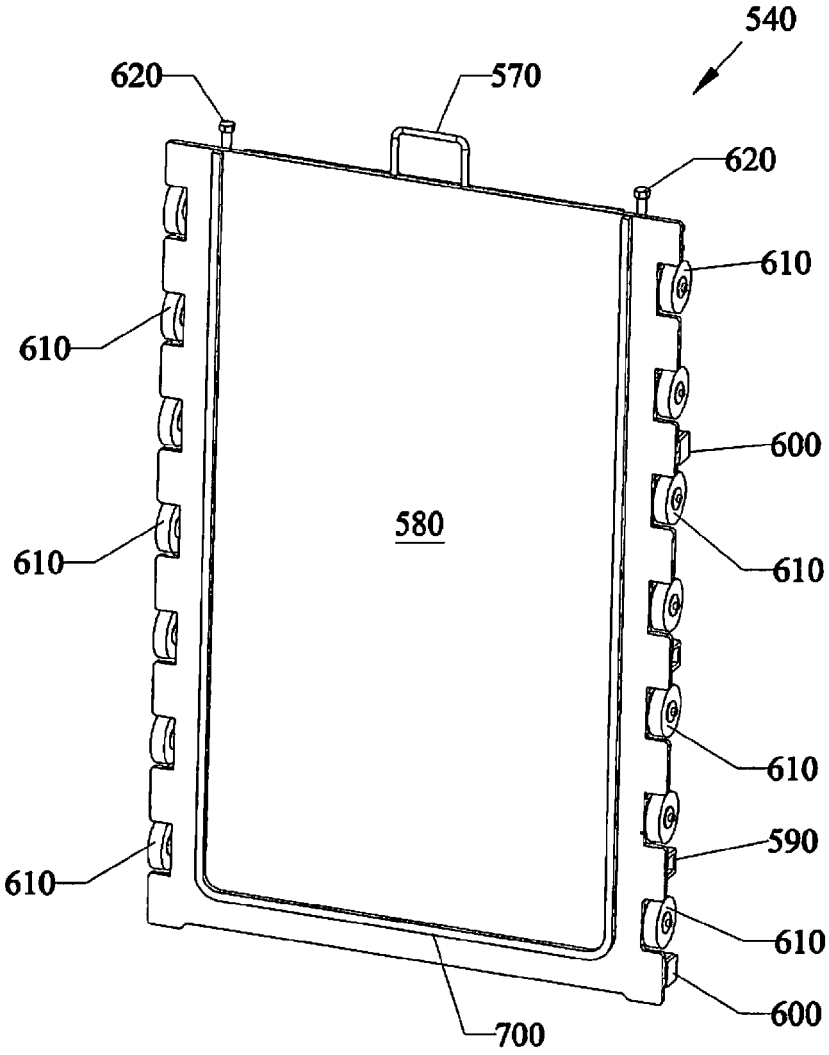

FIG. 48 is a rear perspective view of the primary door assembly of the preceding figures.

Figure 49:
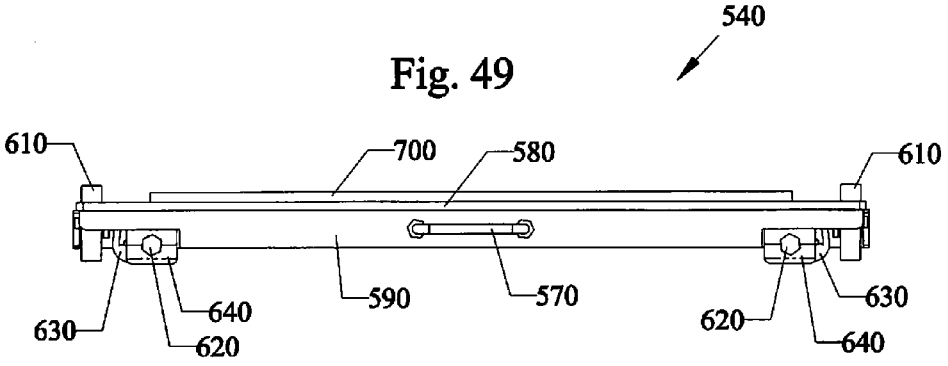

FIG. 49 is a top view of the primary door assembly of FIG. 48.

Figure 50:
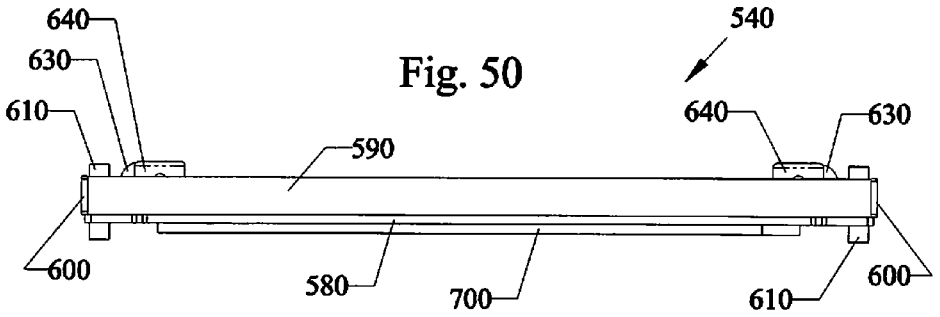

FIG. 50 is a bottom view of the primary door assembly of FIG. 48.

Figure 51:
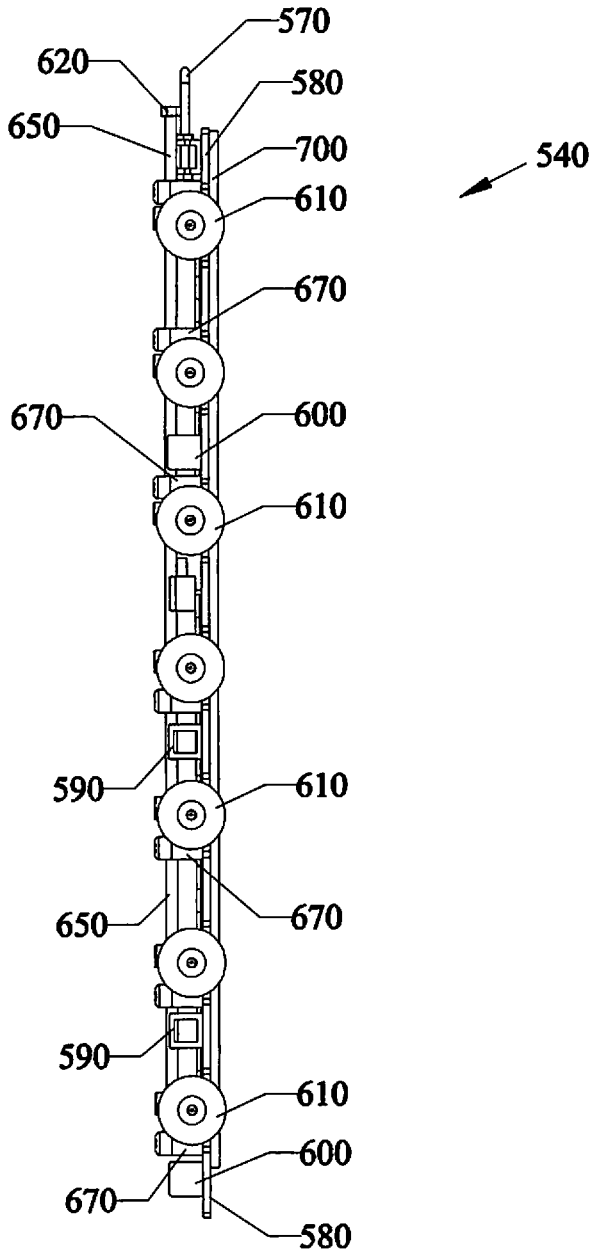

FIG. 51 is a side view of the primary door assembly of FIG. 48.

Figure 52:
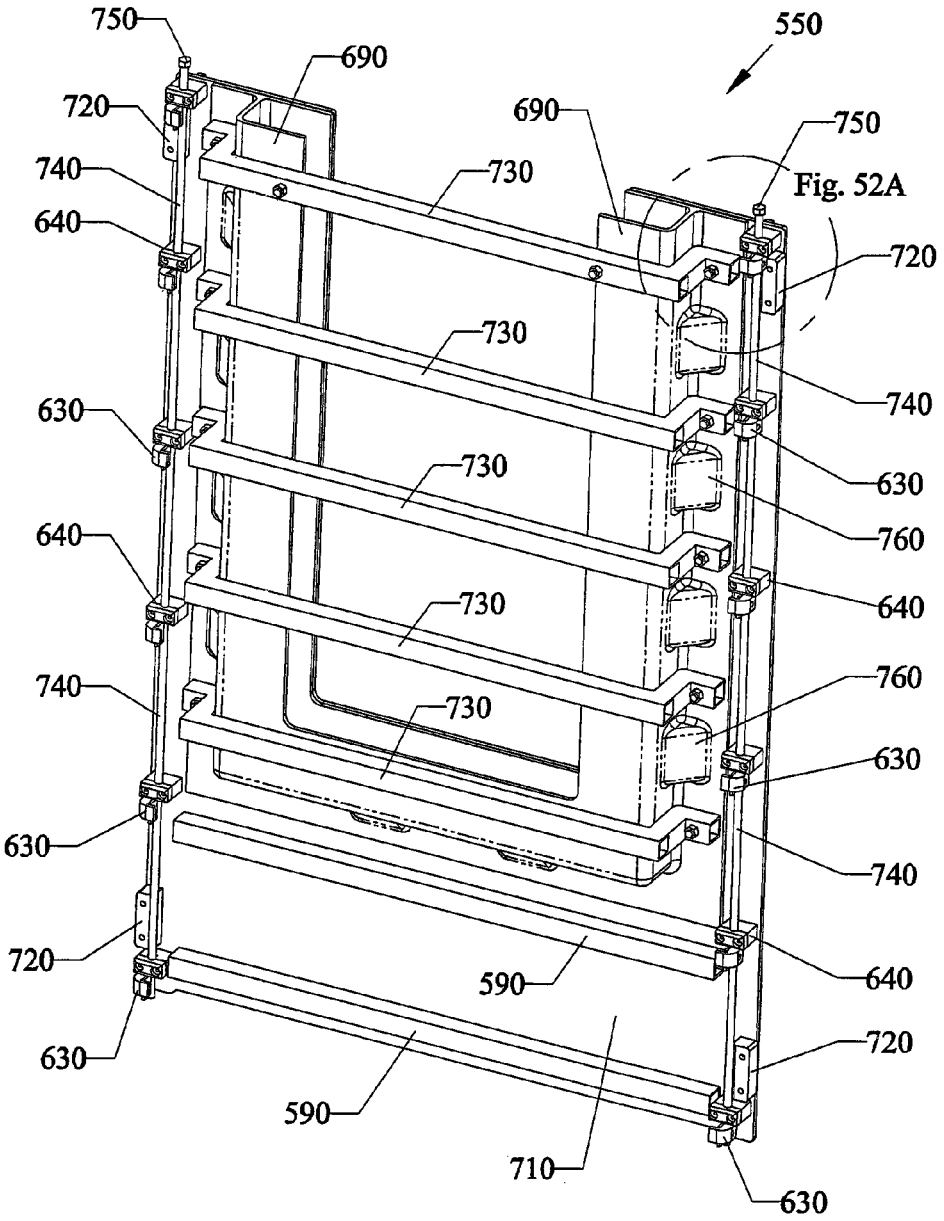

FIG. 52 is a front perspective view of the secondary door assembly of the preceding figures.

Figure 52A:
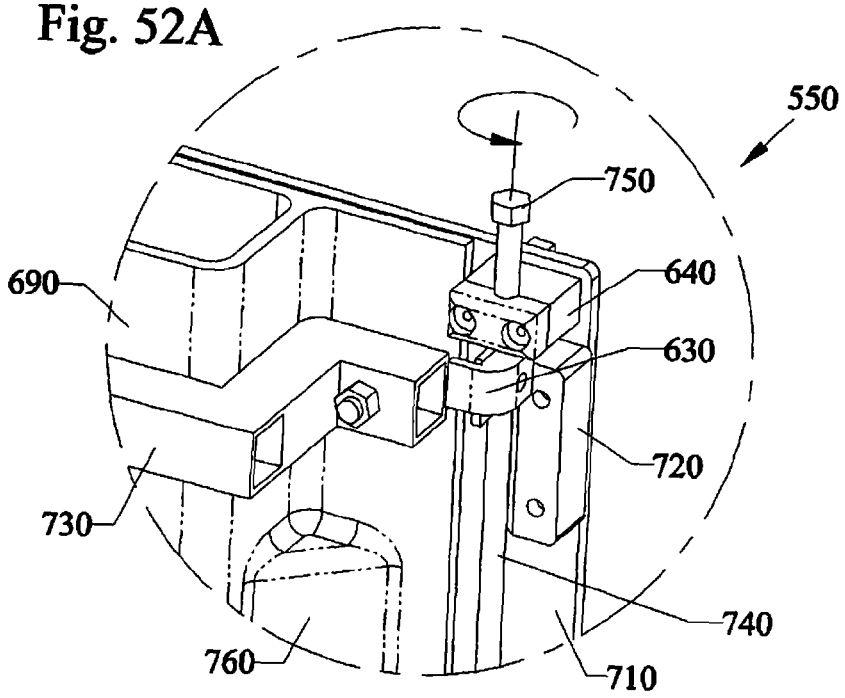

FIG. 52A is an enlarged view of the lock mechanism detail of the secondary door assembly of FIG. 52 shown in a "door sealed" condition.

Figure 52B:
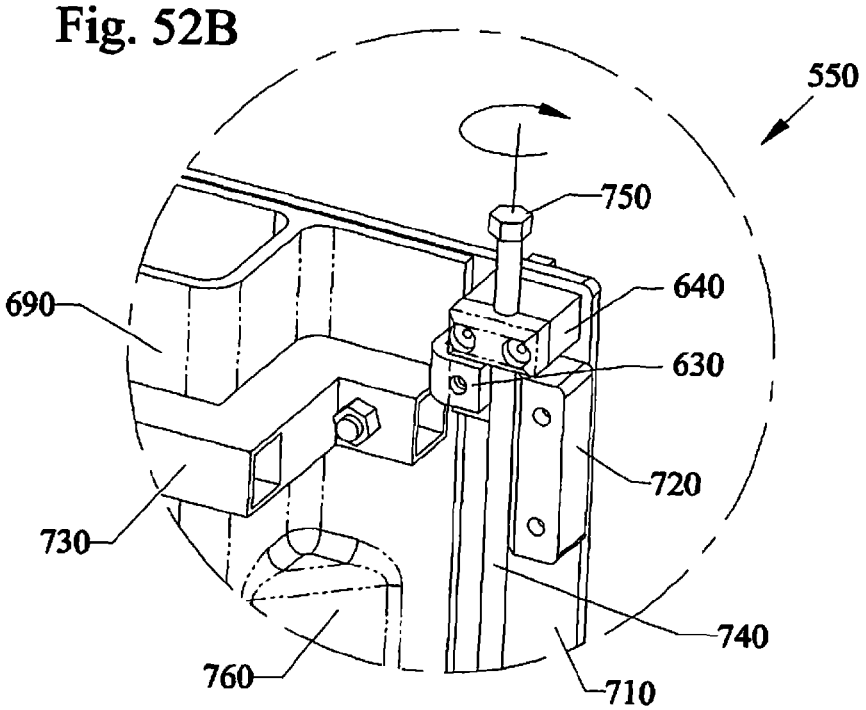

FIG. 52B is an enlarged view of the lock mechanism detail of the secondary door assembly of FIG. 52 shown in the "door unsealed" condition.

Figure 53:
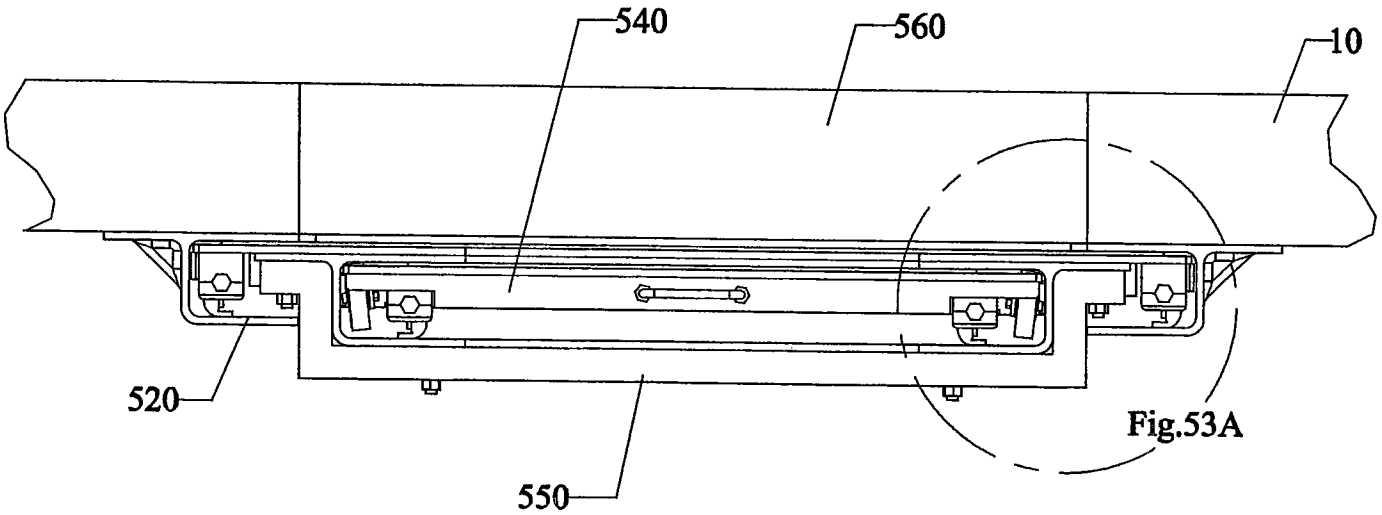

FIG. 53 is a top view of FIG. 41 along arrow 53Y of the primary and secondary door assemblies installed into the secondary door frame which is attached to the vault.

Figure 53A:
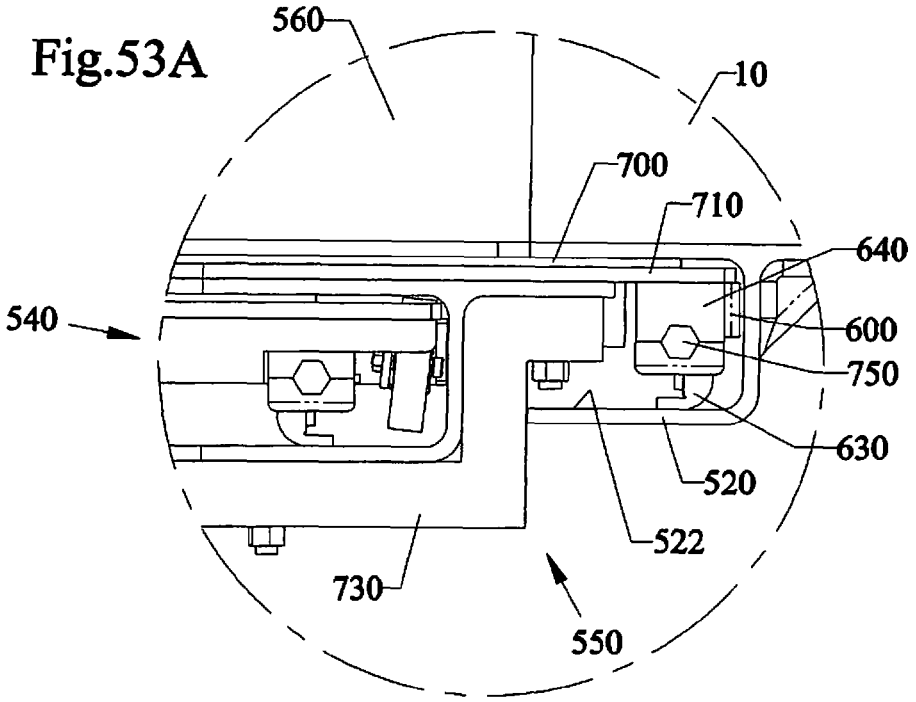

FIG. 53A is an enlarged view of the lock mechanism detail of the secondary door assembly of FIG. 53 shown with cam locks engaged and foam rubber seal pressed against the inside of the frame.

Figure 53B:
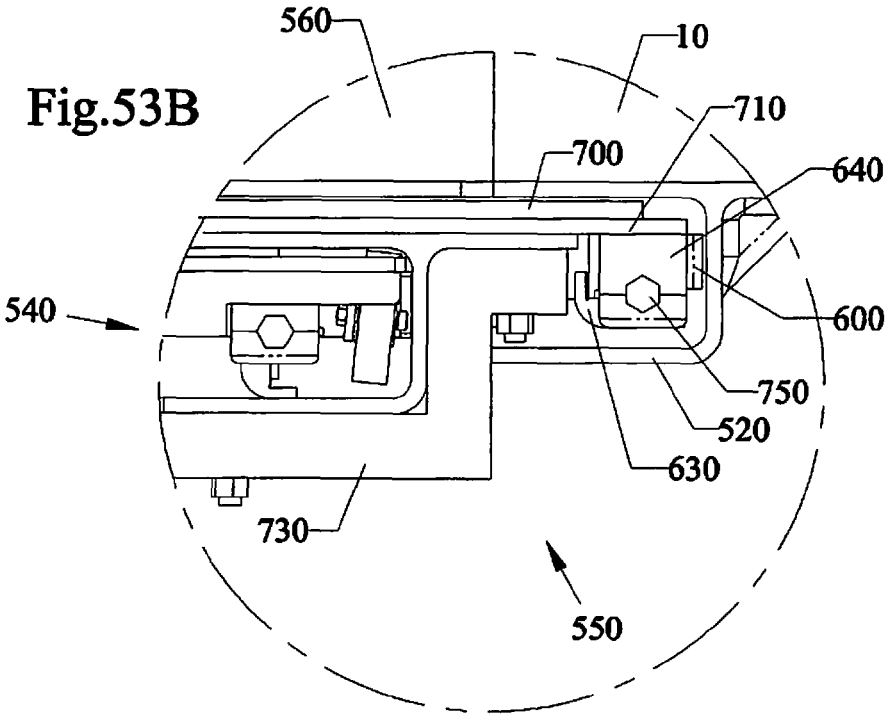

FIG. 53B is an enlarged view of the lock mechanism detail of the secondary door assembly of FIG. 53 shown with the cam locks disengaged from the frame.

Figure 54:
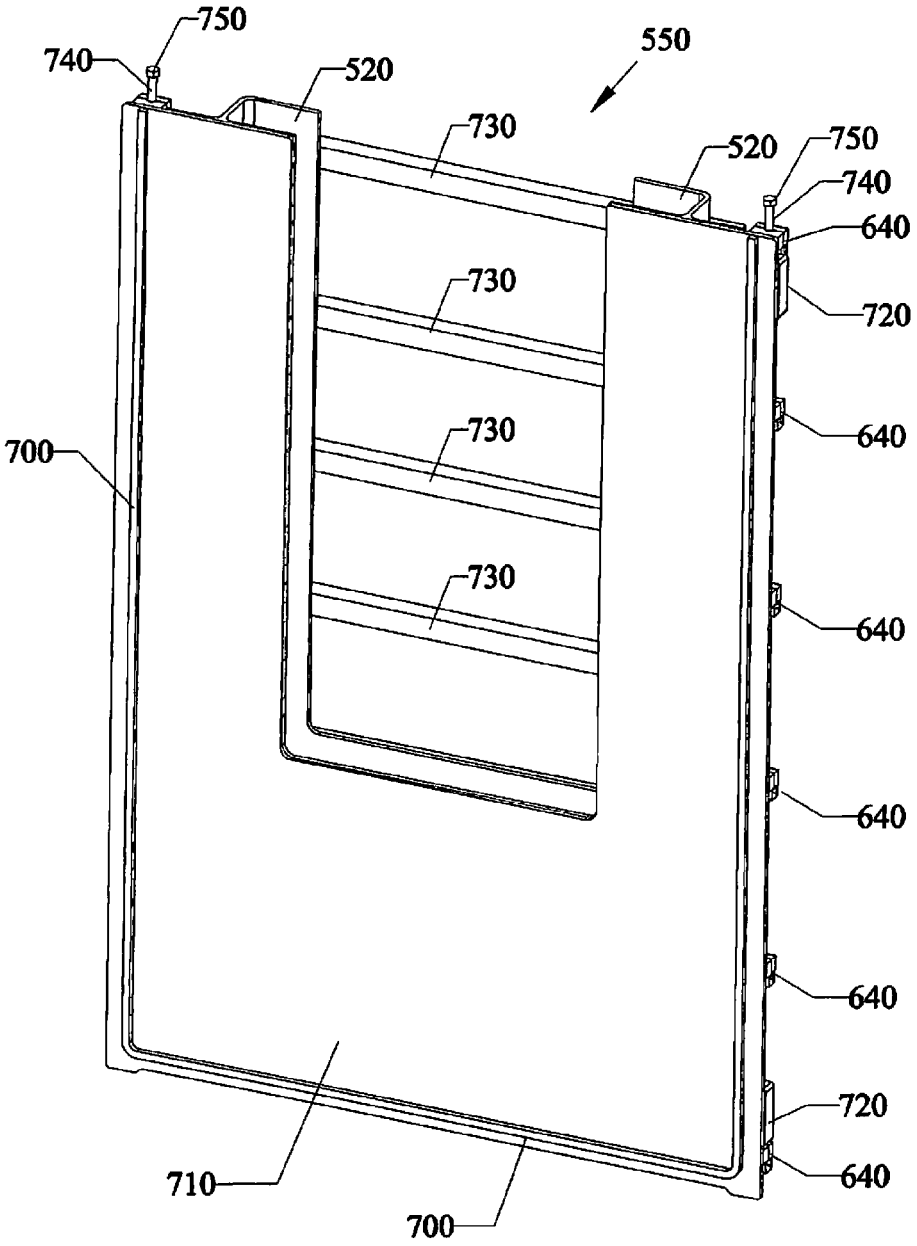

FIG. 54 is a rear perspective view of the secondary door assembly of the previous figures.

Figure 55:
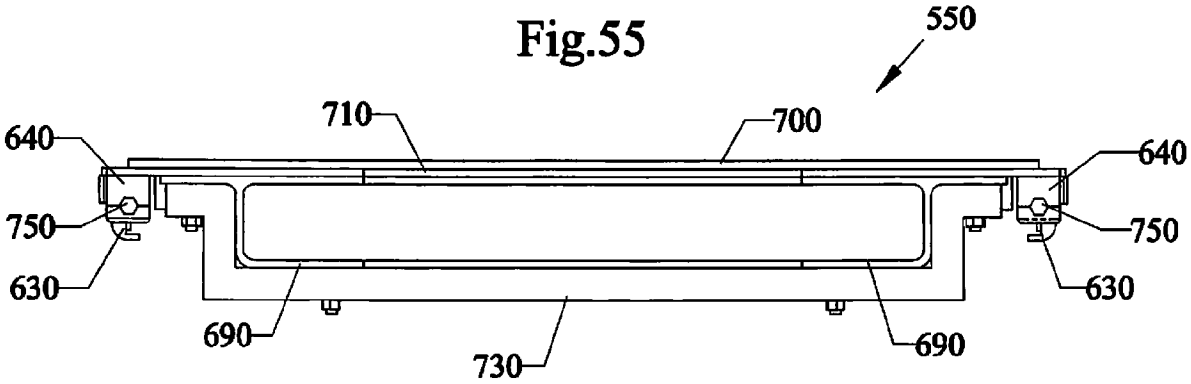

FIG. 55 is a top view of the secondary door assembly of FIG. 54.

Figure 56:
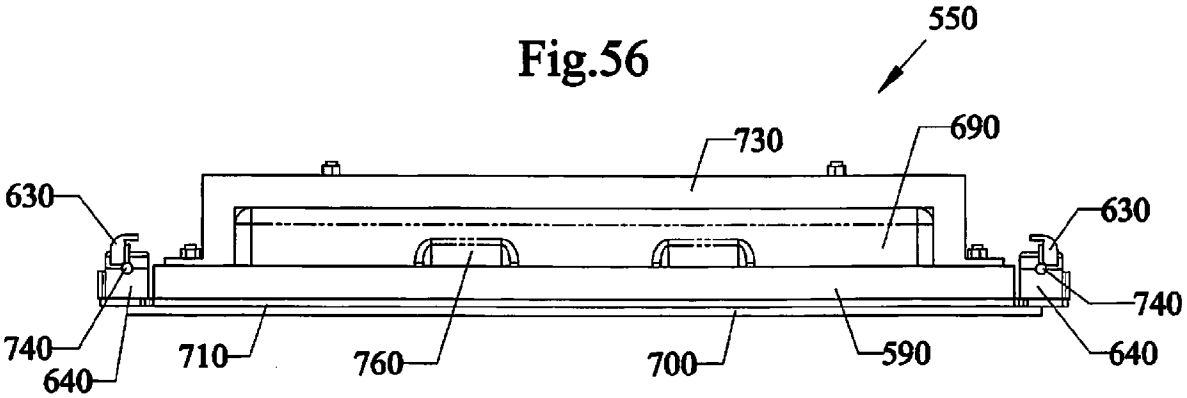

FIG. 56 is a bottom view of the secondary door assembly of FIG. 54.

Half-Panel Door Damper System

Figure 57:
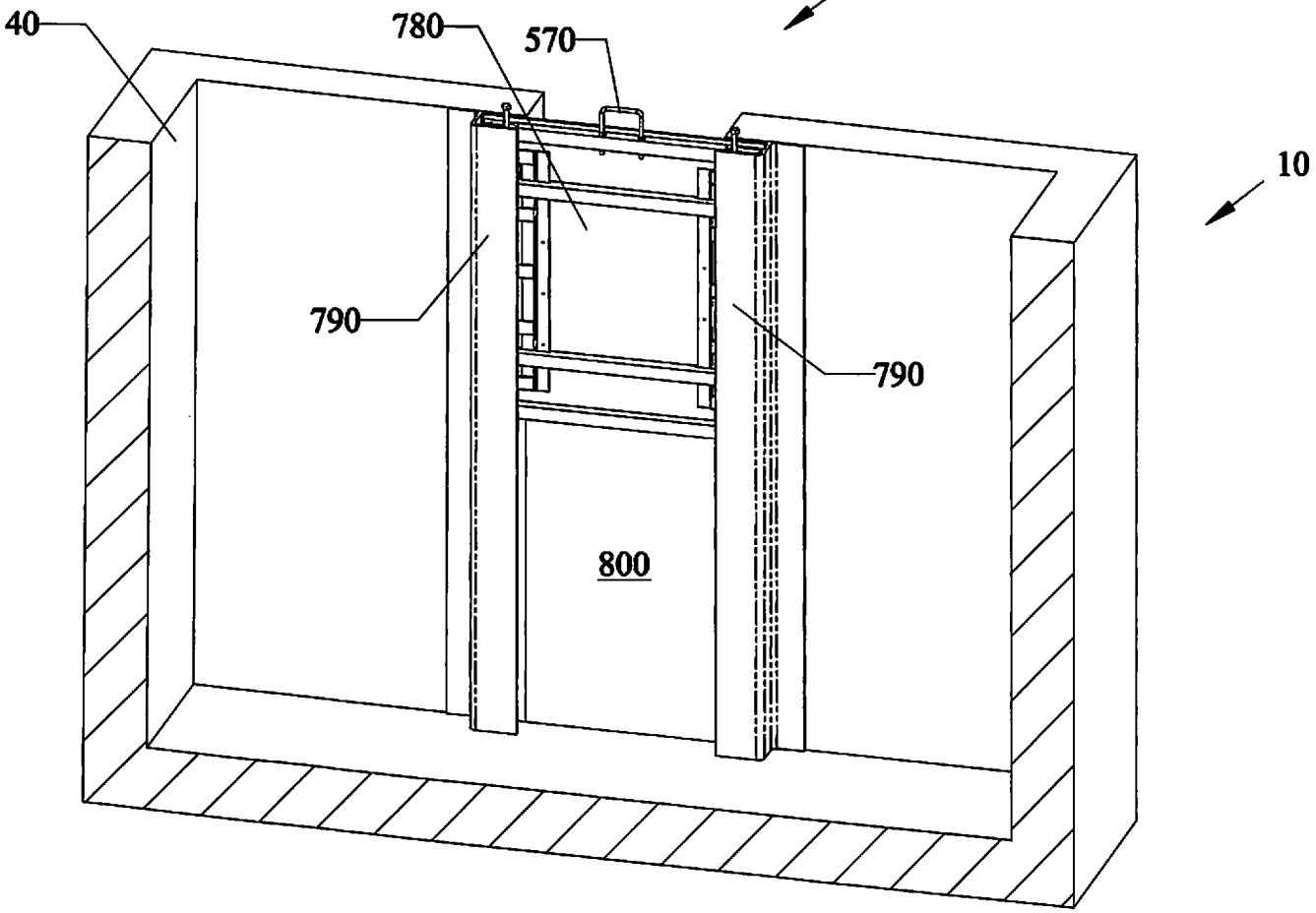

FIG. 57 is a front perspective view of a half-panel door damper system.

Figure 58:
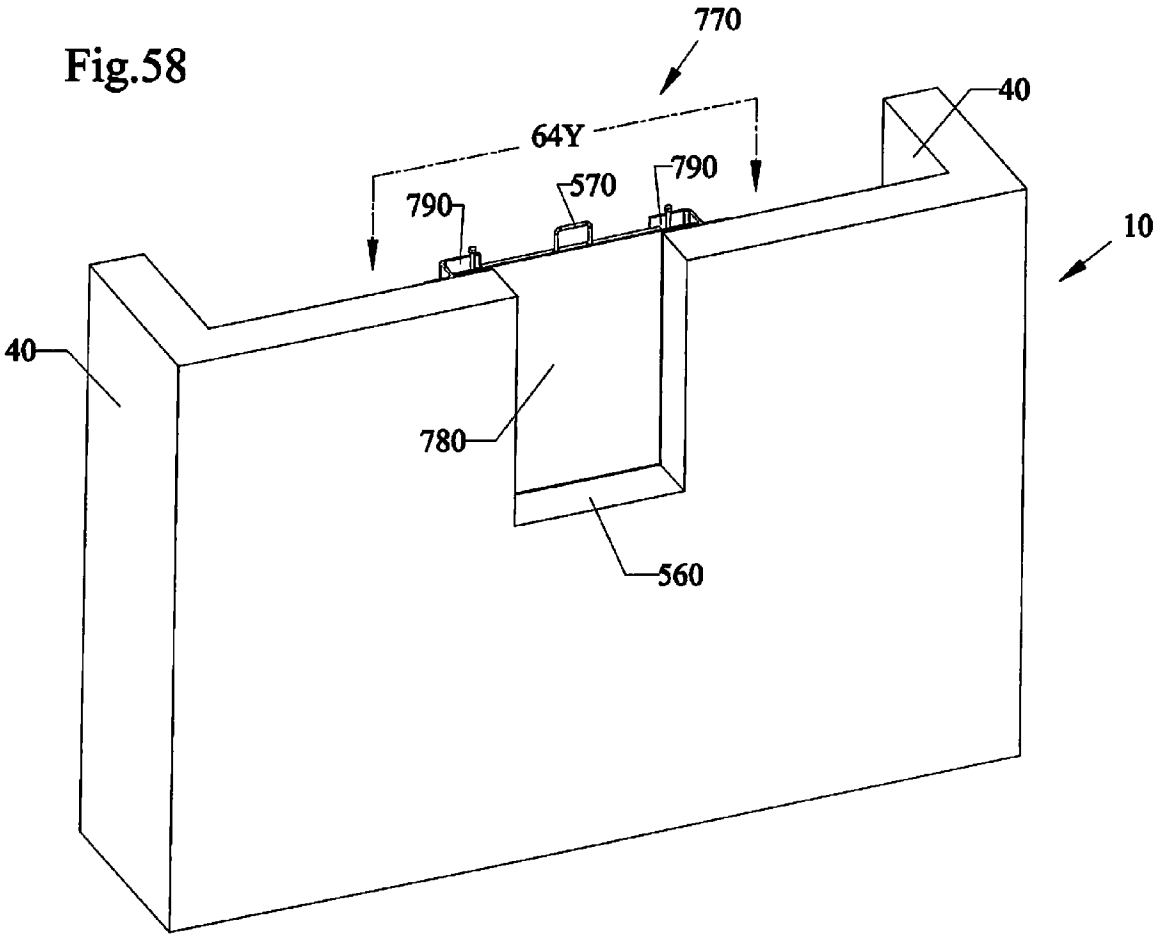

FIG. 58 is a rear perspective view of the half-panel door damper system of FIG. 57.

Figure 59:
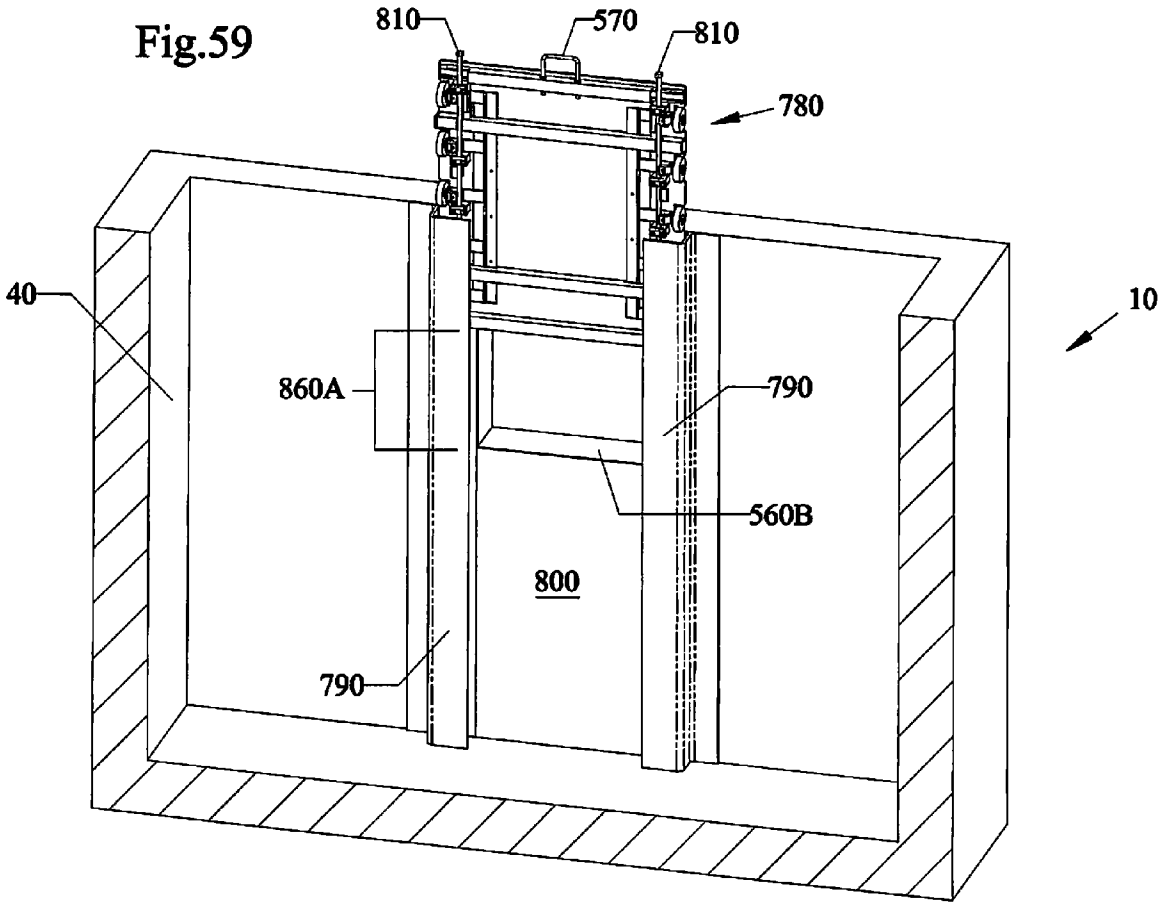

FIG. 59 is a front perspective of the half-panel system of FIG. 57 showing the door locked half up to reveal an underflow passage for storm water flow. The size of this passage can be adjusted by locking the door in different positions.

Figure 60:
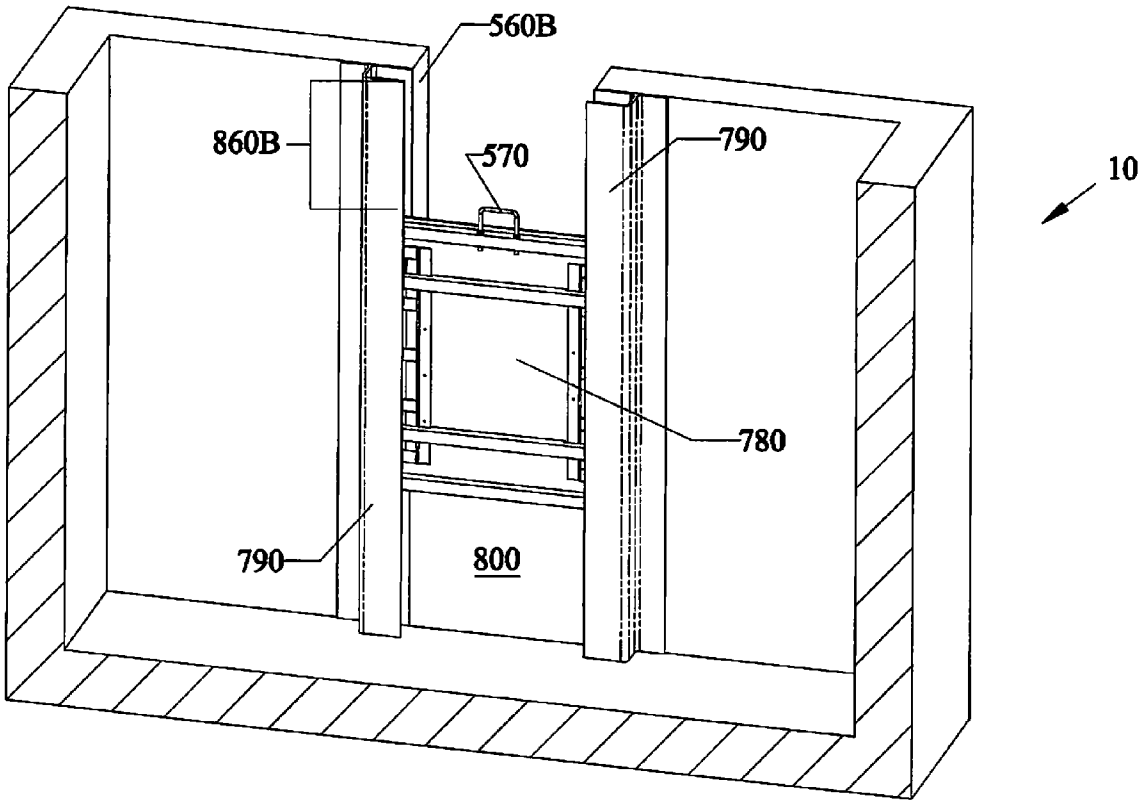

FIG. 60 is a front perspective view of the half-panel system of FIG. 57 showing the door locked half down to reveal an overflow passage for storm water flow. Like the underflow passage, the size can be adjusted by locking the door in different positions.

Figure 61:
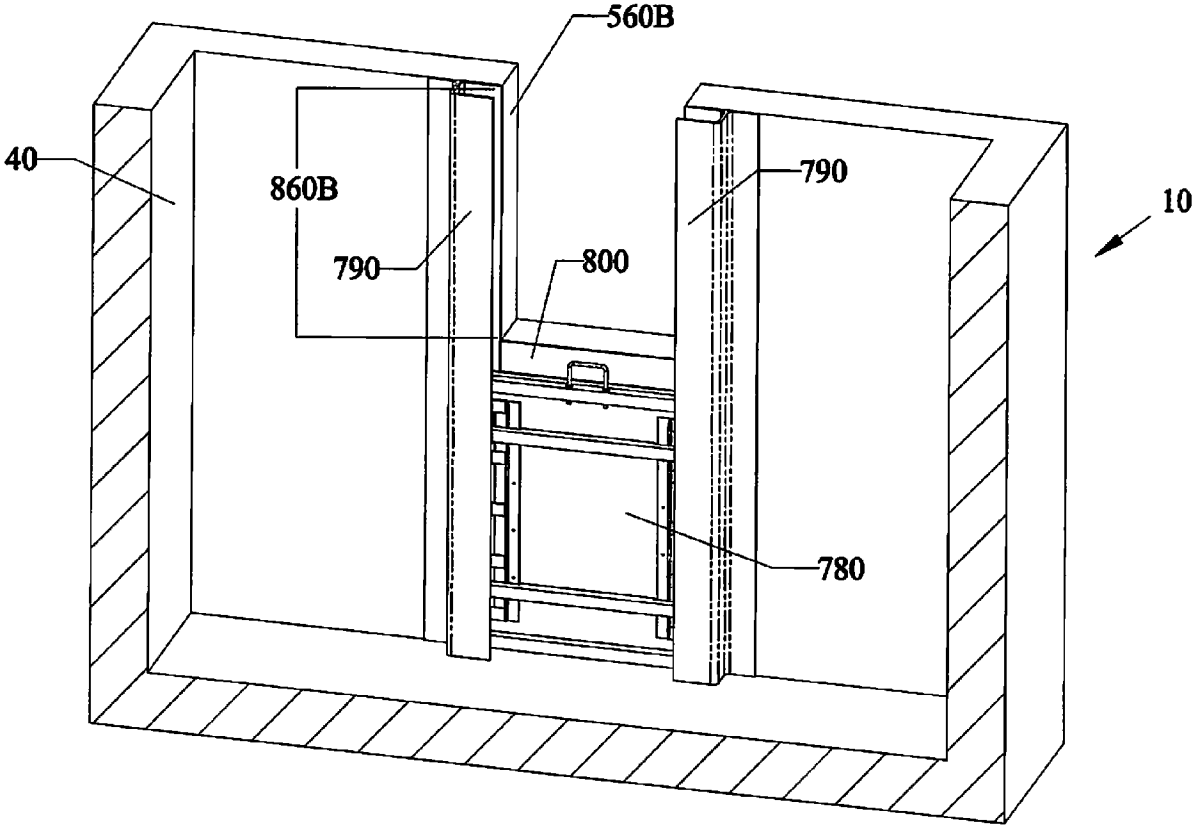

FIG. 61 is a front perspective view of the half-panel system of FIG. 57 showing the door all the way down to reveal maximum overflow passage for storm water flow.

Figure 62:
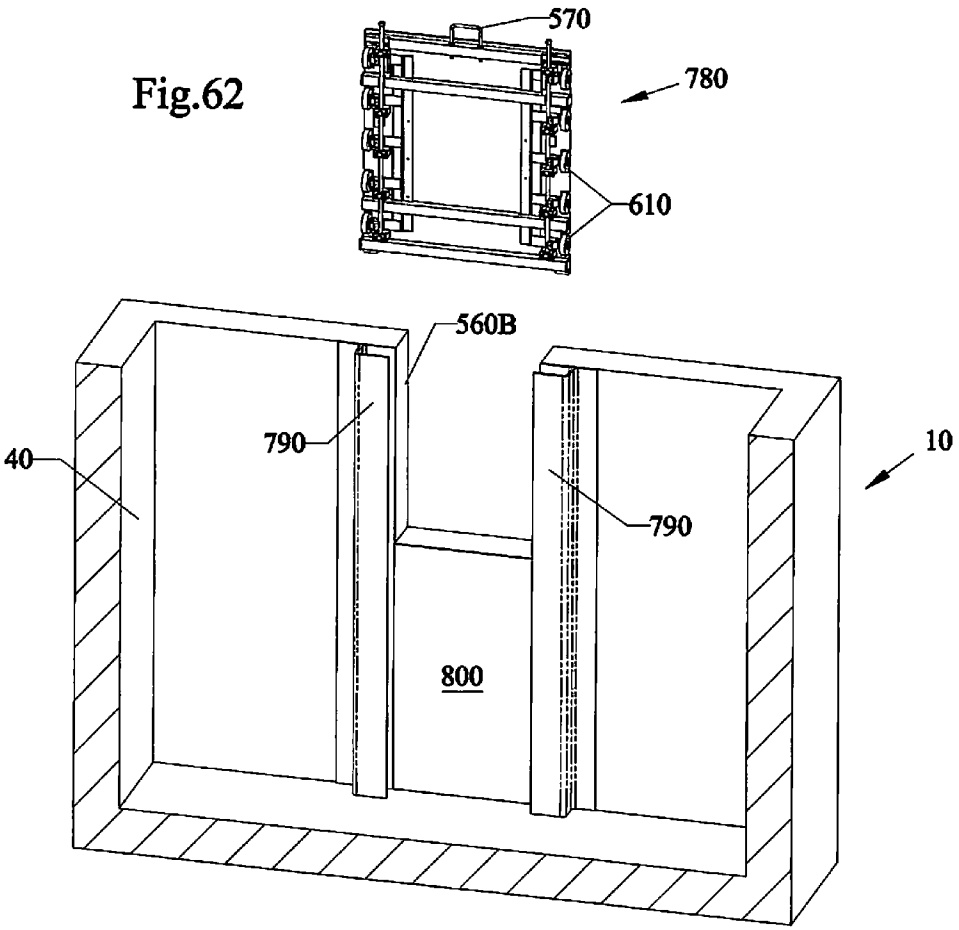

FIG. 62 is a front perspective view of the half-panel system of FIG. 57 showing the door removed from the frame.

Figure 63:
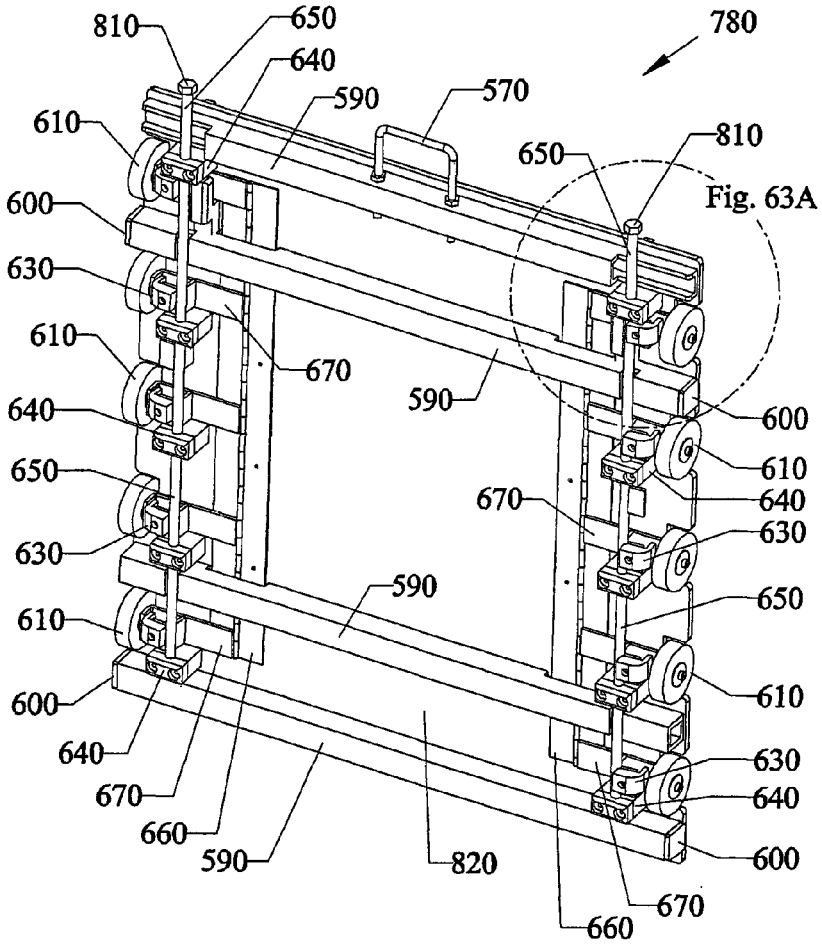

FIG. 63 is a front perspective view of the half-panel panel door assembly of FIG. 57.

Figure 63A:
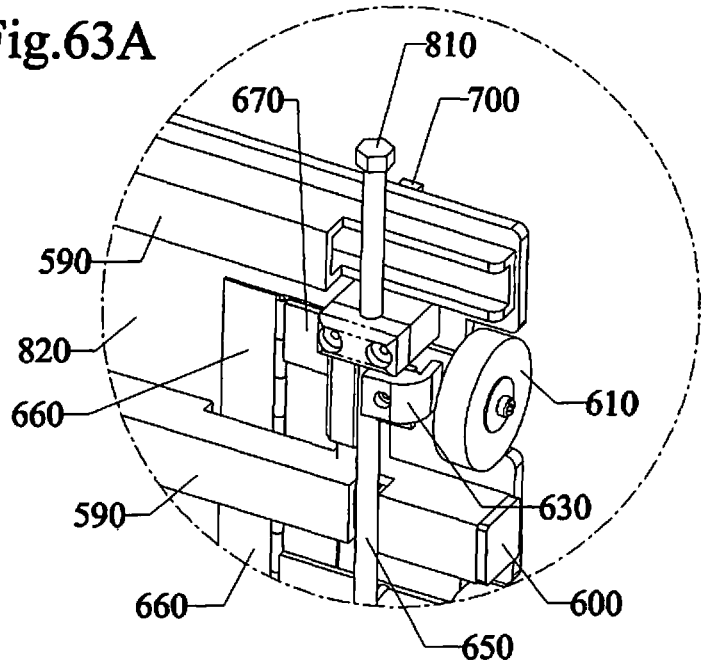

FIG. 63A is an enlarged view of the lock and wheel mechanism of FIG. 63##

Figure 63B:
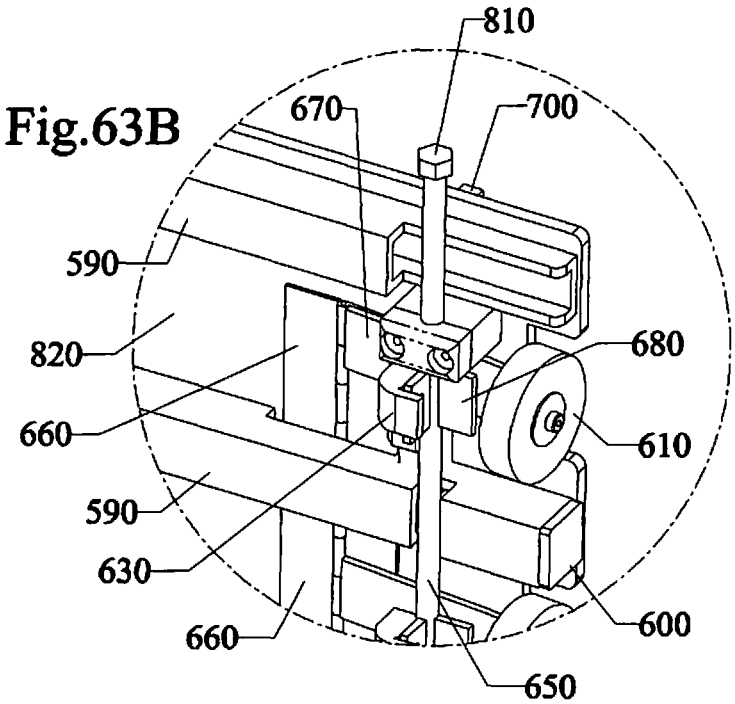

FIG. 63B is an enlarged view of the lock and wheel mechanism of FIG. 63##

Figure 64:
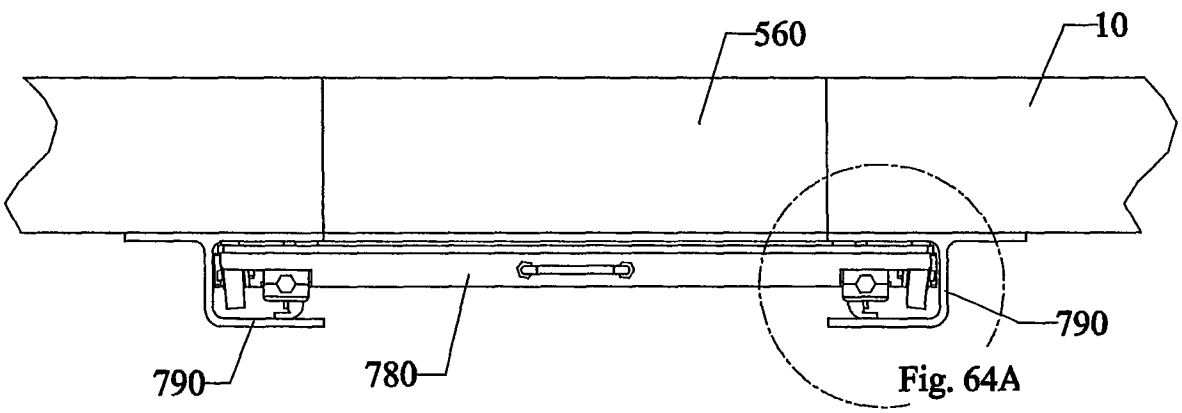

FIG. 64 is a top view of the half-panel door assembly of FIG. 58 along arrow 64Y locked into the frame.

Figure 64A:
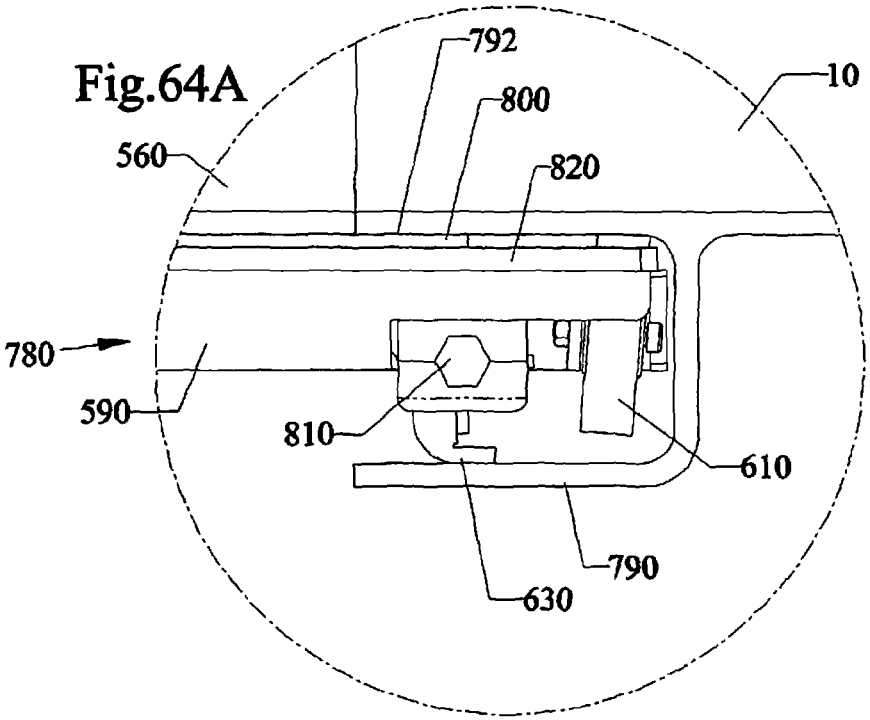

FIG. 64A is an enlarged view of the lock and wheel mechanism detail of the half-panel door assembly of FIG. 64 shown with cam locks engaged and foam rubber seal pressed against the inside of the frame.

Figure 64B:
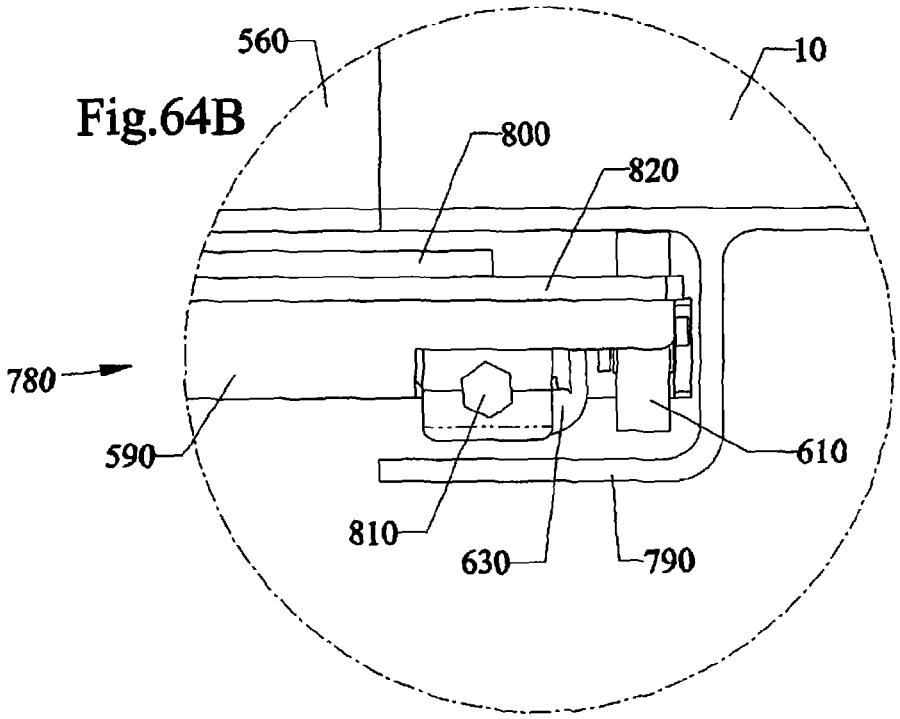

FIG. 64B is an enlarged view of the lock and wheel mechanism detail of the half door assembly of FIG. 64 shown with wheels locked and engaged with the frame for ease of door removal.

Figure 65:
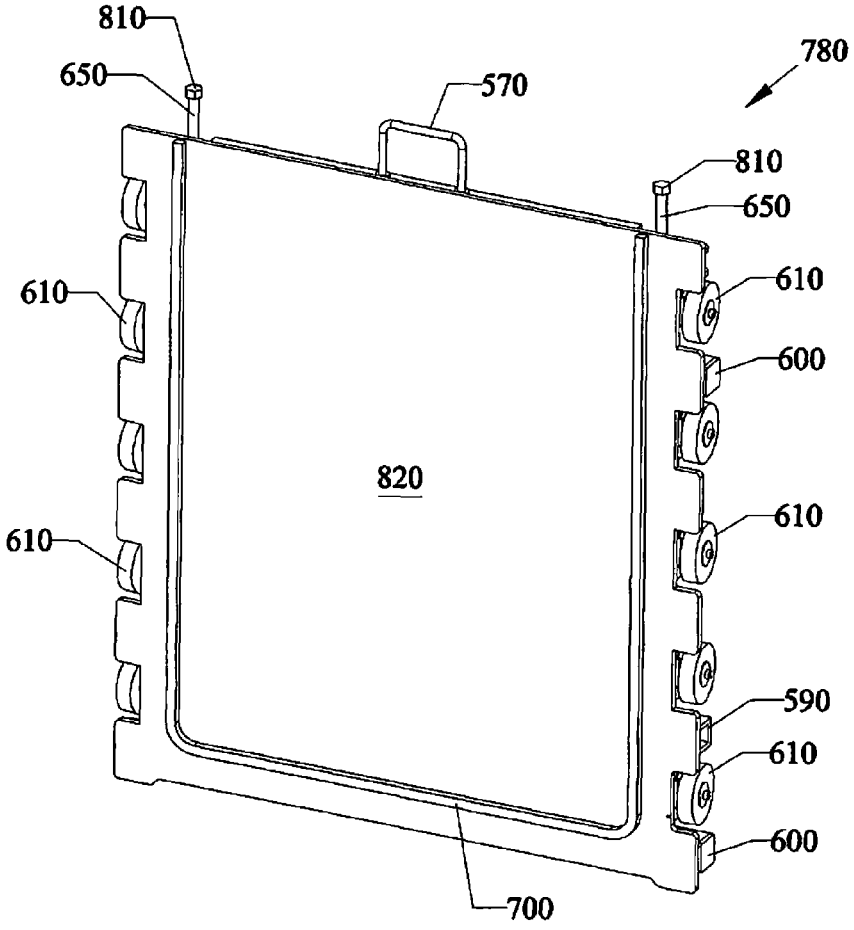

FIG. 65 is a rear perspective view of the half-panel door assembly of FIG. 57.

Figure 66:
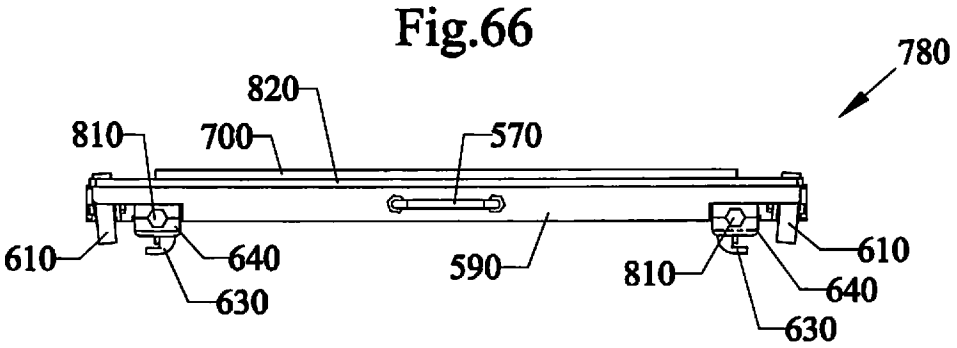

FIG. 66 is a top view of the half-panel door assembly of FIG. 65.

Figure 67:
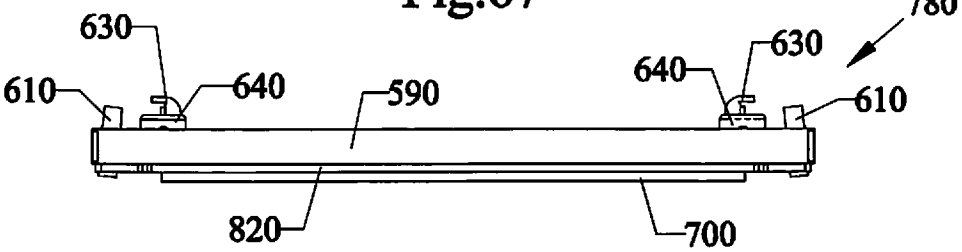

FIG. 67 is a bottom view of the half-panel door assembly of FIG. 65.

Figure 68:
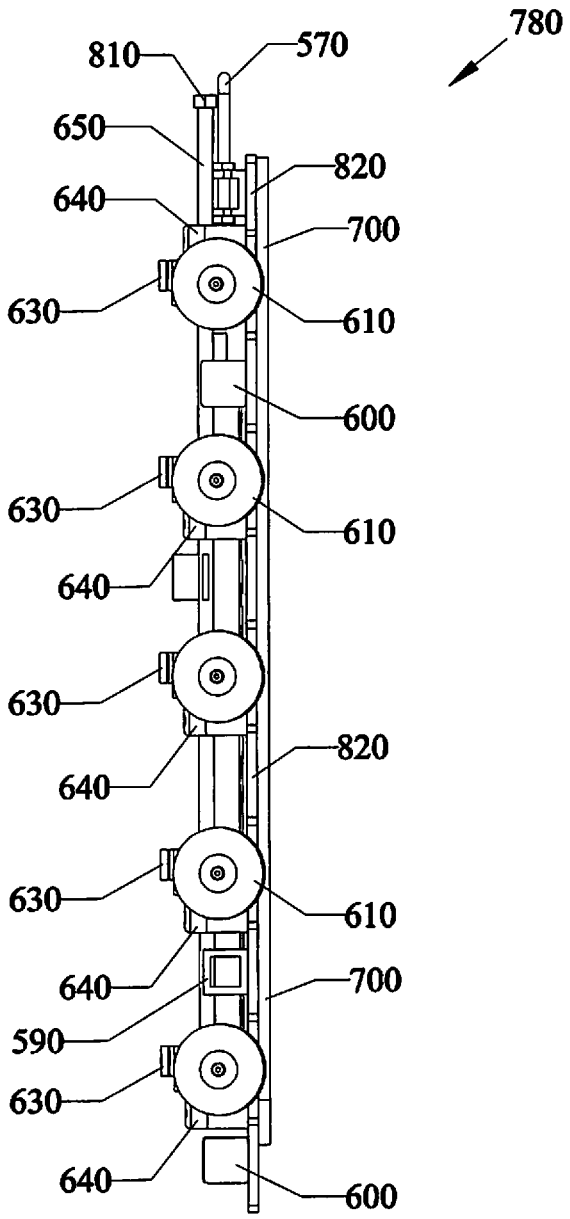

FIG. 68 is a side view of the half-panel door assembly of FIG. 65.

Concrete Channel Installation

Figure 69:
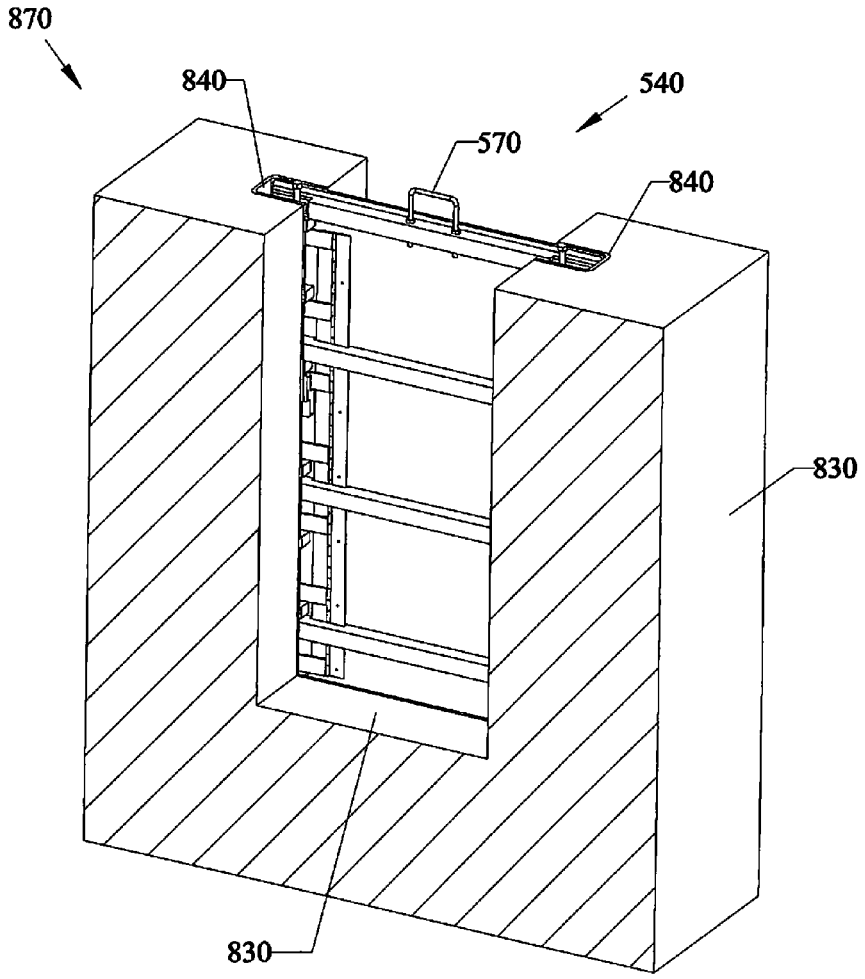

FIG. 69 is a front perspective view of a concrete damper system installed into a concrete channel with the frame inserted into the concrete.

Figure 70:
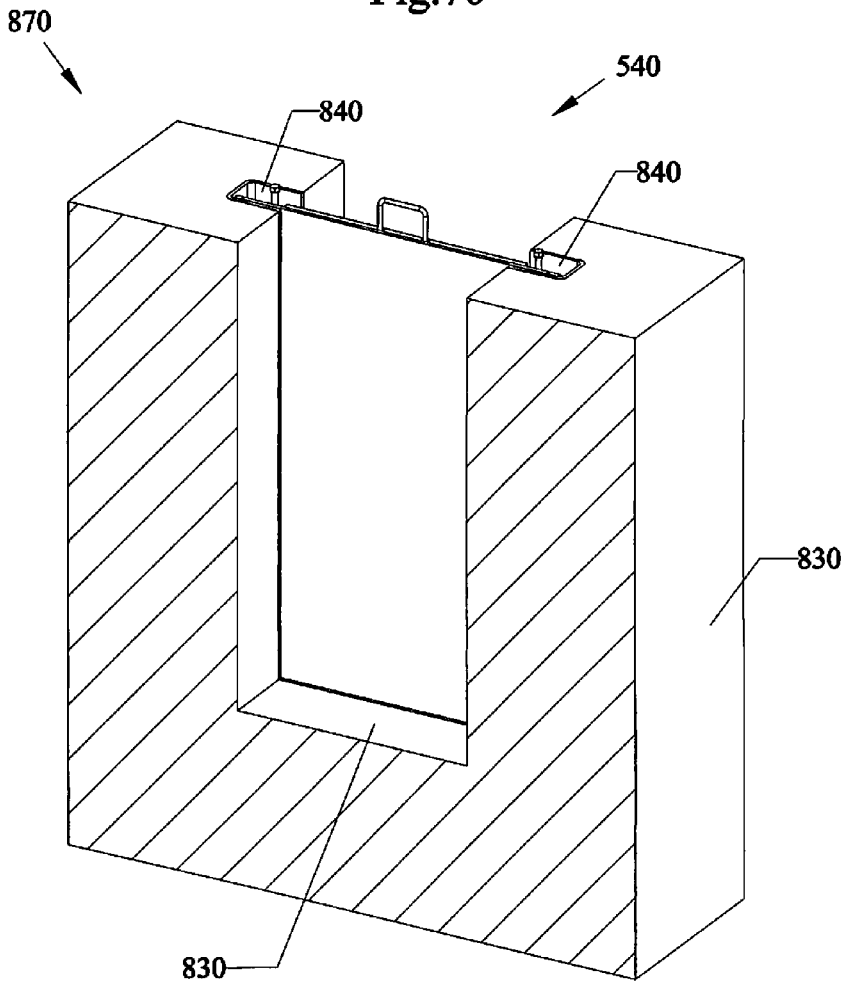

FIG. 70 is a rear perspective view of the concrete damper system of FIG. 69 installed into a concrete channel.

Figure 71:
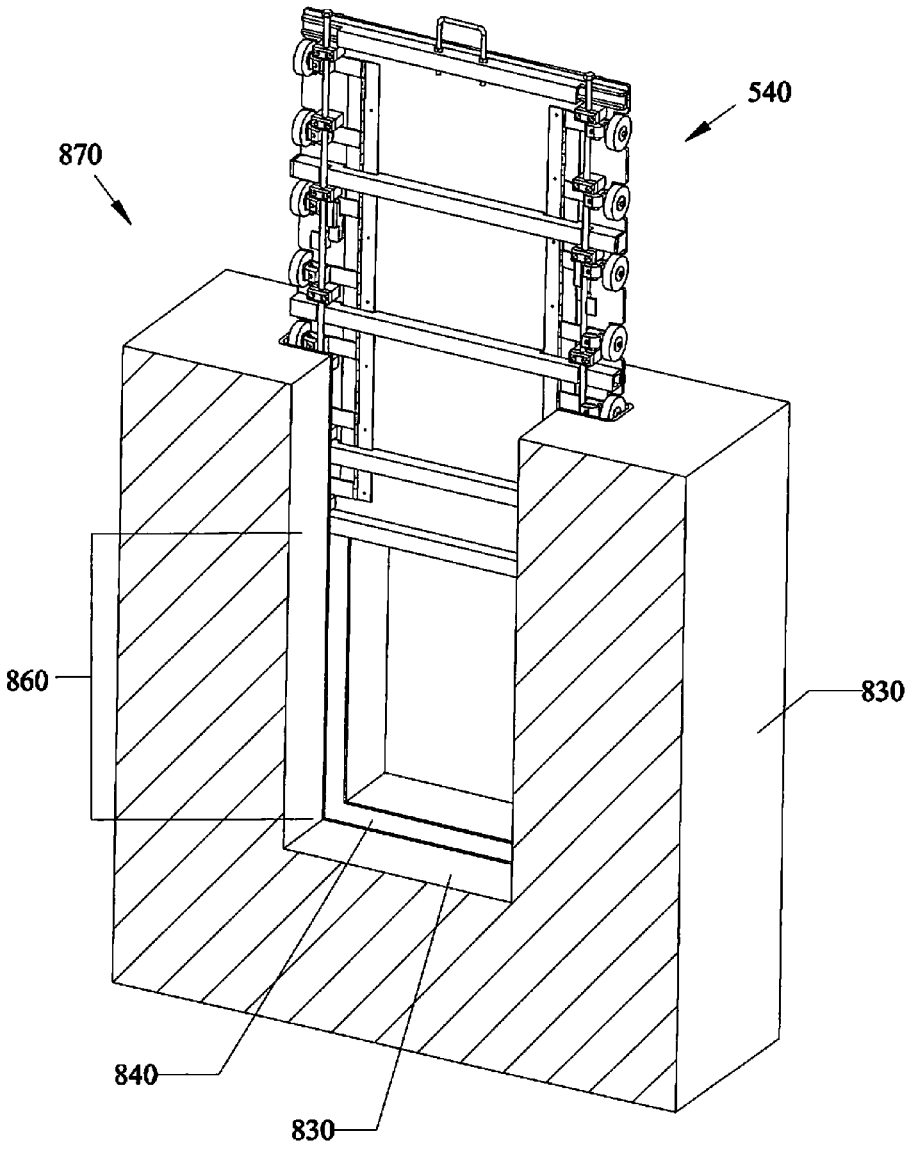

FIG. 71 is a front perspective view of the concrete channel damper system of FIG. 69 showing the door locked half up to reveal an underflow passage for storm water flow.

Figure 72:
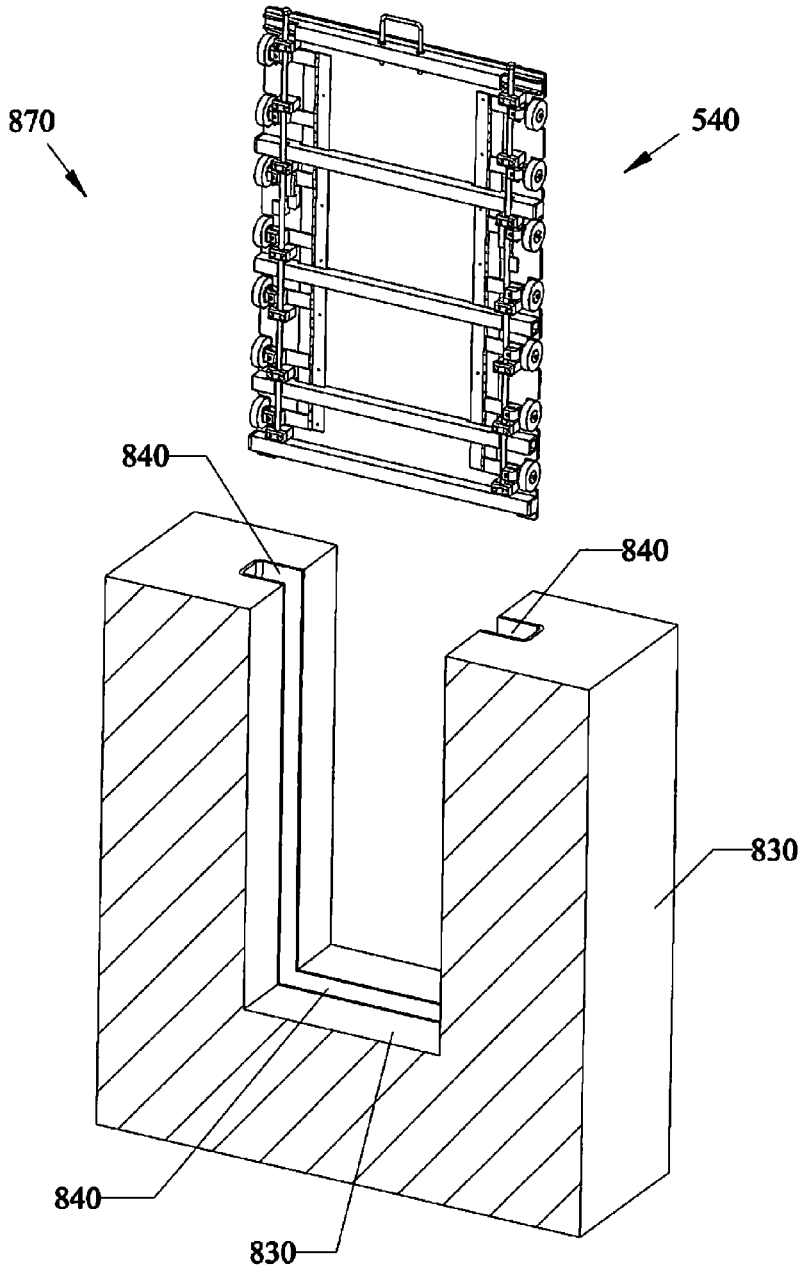

FIG. 72 is a front perspective view of the concrete channel damper system of FIG. 69 showing the door removed from channels.

Figure 73:
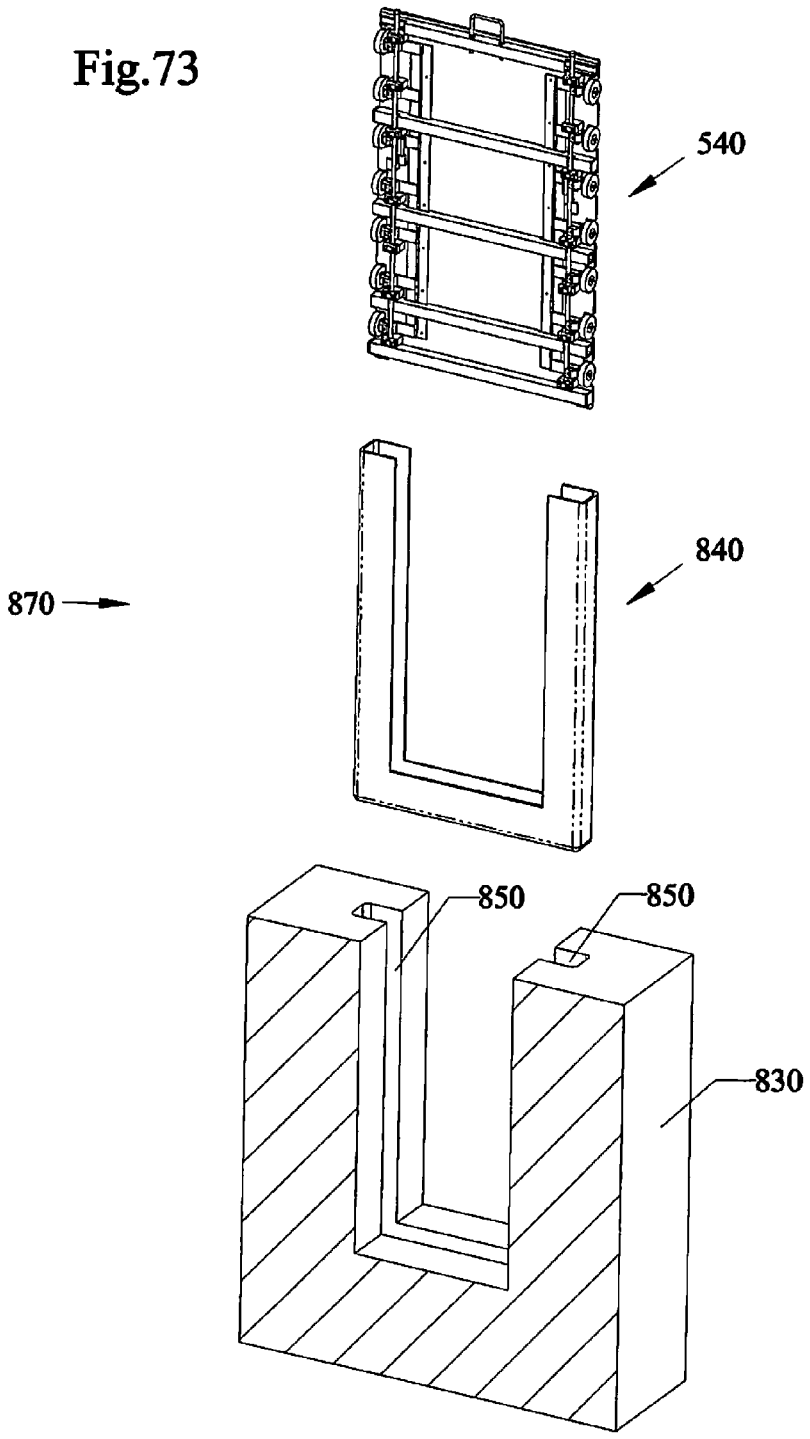

FIG. 73 is a front perspective of the concrete channel damper system showing door and channel removed.

Figure 74:
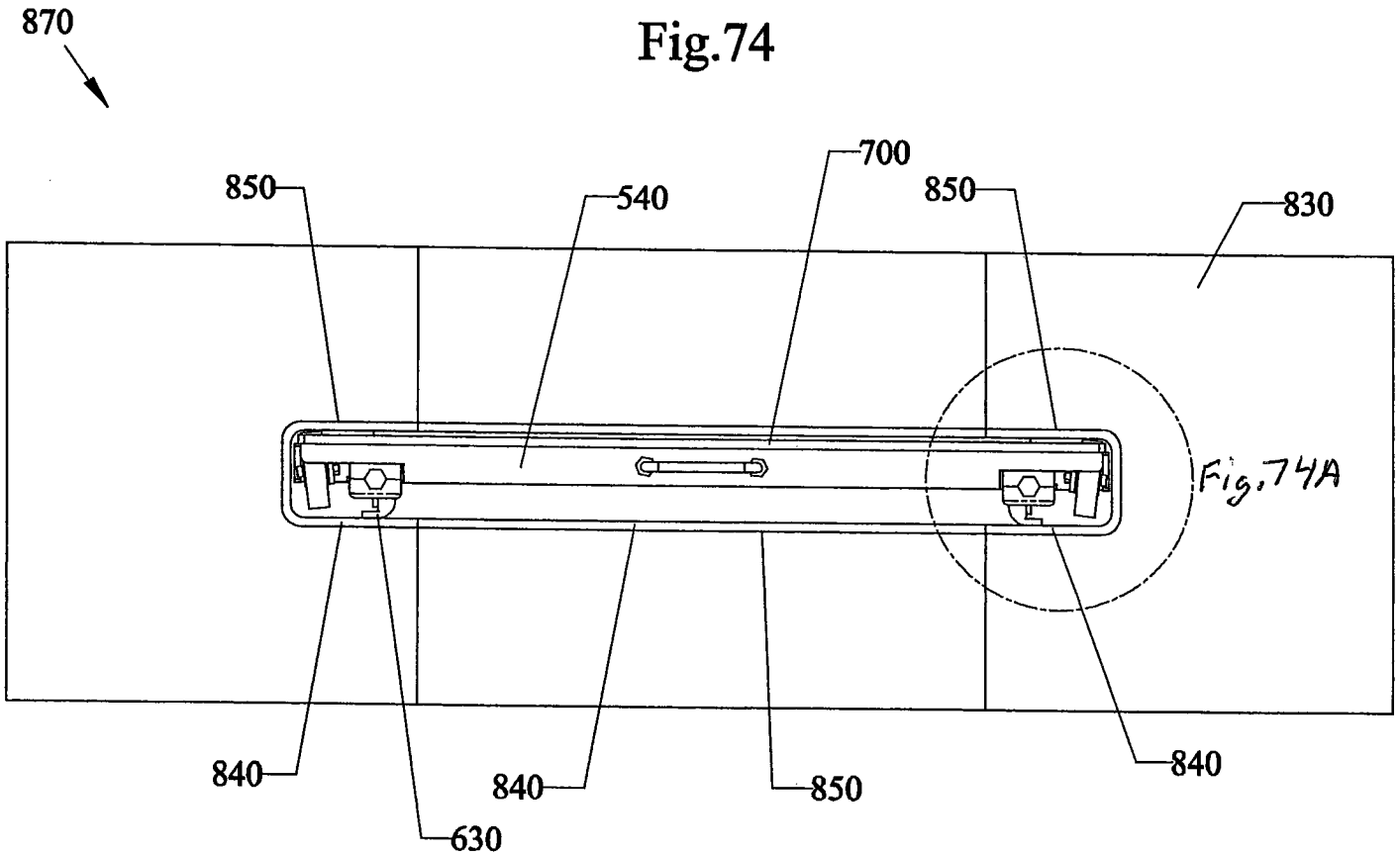

FIG. 74 is a top view of the concrete channel damper system of FIG. 69.

Figure 74A:
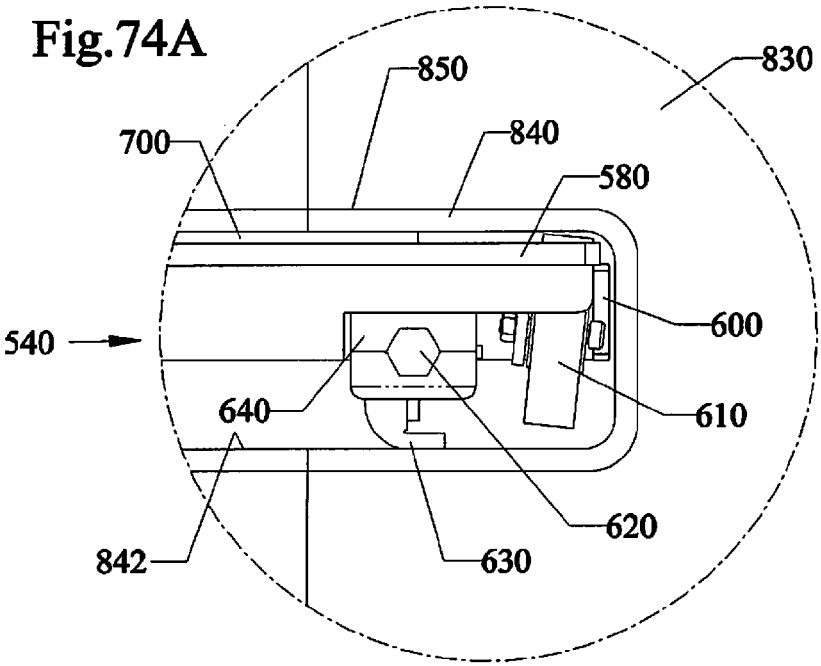

FIG. 74A is an enlarged view of the lock and wheel mechanism detail of the channel damper door assembly of FIG. 74 shown with cam locks engaged and foam rubber seal pressed against the inside of the frame.

Figure 74B:
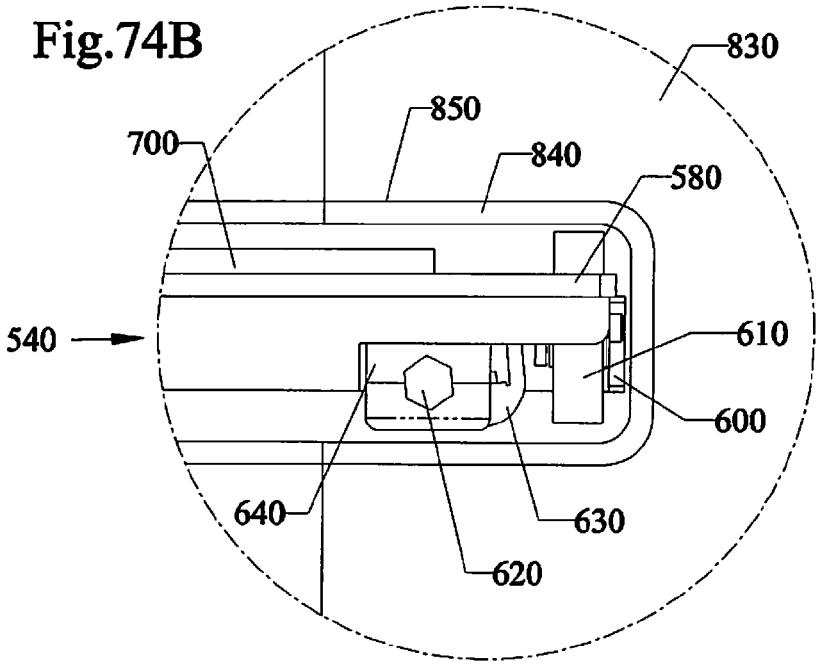

FIG. 74B is an enlarged view of the lock and wheel mechanism detail of the channel damper door assembly of FIG. 74 shown with wheels locked and engaged with the frame for ease of door removal.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of components will now be described.

10. Concrete storm water handling vault.
20. Storm water inflow.
30. Storm water outflow.
40. Vault wall.
40A. Inner wall
50. Novel damper system with wheels.
60. Vault inlet.
70. Vault outlet pipe.
80. Composite frame.
90. Novel panel assembly with wheels.

95. Grooves in side edges of panel 92.
100. Panel lift handle.
110. Front wall of composite frame.
112/114. Parallel Tracks(left channel and right channel)
116. Lower channel of front wall.
120. Damper panel release hex.
130. Frame mounting holes.
140. Frame mounting flange.
150. Frame gussets(such as angled strengthening members)
160. Back wall of composite frame.
170. Articulating panel support wheel.
180. Panel.
190. Foam rubber panel seal/gasket members
200. Lock release rod.
210. Damper panel stiffener brace.
220. Damper panel cam-lock.
230. Wheel toggle locking bar.
240. Panel mounted hinge upon which wheel brackets are affixed allow wheels to articulate.
250. Lock release rod mount block.
260. Wheel mount bracket.
270. Stop block prevents cam over-travel in locked or unlocked configuration.
280. Socket Wrench Tool to lock and unlock panel.
285. Hex head
289. Hand wrench
290. Panel cutout to clear support wheel.
300. Water pressure.
310. Cam-lock mounting bar welded to lock release rod.
320. Storm water in vault.
330. wrench tool for remote unlocking of panel assembly.
340. Socket for engaging panel release hex.
350. Universal joint for all-angle operation of remote socket wrench tool.
360. Hook tool for remote lifting of panel assembly.
370. Person.
380. Telescoping tube handle.
390. Ball on hook end to prevent panel lift handle slip.
400. Reinforced lift hook.
10. Concrete storm water handling vault.
40. Vault wall.
510. Inflow Outflow Door Damper System.
520. Secondary door frame bolts to vault.
522. Inside wall of frame
530. Frame gusset.
540. Primary door assembly.
550. Secondary door assembly.
560A. Large storm water inflow opening cut into vault.
560B. Half storm water inflow opening cut into vault
570. Primary door lift handle.
580. Primary damper panel.
590. Panel stiffener brace.
600. Panel centering bushings center panel in secondary door frame.
610. Articulating panel support wheel.
620. Panel and wheel release hex for primary door.
630. Panel cam lock.
640. Lock release rod mount block.
650. Panel and wheel lock release rod for primary door or half-panel door.
660. Panel mounted hinge upon which wheel brackets are affixed to allow wheels to articulate.
670. Wheel mounting bracket.
680. Wheel toggle locking bar.
690. Primary door frame is mounted to secondary door.
692. Inside wall of frame 690
700. Foam rubber panel seal.
710. Secondary damper panel.
720. Panel centering bushings center panel in secondary door frame.
730. Secondary door panel and frame stiffeners.
740. Panel lock rod for secondary door.
750. Panel release hex for secondary door.
760. Secondary door gussets.
770. Half-panel Door Damper System.
780. Half-panel door assembly.
790. Half-panel frame.
792. Inside wall of frame
800. Half-panel panel seal plate.
810. Panel release hex for half-panel door.
820. Half-panel damper panel.
830. Concrete channel for storm water flow.
840. Frame for the door assembly is recessed into concrete channel.
850. Recess in concrete for frame.
860. Adjustable storm water passage for inflow outflow door system.
860A. Underflow passage for half-panel
860B. Overflow passage for half-panel
870. Concrete channel damper system The invention is a Continuation-In-Part of U.S. patent application Ser. No. 12/823,727 filed Jun. 25, 2010, which is a Continuation-In-Part of U.S. patent application Ser. No. 12/533,806 filed Jul. 31, 2009, both of which are incorporated by reference.

FIG. 1 is a top perspective view of prior art type concrete storm water handling vault 10 that can have four vault walls 40 with storm water 20 inflow coming in through an inlet opening 60 into the vault 10 and eventually flow out 30 through an outlet pipe 70. The external housing of the storm-water vault 10 or treatment structure is commonly made of concrete, fiberglass, or plastic.

Figure 2:
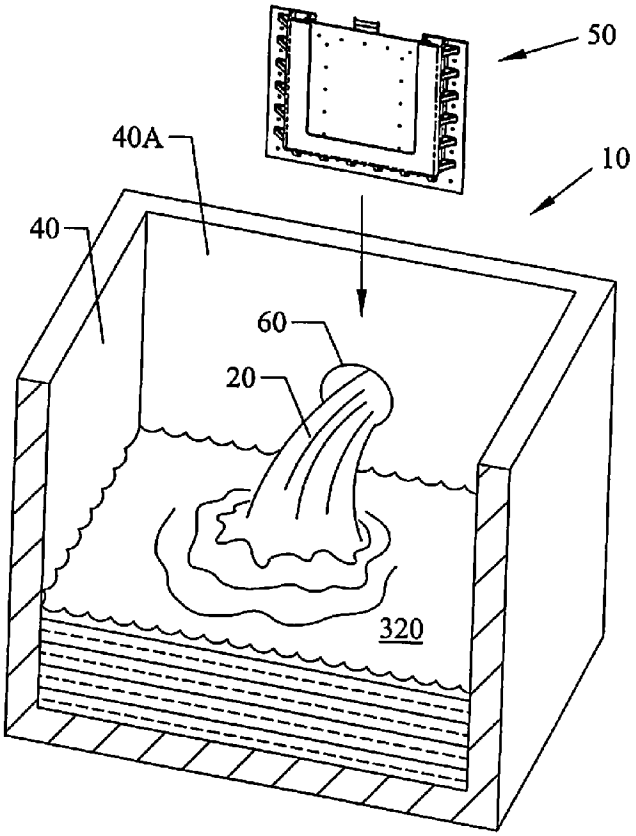
FIG. 2 is a perspective cut-away sectional view of a vault with novel damper system ready to install.
Figure 4:
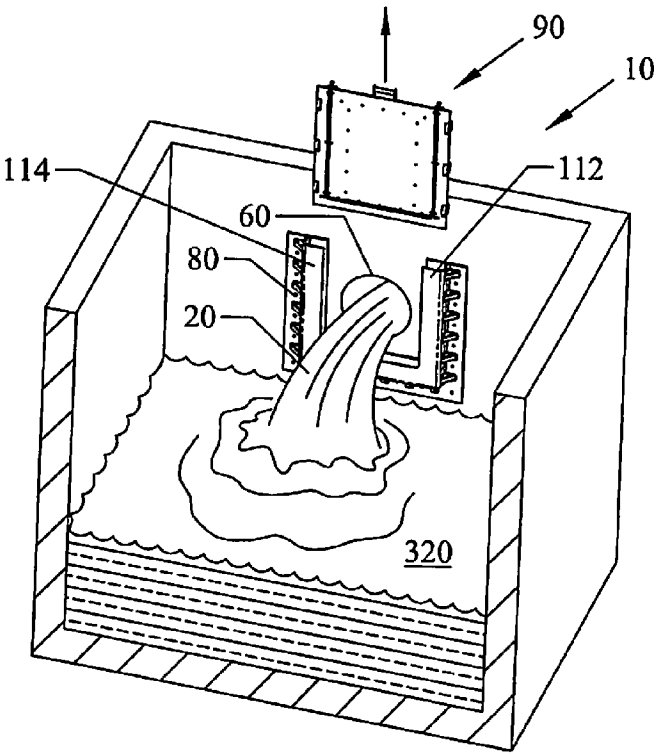
FIG. 4 shows the damper panel assembly removed from the damper frame allowing water to flow.
Figure 3:
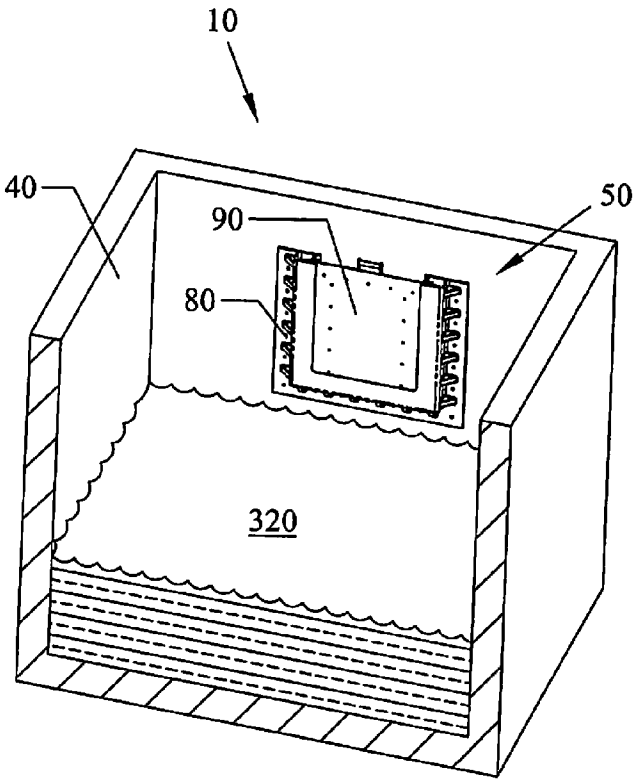
FIG. 3 shows the damper system installed in the vault shutting off water flow.

FIG. 2 is a cut-away perspective section view of the FIG. 1 vault 10 with novel damper system 50 invention ready to be installed to an inner wall 40A over the inlet port 60 to the vault 10. FIG. 3 shows the damper system 50 installed in the vault 10 shutting off water flow with storm water 320 within the vault. FIG. 4 shows the damper panel assembly 90 removed from the damper frame 80 allowing water to flow 20 to flow through vault inlet 60.

The novel damper system 50 can include a composite frame assembly 80 that can attach to the inner surface of the wall 40 about the inlet port 60 by fasteners, such as but not limited to bolts, screws, and the like. Once installed, a damper panel assembly with wheels 90 can slide into parallel tracks 112, 114 in the frame assembly 80 to close off the inlet port 60.

Figure 6:
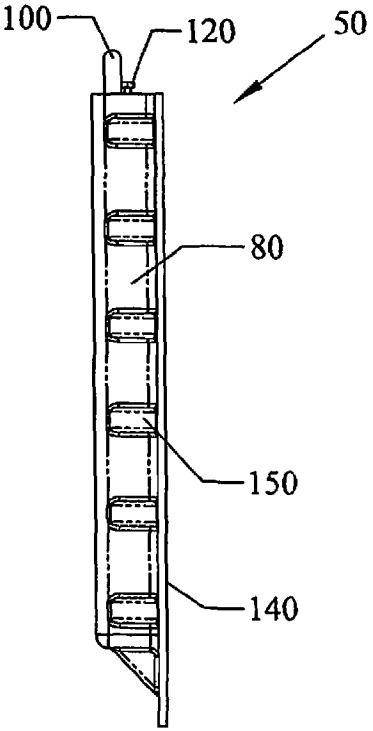
FIG. 6 is a side view of the damper system of FIG. 5.
Figure 5:
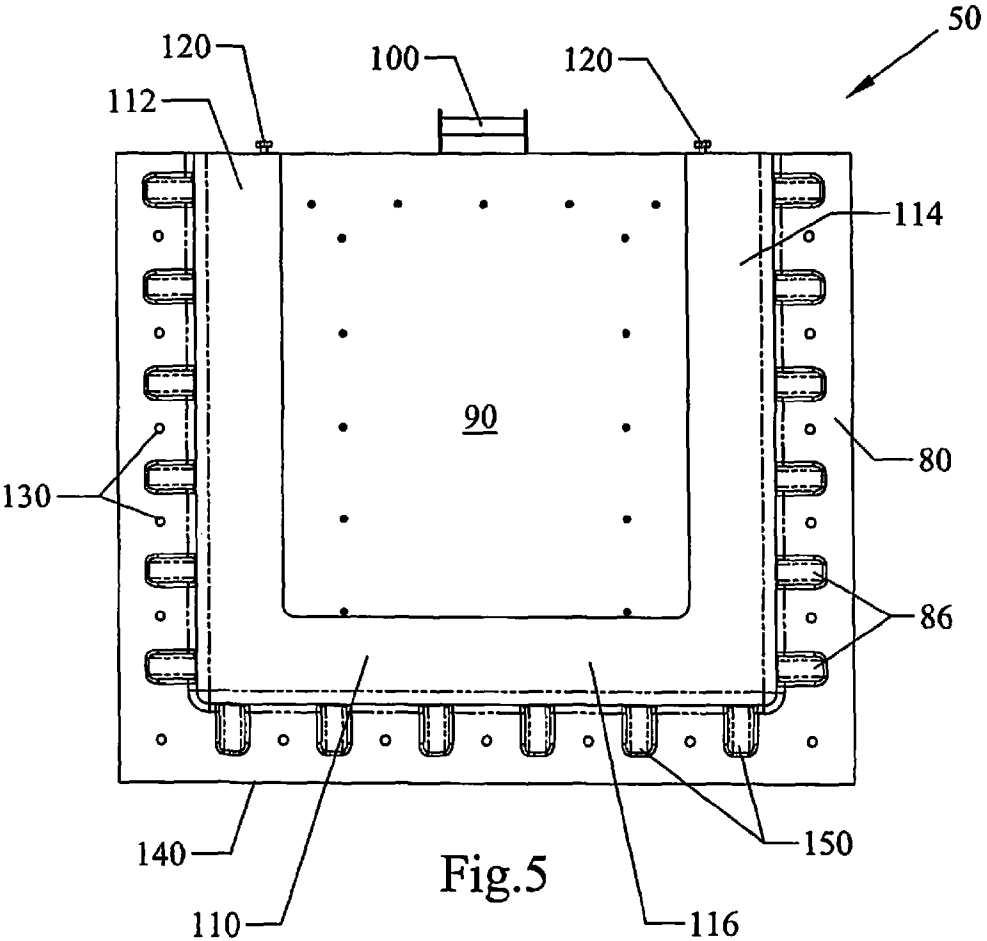
FIG. 5 is a front view of the damper system of FIG. 2.
Figure 8:
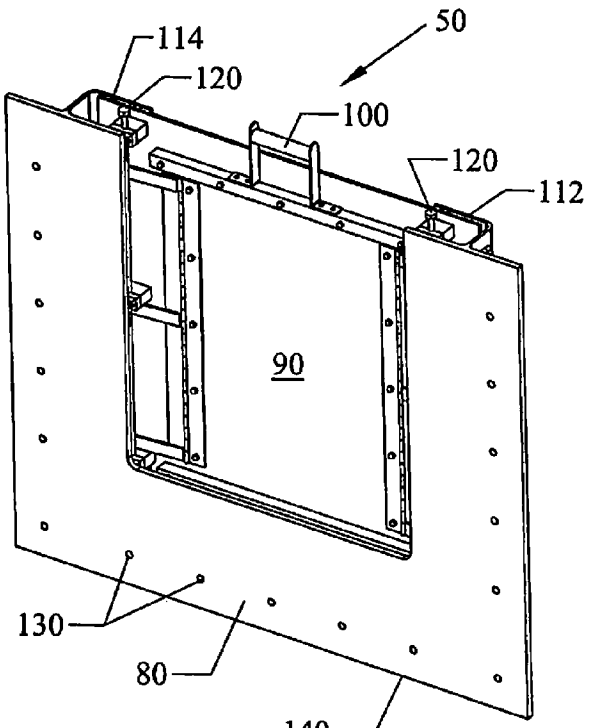
FIG. 8 is a rear perspective view of the damper system of FIG. 5.
Figure 7:
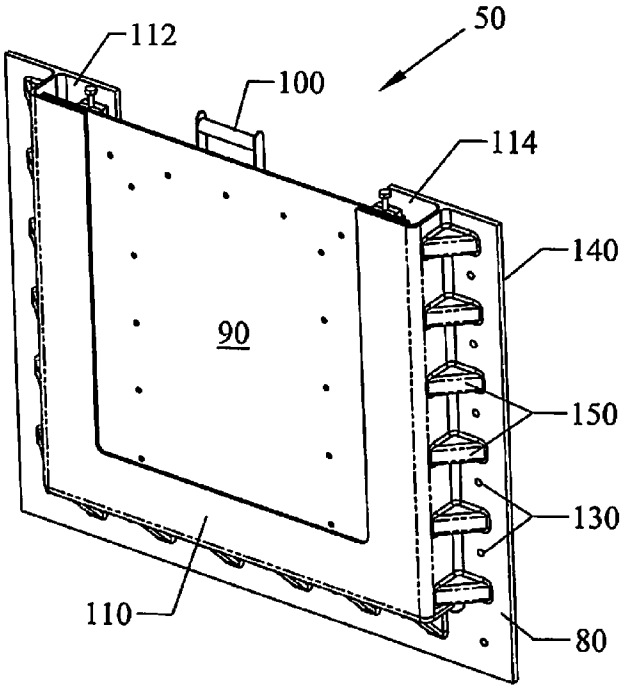
FIG. 7 is a front perspective view of the damper system of FIG. 5.

FIG. 5 is a front view of the damper system 50 of FIG. 2. FIG. 6 is a side view of the damper system 50 of FIG. 5. FIG. 7 is a front perspective view of the damper system 50 of FIG. 5. FIG. 8 is a rear perspective view of the damper system 50 of FIG. 5.

The damper panel 90 can be made from metal such as but not limited to aluminum, galvanized metal, stainless steel, fiberglass, plastic or combinations thereof.

Referring to FIGS. 5-8, frame mounting holes 130 through the U-shaped frame mounted flange 140 of the frame assembly 80 allow for the fasteners to be used to attach the frame assembly 80 to the inner wall 40A of the vault 10. Frame gussets, such as angled strengthening members 150 support the U-shaped flange to the tracks 112, 114. The damper panel 90 can slide along the parallel tracks 112, 114 and sit against a lower channel 116. Across the top of the damper panel 90 is a panel lift handle 100, that can be fastened along bent outer edges by fasteners, such as screws and bolts. The damper panel release hex 120 whose operation of which will be described in greater detail later in reference to FIGS. 14, 15, 18, 19.

Figure 9:
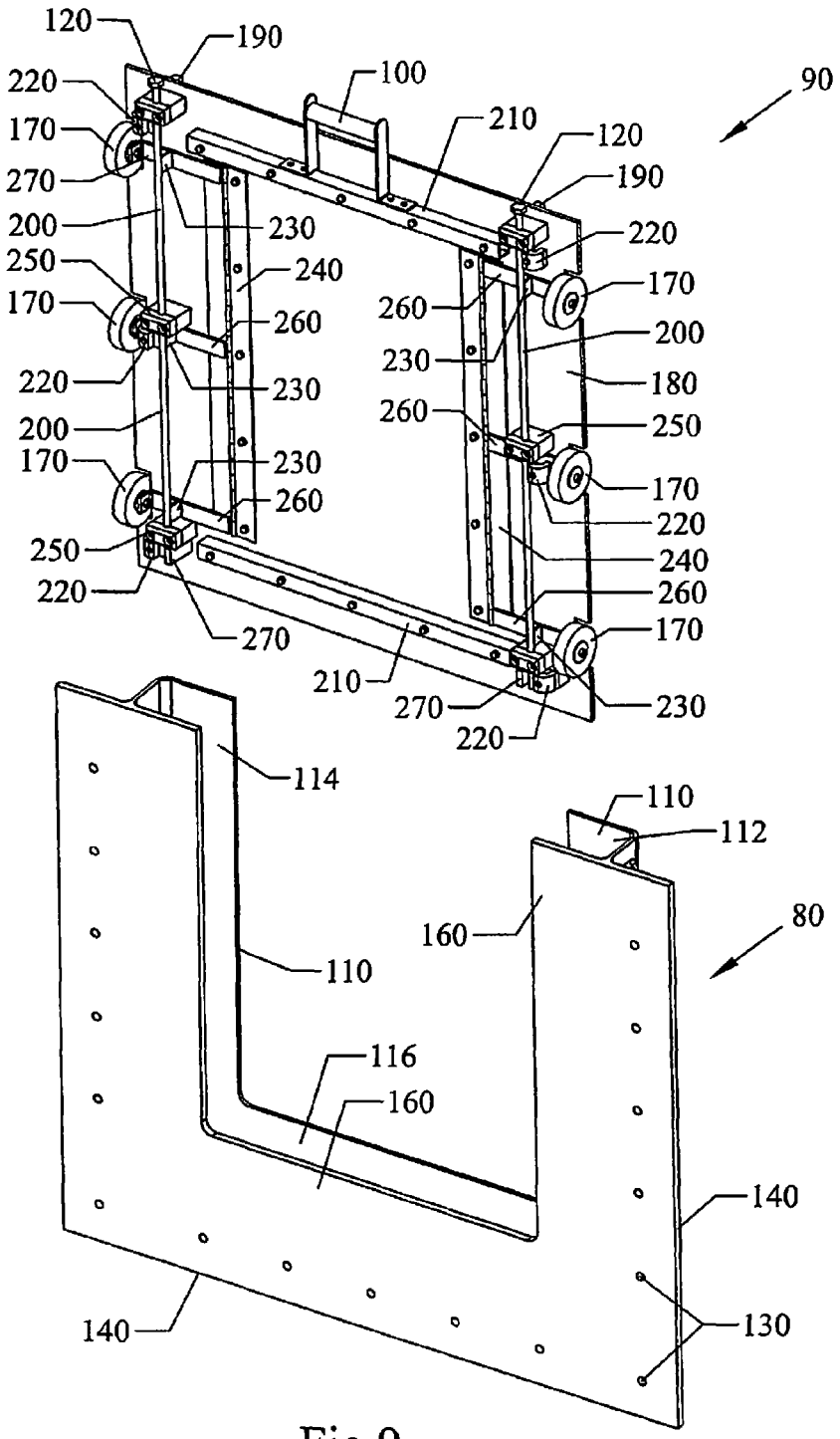
FIG. 9 is a front perspective view of the damper system of FIG. 5 with damper panel removed.
Figure 10:
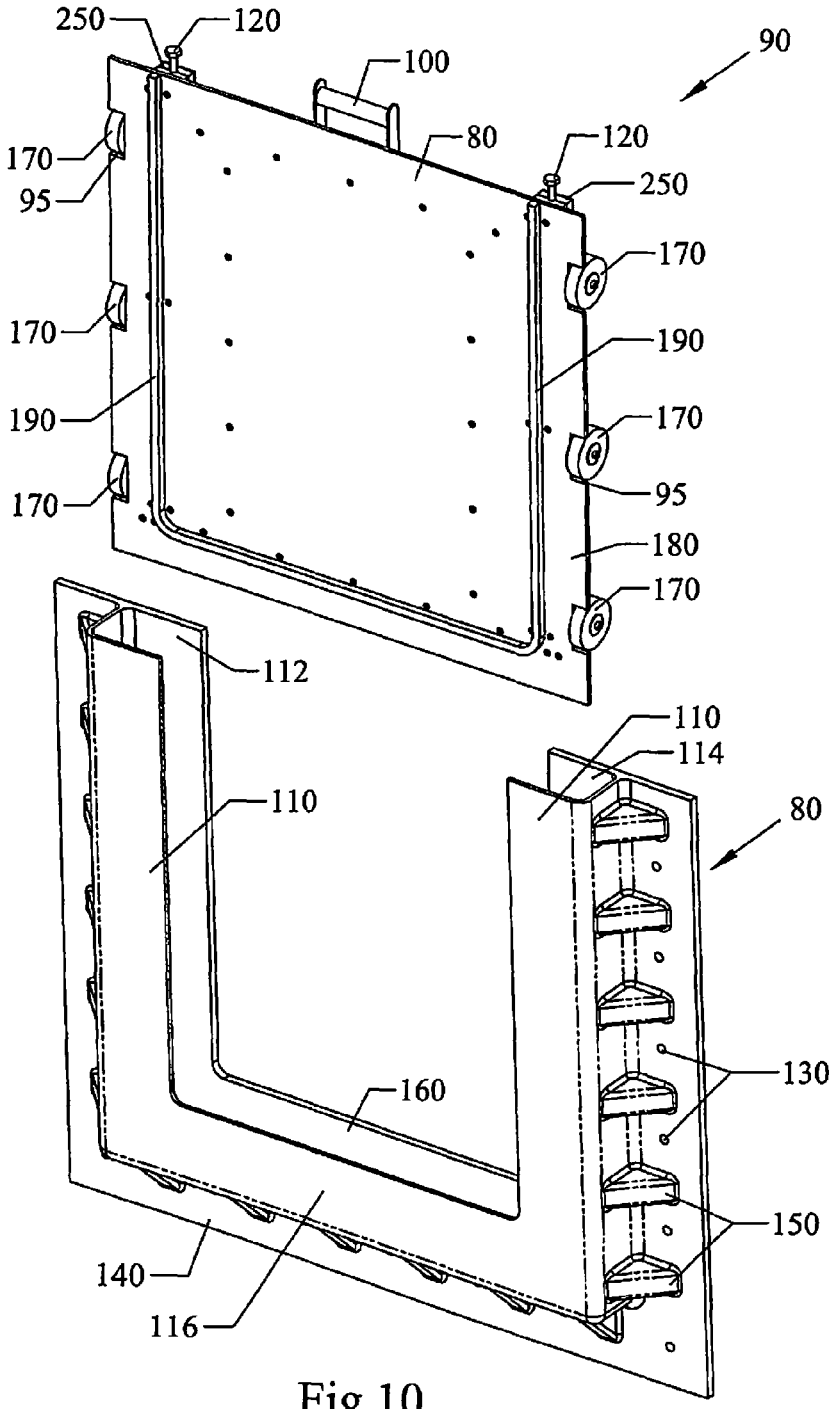
FIG. 10 is a rear perspective view of the damper system of FIG. 5 with damper panel removed.
Figure 12:
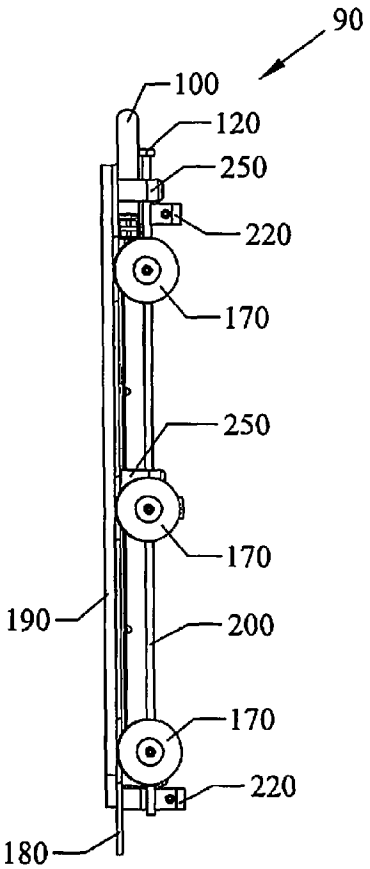
FIG. 12 is a side view of the damper panel of FIG. 11.
Figure 11:
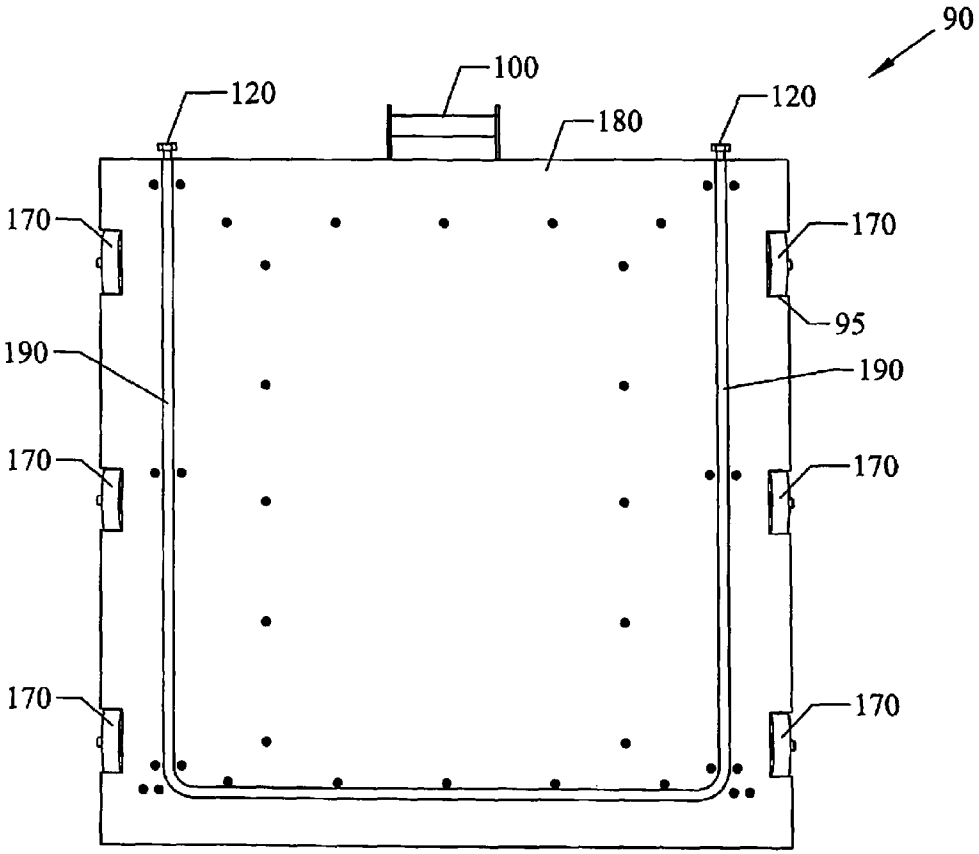
FIG. 11 is a rear view of the damper panel used in the damper system of FIG. 5.
Figure 13:
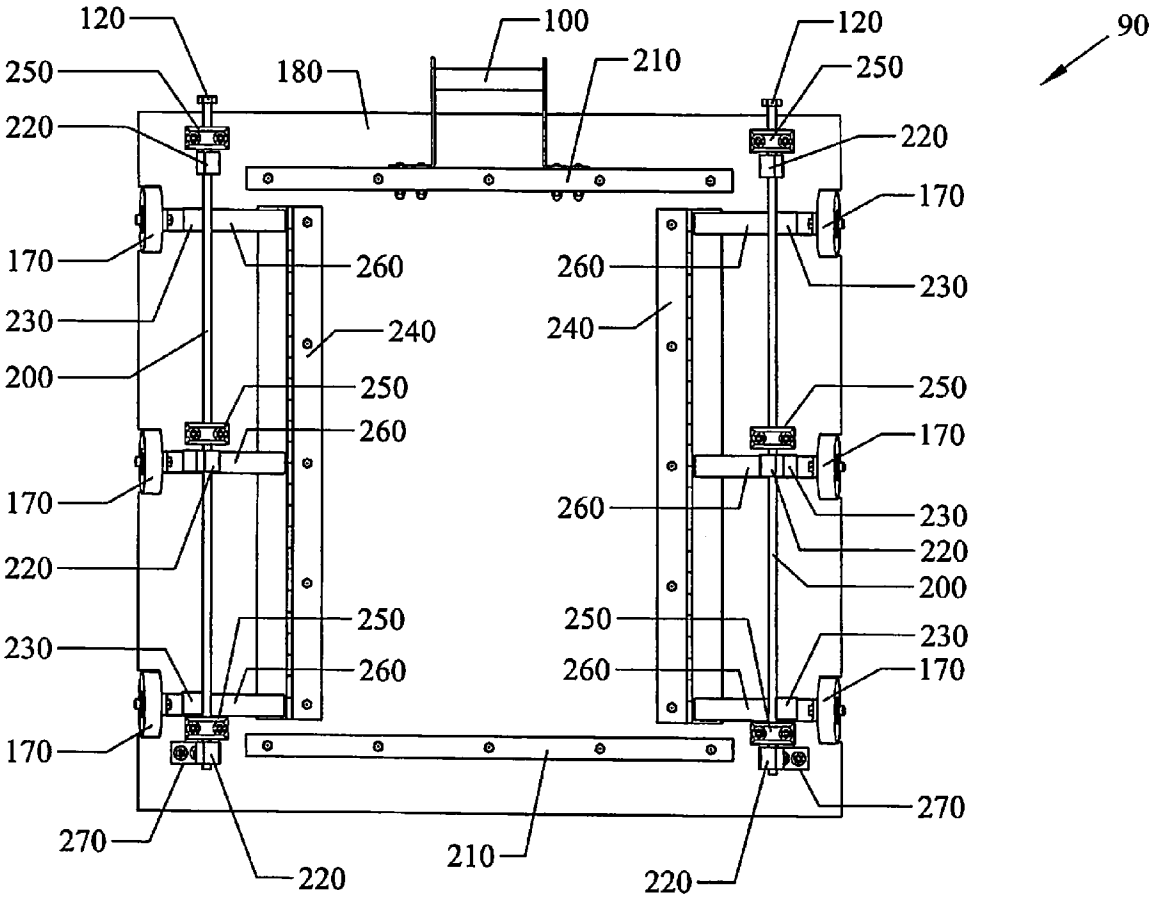
FIG. 13 is a front view of damper panel of FIG. 11.

FIG. 9 is a front perspective view of the damper system 50 of FIG. 5 with damper panel 90 removed from the frame 80. FIG. 10 is a rear perspective view of the damper system 50 of FIG. 5 with damper panel 90 removed from the frame 80. FIG. 11 is a rear view of the damper panel 90 used in the damper system 50 of FIG. 5. FIG. 12 is a side view of the damper panel of 90 FIG. 11, and FIG. 13 is a front view of damper panel 90 of FIG. 11.

Referring to FIGS. 9-13, the novel frame 80 includes a back wall 160 of the frame behind the front wall 110. The panel assembly 90 includes a generally rectangular panel 180, having a plurality of articulating panel support wheels along both the right and side edges of the panel 180, with each of the wheels positioned within grooves 95 in the side edges of the panel 180. A preferred embodiment has three wheels 170 each on wheel mount brackets 260 along each of the right and left side edges of the panel 180 that are moveable by wheel toggle locking bars 230. Panel mounted hinges 240 are located along both the right and left sides of the panel 180 on which the wheel brackets 260 are affixed and which allow the wheels 170 to articulate.

A foam rubber panel seal 190 having a continuous U shaped configuration can be located on the rear side of the panel 180, and in operation can provide a waterseal between panel 180 and the rear wall 160 of the frame 80. Handle 100 can have a base attached by fasteners, such as screws, bolts, and rivets to a damper panel stiffener brace 210.

A lock release rod 200 can have an upper end with a damper panel release hex 120 that allows the rod 200 to be rotated clockwise or counterclockwise. The rod 200 can pass through three lock release rod mount blocks 250 that are arranged on both the left and right sides of the panel 180. A pair of damper panel cam-locks 220 can be arranged on both the left and right sides of the panel and can be controlled by the rotatable rod 200. Stop blocks 270 can be used to prevent cam over-travel in locked or unlocked configurations, and which will be described in further detail below.

As discussed the frame 80 has a left channel 112, and right channel 114 and lower channel 116 that are formed between a front wall 110 and a rear wall 160. Angled frame gussets 150 add strength support to the channels 112, 114, 116, and holes 130 are used for fasteners to mount the frame 80 to an inner vault wall 40A.

Figure 14:
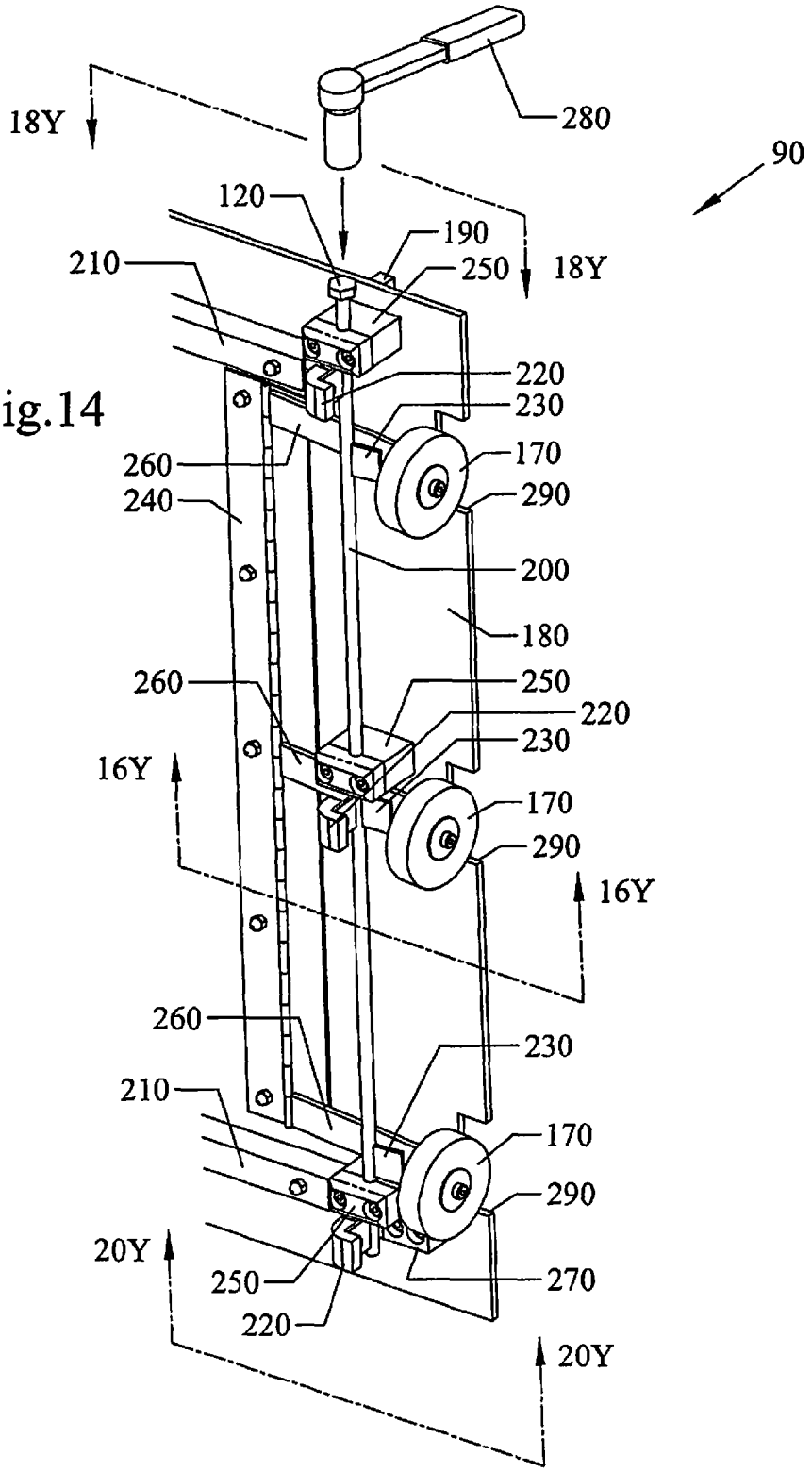
FIG. 14 is a perspective enlarged view of the panel locking system of the damper system of FIG. 5 in a locked configuration.
Figure 15:
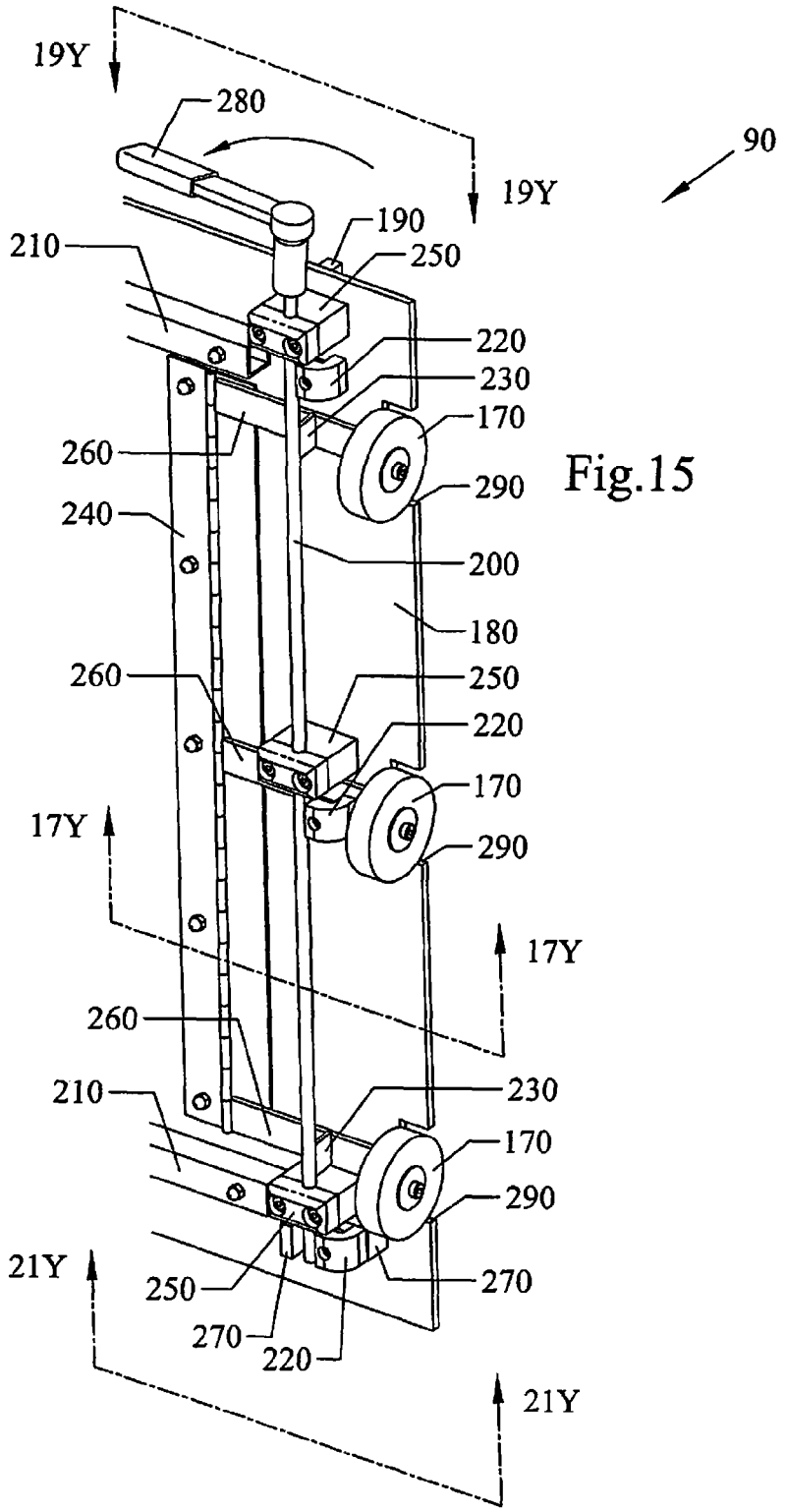
FIG. 15 is a perspective enlarged view of the panel locking system of FIG. 14 in an unlocked configuration.
Figure 16:
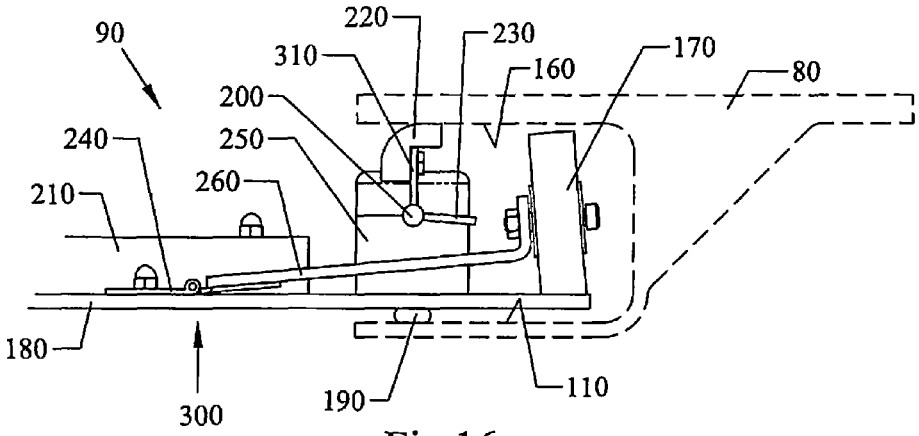
FIG. 16 is a top view of the panel locking system of FIG. 14 along arrows 16Y in a locked configuration.
Figure 17:
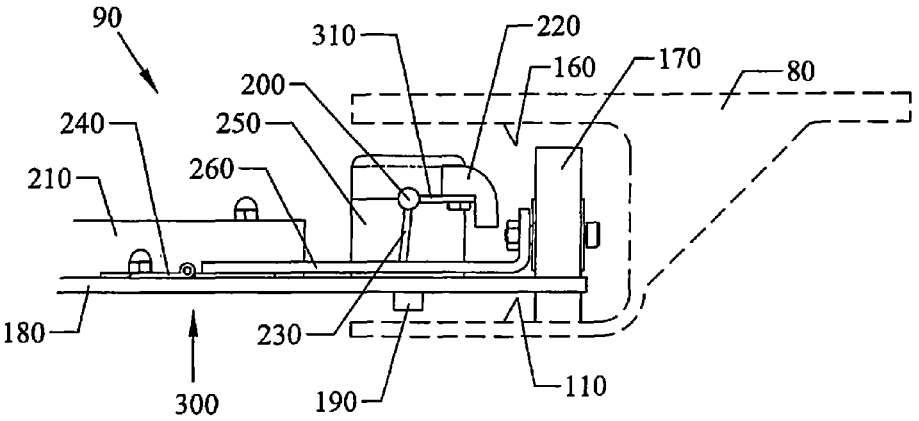
FIG. 17 is a top view of the panel locking system of FIG. 15 along arrows 17Y in an unlocked configuration.
Figure 18:
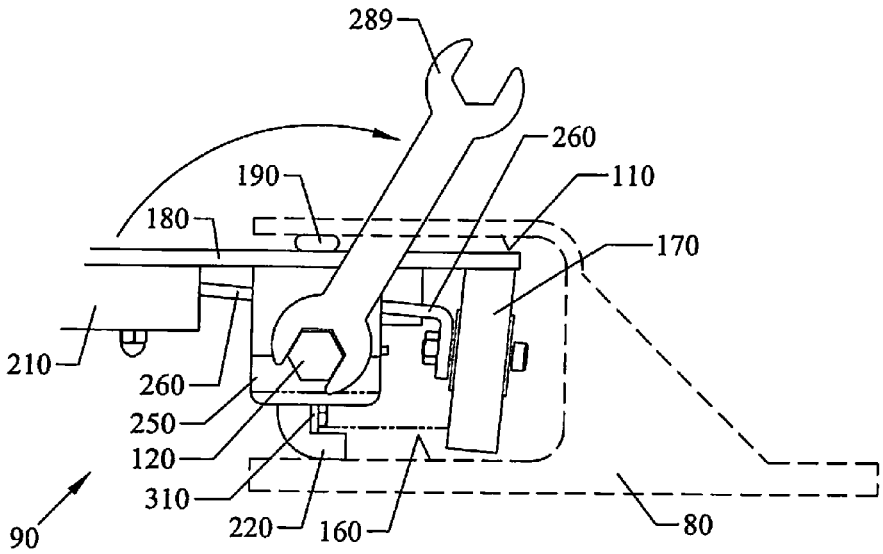
FIG. 18 is a top view of the panel locking system of FIG. 14 along arrows 18Y showing an open-ended wrench being used to lock the panel into the panel frame.
Figure 19:
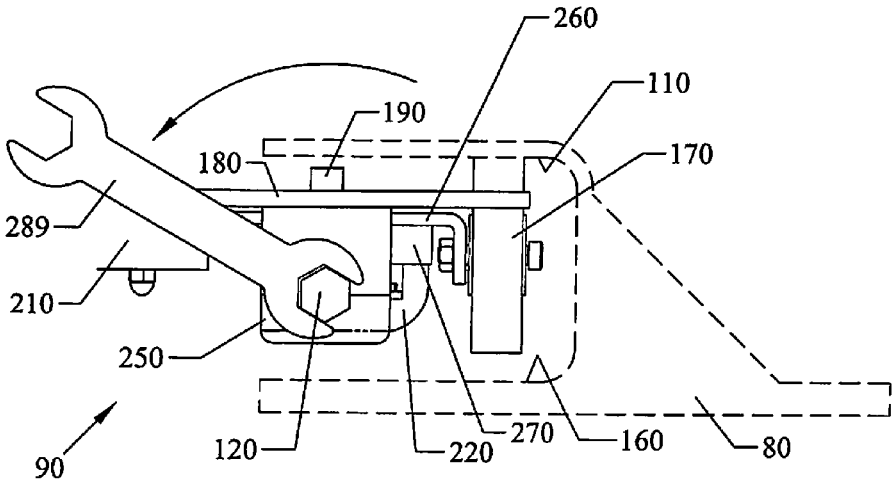
FIG. 19 is a top view of the panel locking system of FIG. 18 along arrows 19Y showing open-ended wrench being used to unlock the panel from the panel frame.
Figure 20:
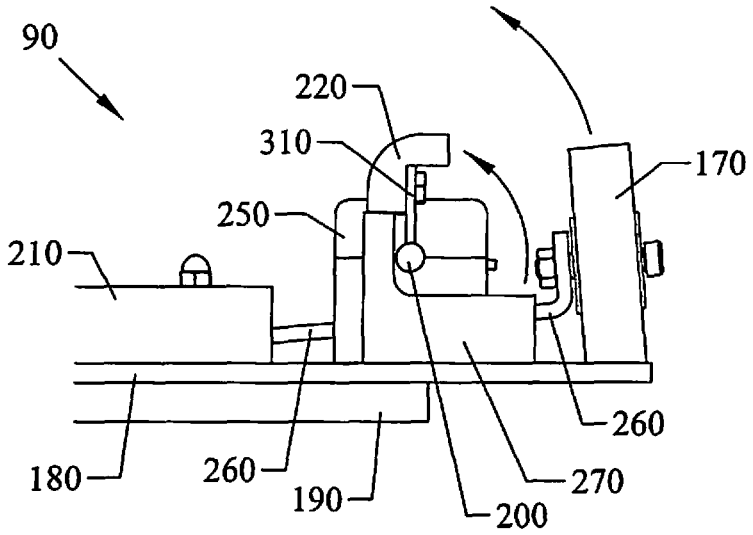
FIG. 20 is a bottom view of the panel locking system of FIG. 14 along arrows 20Y showing the stop-block arresting the counter-clockwise motion of the cam.
Figure 21:
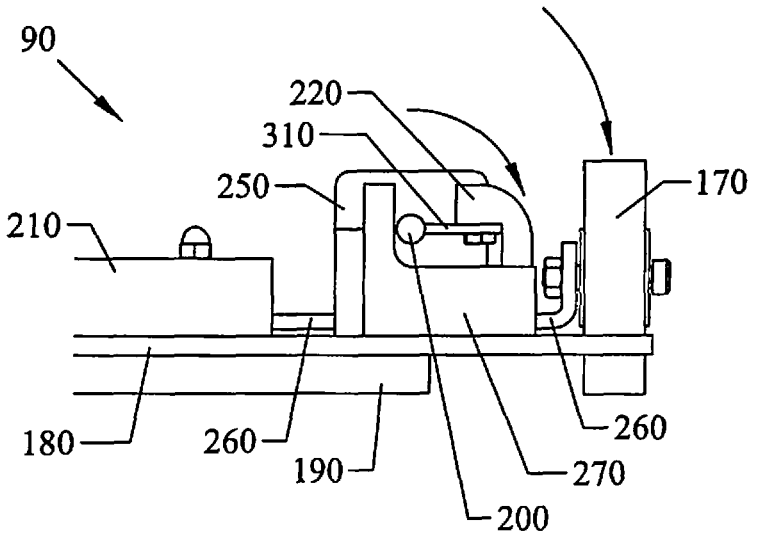
FIG. 21 is a bottom view of the panel locking system of FIG. 20 along arrows 21Y showing the stop-block arresting the clockwise motion of the cam.

FIG. 14 is a perspective enlarged view of the panel locking system of the damper system 50 of FIG. 5 in a locked configuration. FIG. 15 is a perspective enlarged view of the panel locking system of FIG. 14 in an unlocked configuration with the wrench 280 rotated counter-clockwise. FIG. 16 is a top view of the panel locking system of FIG. 14 along arrows 16Y in a locked configuration. FIG. 17 is a top view of the panel locking system of FIG. 15 along arrows 17Y in an unlocked configuration. FIG. 18 is a top view of the panel locking system of FIG. 14 along arrows 18Y showing an open-ended wrench 280 being used to lock the panel into the panel frame. FIG. 19 is a top view of the panel locking system of FIG. 18 along arrows 19Y showing open-ended wrench 280 being used to unlock the panel 180 from the panel frame 80. FIG. 20 is a bottom view of the panel locking system of FIG. 14 along arrows 20Y showing the stop-block 270 arresting the counter-clockwise motion of the cam 220. FIG. 21 is a bottom view of the panel locking system of FIG. 20 along arrows 21Y showing the stop-block 270 arresting the clockwise motion of the cam 220.

Referring to FIGS. 14-21, the socket wrench tool 280 can have a socket 285 that fits about damper panel release hex 120(such as a hex head of a bolt).

FIGS. 14 and 16 show the panel in a lock position with the cam-lock 220 abutting against the front wall 110 of the composite frame 80, and the foam rubber panel seal 190 compressed between the panel 180 and the back wall 160 of the composite frame 80. The articulating support wheel(s) 170 are shown articulated(angled) by the panel mounting hinge 240. Water pressure 300 is shown by an arrow pressing against and exposed surface of the panel 180.

As shown in FIGS. 15, and 17, the socket wrench tool 280 is rotated counter-clockwise on the hex 120, the lock release rod 200 also rotates counter-clockwise rotating the damper panel cam-lock 220 away from front wall 110 of the composite frame 80. The panel 180 becomes spaced apart from the back wall 160 of the composite frame 80 allowing the foam rubber panel seal 190 to expand by being separate from back wall 160.

FIGS. 18 and 19 show a hand wrench 289 attached to damper panel release hex 120 that can be used instead of the socket wrench tool 280 to lock(rotating clockwise) and unlock(rotating counter-clockwise).

FIG. 20 is a bottom view of the panel locking system of FIG. 14 along arrows 20Y showing the stop-block 270 arresting the counter-clockwise motion of the cam 220 with the cam-lock mounting bar 310 welded to the lock release rod 200. FIG. 21 is a bottom view of the panel locking system of FIG. 20 along arrows 21Y showing the stop-block 270 arresting the clockwise motion of the cam 220 with the cam-lock mounting bar 310 welded to the lock release rod 200. In FIG. 21, the outer surface of the wheel(s) 170 extends through the panel cutout(s) 290 to clear the support wheel(s) 170.

FIG. 30 is a side view of the elongated handle remote socket wrench tool 330 used in FIGS. 22, 22A, 23 and 23A. FIG. 30A is an enlarged view of the socket part 340 of the tool 330 of FIG. 30. FIG. 31 is a perspective view of the remote socket wrench tool 330 of FIG. 30. FIG. 31A is an enlarged view of the socket part 380 of the tool 330 of FIG. 31. The elongated handle remote socket wrench tool 330 can have a telescoping tube handle with cylindrical type parts that slide in and out of each other extending and reducing the length of the handle portion of the tool 330. A universal joint 350 between the handle portion 380 and the socket 340 allows for all-angle operation and versatility and maneuverability of the remote socket wrench tool 330.

Figures 22, 22A:
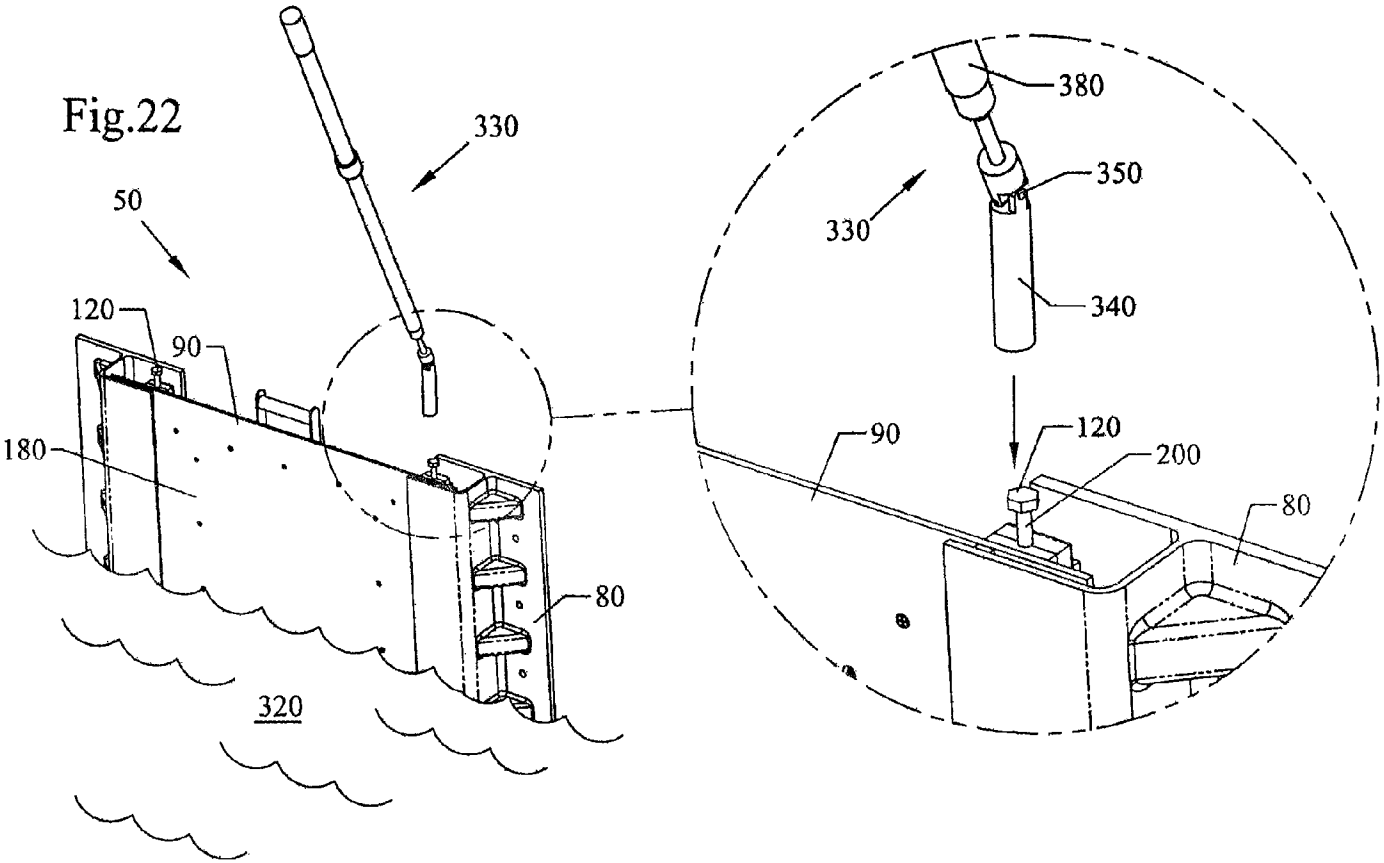
FIG. 22 shows an upper view of the damper panel system in water, with a remote socket wrench tool ready to engage the damper release hex.
FIG. 22A is an enlarged partial view of FIG. 22 showing the socket on the tool ready to engage the damper release hex.
Figures 23, 23A:
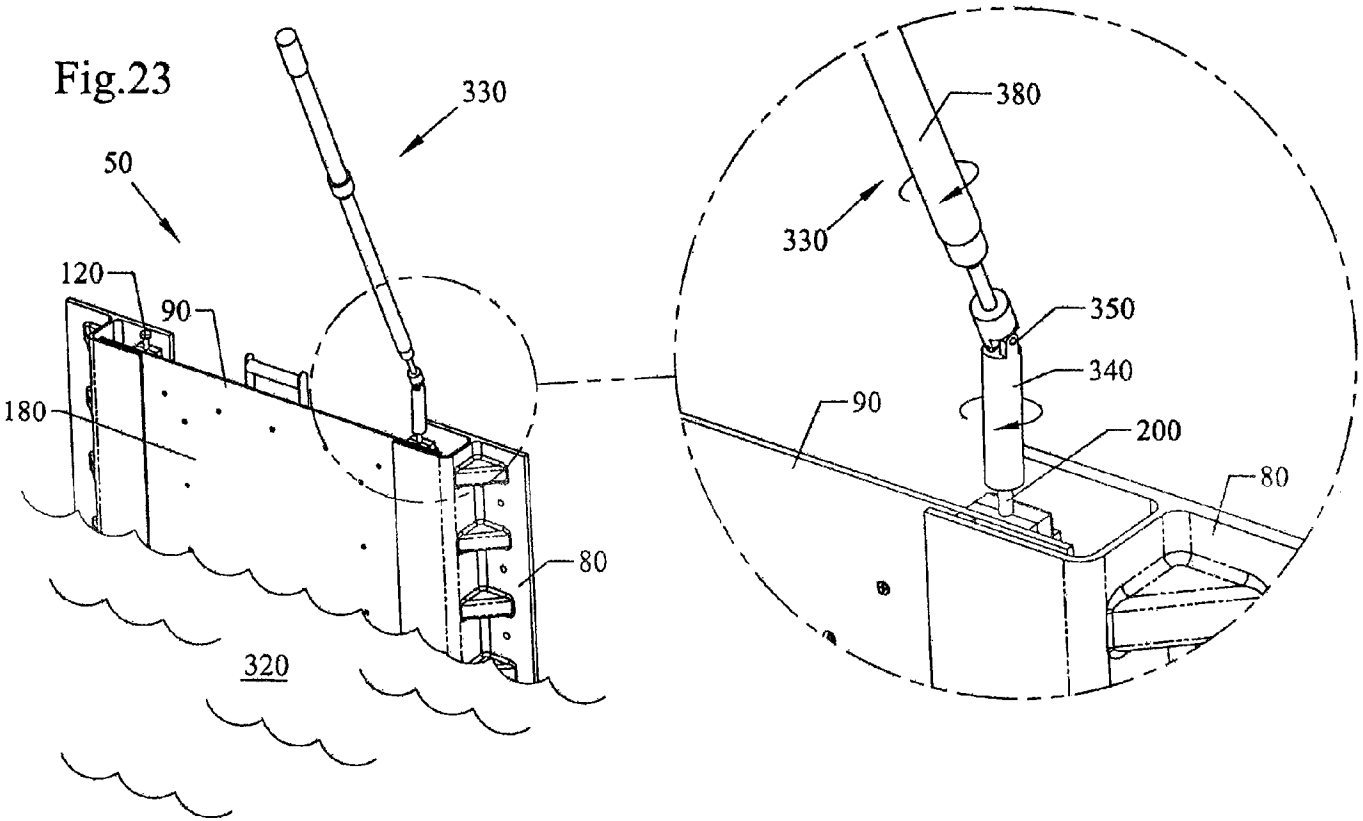
FIG. 23 shows an upper view of the damper panel system in water with a remote socket wrench tool engaged to damper release hex.
FIG. 23A is an enlarged partial view of FIG. 23 showing the socket on the tool ready to unlock the damper release hex.

FIG. 22 shows an upper view of the damper panel system 50 in water, with a remote elongated handle socket wrench tool 330(of FIGS. 30-31A) ready to engage the damper release hex 120. A universal joint 350 on the elongated tool 330 allows for all angle operation of the elongated remote socket wrench tool 330. FIG. 22A is an enlarged partial view of FIG. 22 showing the socket 340 on the tool 330 ready to engage the damper release hex 120. FIG. 23 shows an upper view of the damper panel system 50 in water 320 with the elongated remote socket wrench tool 330 engaged to damper release hex 120. Clockwise turn of tool unlocks panel 180 from panel frame 80. Counter-clockwise locks the panel 180 to the frame 80 FIG. 23A is an enlarged partial view of FIG. 23 shows the socket 340 on the tool 330 ready to unlock the damper release hex 120.

Figure 24:
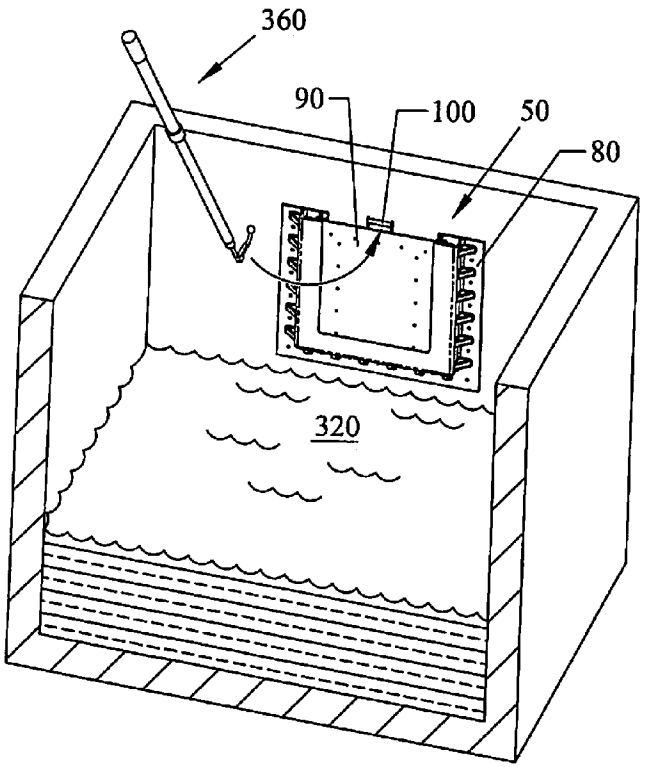
FIG. 24 shows a perspective view of a remote panel lifting hook tool preparing to engage the lift handle on the damper panel that is attached the damper panel system.

FIG. 28 is a perspective view of a hook tool 360 used in FIG. 24. FIG. 28A is an enlarged view of the hook end 400 and ball 390 on the hook tool 360 of FIG. 28. FIG. 29 is a side view of hook tool 360 of FIG. 28. FIG. 29A is an enlarged view of the hook end 400 and ball 390 on the hook tool 360 of FIG. 29.

Figure 25:
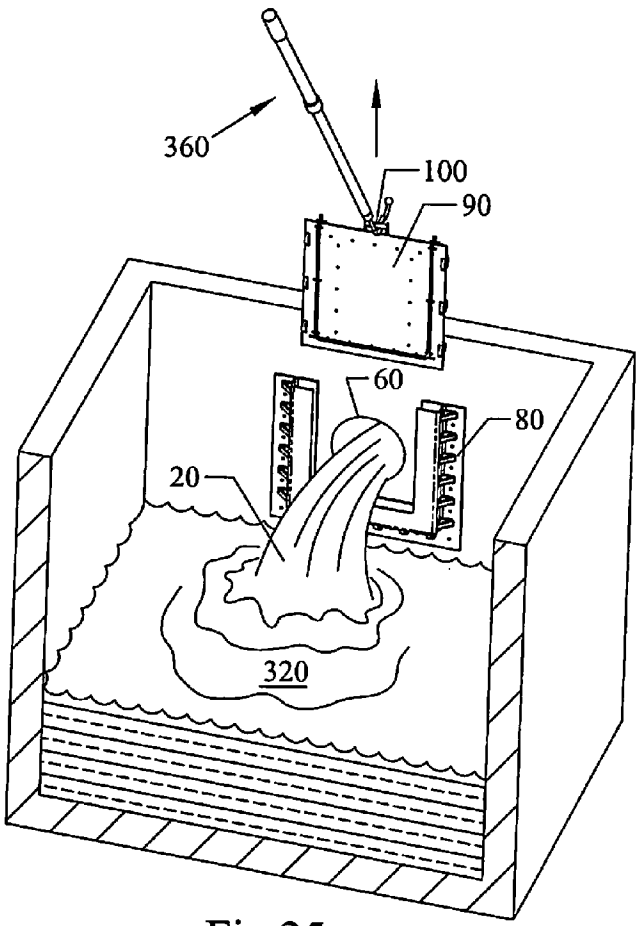
FIG. 25 is another view of FIG. 24 showing the remote panel lifting hook tool lifting the damper panel from the panel frame.

FIG. 24 shows a perspective view of a remote panel lifting hook tool 360(shown in FIGS. 28-29A) preparing to engage the lift handle 100 on the damper panel assembly 90 that is attached the damper panel system 80 after the panel assembly is in an unlocked position. The ball 390 on the hook end 400 is inserted through the extended handle 100 hooking the handle 100. FIG. 25 is another view of FIG. 24 showing the remote panel lifting hook tool 360 lifting the damper panel assembly 90 from the panel frame 80. A user(not shown) can raise the hook tool 360 that has the hook end 400 with ball 390 hooked about the handle 100 and clearly lift the panel assembly 90 from the frame and allow storm water inflow 20 into the stormwater 320 inside of the vault.

Figure 27:
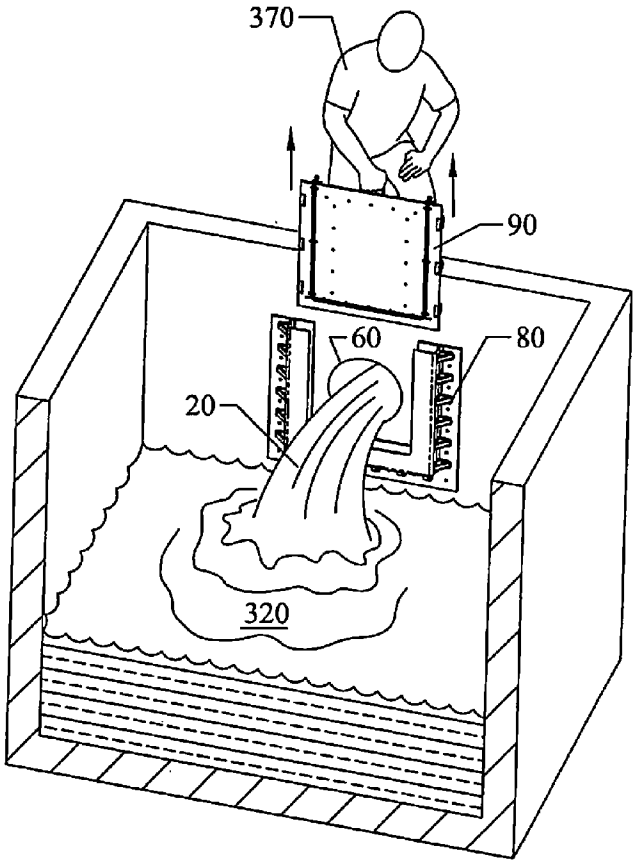
FIG. 27 is another view of FIG. 26 showing the person lifting the damping panel from the frame.
Figure 26:
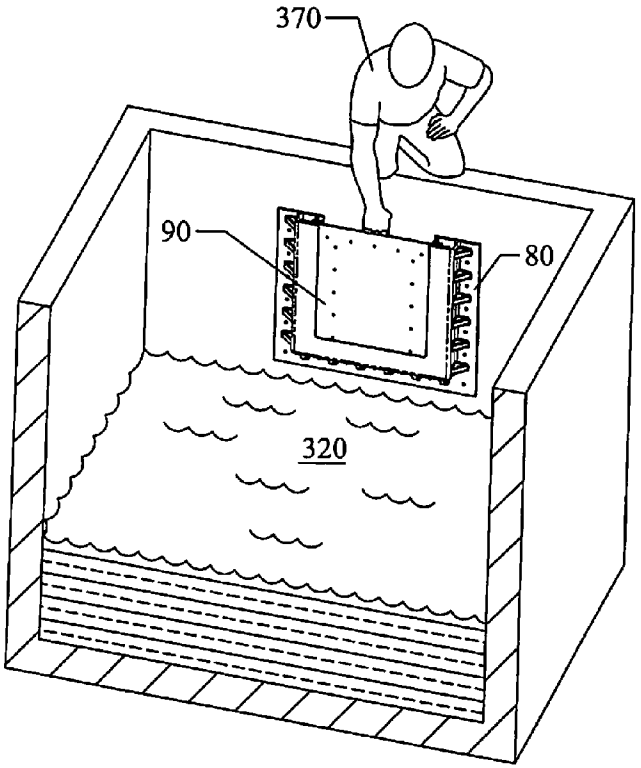
FIG. 26 is a perspective view of a person grasping the damping panel handle preparing to lift the panel from the frame.

FIG. 26 is a perspective view of a person 370 grasping the damping panel handle 100 preparing to lift the panel assembly 90 from the frame 80, after the panel assembly is in an unlocked position. FIG. 27 is another view of FIG. 26 showing the person 370 lifting the damping panel assembly 90 from the frame 80.

Although the figures show the damper panel assembly with frame mounted on the wall of a vault, the invention can be used on other types of walls, such as on dams, and the like.

The foam rubber panel seal 190 can be an elongated seal member, and can be a gasket member such as but not limited to one having a C or E or U type channel that compresses. The seal can also include resilient and/or elastomeric type members, and the seal can be an inflatable bladder type tube(s), and the like. Additionally, the seal 190 can be placed along the bottom edge of the panel as well as the left and right sides of the panel. In a preferred embodiment, the seal member is placed on the opposite side of the panel from the inlet port to the vault or structure.

Although preferred types of lifting tools are described, the invention can use other types of tools for lifting the panel assembly, such as but not limited to using a manhole hook tool, and the like.

While the handle 100 is shown as rectangular, the handle can have other shapes such as triangular, arc shaped, and the like, and can have a catch portion such as an indented or cut-out or lip edge, that can also be snagged or hooked to lift the panel assembly.

Although the invention refers to wrenches, the invention can work with lever arms that are fixably attached to the tops of the cam bars, or are removably attached as needed. Although the invention shows separate rotatable cams in the tracks, a single elongated cam can be used on each side of the panel that can have paddle or wedge shapes. Alternatively, the invention can use removable wedges that when driven into place compress and water seal the damper panel in place.

The invention can incorporate embodiments of the rotating wheels on the doors moving up and down in a track, where the track is in a fixed wall. Alternatively, the invention can have a sliding main primary door, and a secondary door that slides up and down relative to the primary door. The embodiments can have flow over versions so that water can overflow over a sliding door into a vault. Likewise, the embodiments can flow under versions where water flows under a slidable door into a vault. Either or both the primary and secondary doors can slide up in down within tracks with or without rollers and wheels to ease the sliding action of the respective doors.

Figure 34:
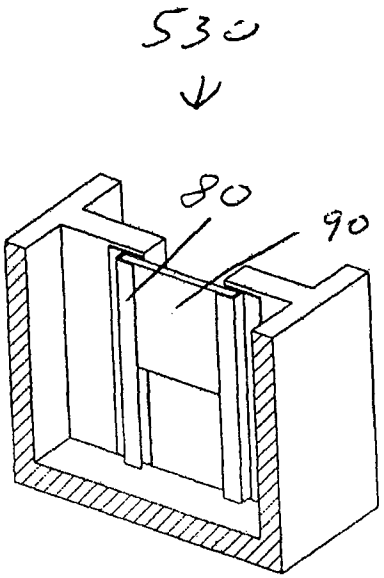
FIG. 34 is a perspective cut-away view of the flow-over door system of FIG. 33 with the door pulled up fully
Figure 33:
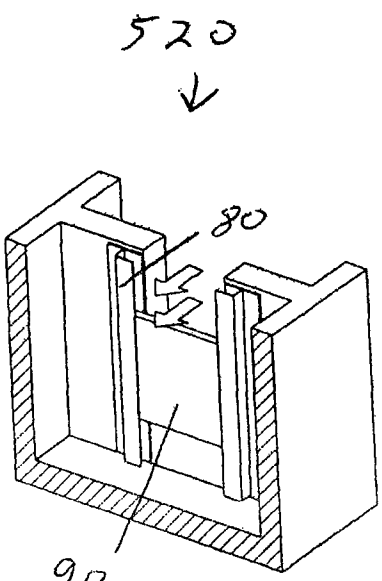
FIG. 33 is a perspective cut-away view of the flow-over door system of FIG. 32 with the door pulled half way up in the door tracks.
Figure 32:
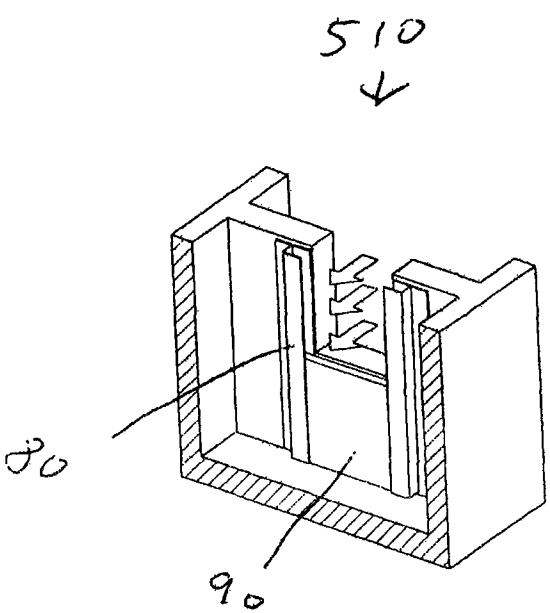
FIG. 32 is a perspective cut-away view of a "flow-over" door system shown with the door down.

FIG. 32 is a perspective cut-away view of a "flow-over" door system shown with the door down. The system is at maximum flow capacity where arrows can represent an overflow into a vault. FIG. 33 is a perspective cut-away view of flow-over door system of FIG. 32 with the door pulled half way up in the door tracks. The flow-over capacity is cut by half. Further choices of position are possible to adjust flow. The invention can allow for the door to be selectively fixed by the user in different height positions in the tracks. FIG. 34 is a perspective cut-away view of flow-over door system of FIG. 33 with the door pulled up fully Here, the flow is completely cut off from entering into the vault.

Primary and Secondary Doors with Underflow and Overflow

Figures 35, 36, 37:
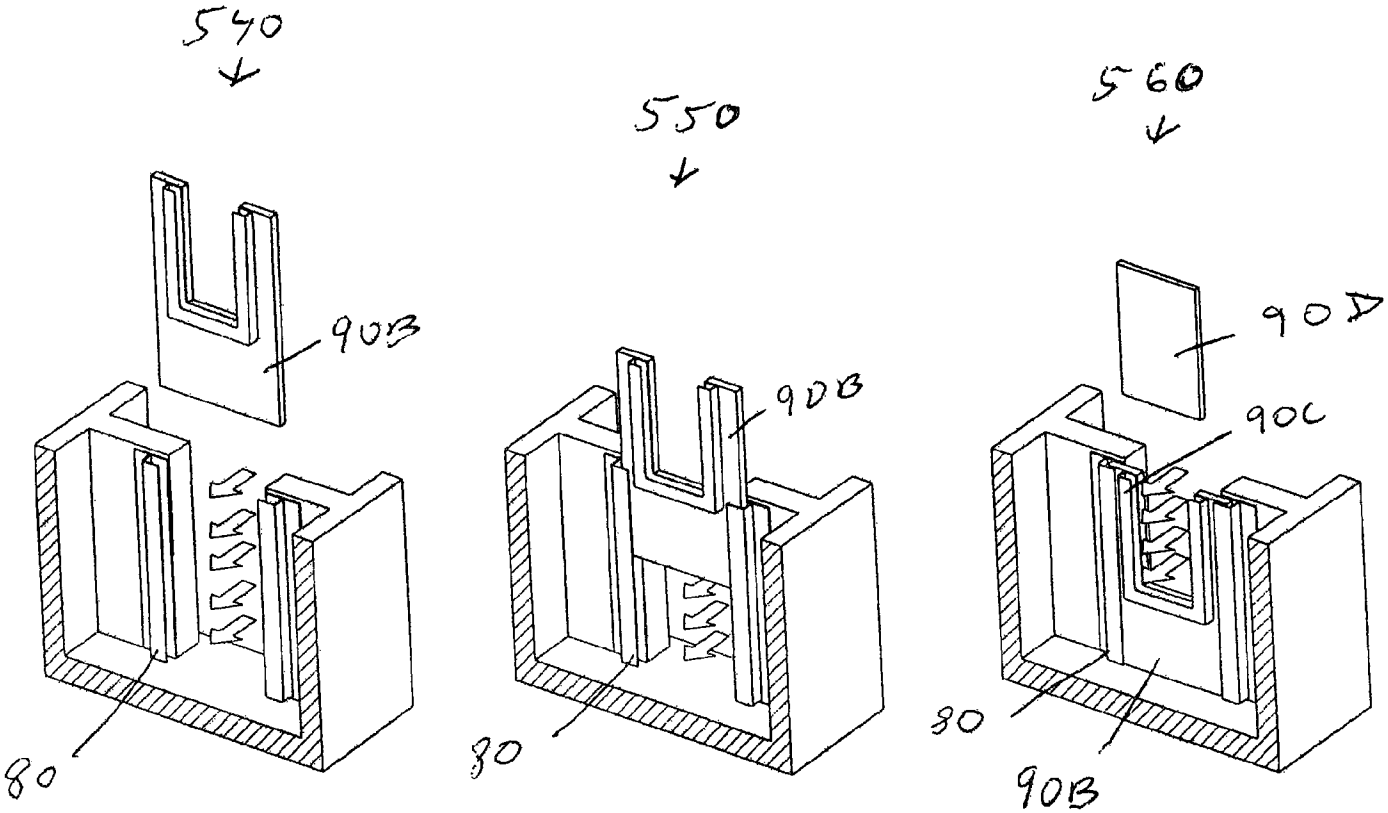
FIG. 35 is a perspective cut-away view of a "door-in-a-door" system with the primary flow through door removed.
FIG. 36 is a perspective cut-away view of the door-in-a-door system of FIG. 35 with the primary door installed half way.
FIG. 37 is a perspective cut-away view of the door-in-a-door system of FIG. 36 with the primary door fully installed.

FIG. 35 is a perspective cut-away view of "door-in-a-door" system with the primary flow through the opening in the wall with both doors removed. Here, the system is at maximum flow capacity. FIG. 36 is a perspective cut-away view of the door-in-a-door system of FIG. 35 with one of the doors installed half way. System is at about half flow-under capacity. Further choices of position are possible to adjust flow. Similar to the previous embodiment, each of the doors can be selectively locked in different height positions within the tracks as needed.

Figure 39:
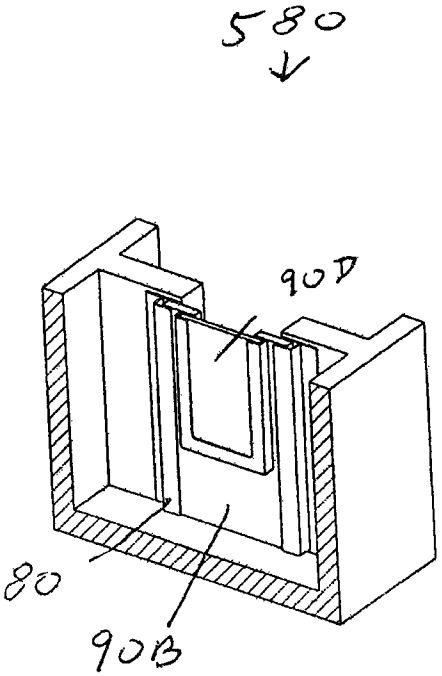
FIG. 39 is a perspective cut-away view of the door-in-a-door system of FIG. 38 with secondary door fully installed.
Figure 38:
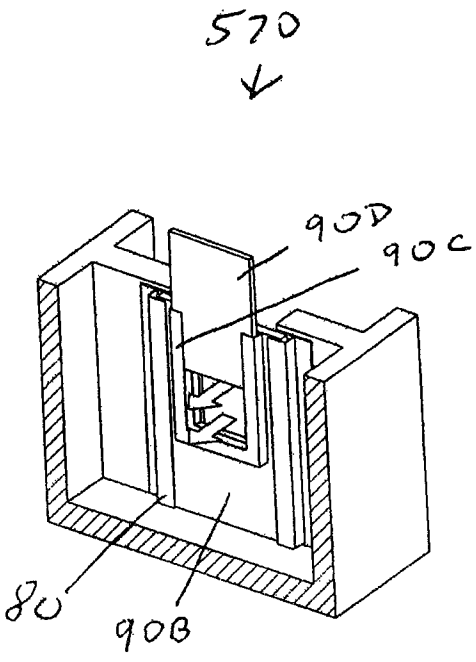
FIG. 38 is a perspective cut-away view of the door-in-a-door system of FIG. 37 with secondary smaller door installed half way.

FIG. 37 is a perspective cut-away view of the door-in-a-door system of FIG. 36 with the larger door fully installed, and the smaller primary smaller door removed. Here, the system is at maximum flow-over capacity. FIG. 38 is a perspective cut-away view of door-in-a-door system of FIG. 37 with the smaller door installed half way. Here, the system is at about half flow-under (secondary) capacity. Further choices of position for the smaller door are possible to adjust flow-over capacity. Similar to the previous embodiment, the smaller door can be selectively locked in different height positions within the tracks as needed. FIG. 39 is a perspective cut-away view of the door-in-a-door system of FIG. 38 with the smaller and the larger doors fully installed. Here, the flow is completely being cut off. A preferred embodiment of the door in door system of these figures is shown and described in relation to FIGS. 40-46B below. The larger door can be the first primary main door and the smaller door can be the secondary door. Alternatively, the user can identify the smaller door as the first primary main door and the larger door as the secondary door.

FIG. 40 is a front perspective of inflow outflow (I.O.) door damper system 510 mounted to a vault 10 with a primary door assembly 540 and a secondary door assembly 550. FIG. 41 is a rear perspective view of the primary door 540 and secondary door 550 installed in the vault 10 of FIG. 40, and the large rectangular storm water inflow opening 560A cut into vault 10.

FIG. 42 is a front perspective view of the I.O. vault 10 of FIG. 40 with the primary door assembly 540 locked half open to reveal an underflow passage 860 for storm water flow. The size of this passage 860 can be adjusted by locking the primary door assembly 540 in different positions. The same can be accomplished by locking the primary door assembly 540 to the secondary door assembly 550 and locking that assembly 550 into different positions in the frame 520. Water flow can run under primary door assembly 540.

FIG. 43 is a front perspective view of the I.O. vault 10 of FIG. 40 with the primary door assembly 540 removed. FIG. 44 is a front perspective view of the I.O. vault 10 of FIG. 40 with the primary door assembly 540 and secondary door assembly 550 removed. A secondary door frame 520 having a generally U-shaped configuration can run along the left side, bottom side and right side of a water flow opening in a wall of the vault 10, and be bolted the vault 10. The mounting wall can be perpendicular to a side vault wall 40. Side edges of the secondary door assembly 540 can be positioned top slide into and out of the U-shaped openings of the frame 520. Frame gussets 530 can be mounted along outer edges of the frame to strengthen the secondary door frame 520

FIG. 45 is a front perspective exploded view of the I.O. vault 10 with the primary door assembly 540 and secondary door assembly 550 removed from the vault 10. The articulating wheels 610 attached to the left and right sides of the primary door assembly 540 can be positioned to roll into and out of the U-shaped channel 690 about the opening in the secondary door assembly 550.

FIG. 46 is a front perspective view of the primary door assembly 540 of FIG. 1. FIG. 46A is an enlarged view of the lock and wheel mechanism detail of the primary door assembly 540 of FIG. 46 in a "wheels locked/door unsealed" condition. FIG. 46B is an enlarged view of the lock and wheel mechanism detail of the primary door assembly 540 of FIG. 46 in a "wheels unlocked/door sealed" condition.

Referring to FIGS. 46, 46A and 46B, the primary door assembly 540 can include a primary damper panel 580 that can have a generally rectangular shape, and a plurality of horizontal stiffener panels running from the left side of the panel to the right side of the panel 580. A lift handle 570 can be attached to an upper edge of a top panel stiffener brace 590. Along both a left side and a right side of the panel 580 can be panel mounted hinges 660 that are attached to pivotal wheel mounting brackets 670. On the outer ends of each bracket 670 can be articulating panel support wheel 610. A plurality of left side lock release rod mount blocks 640 are attached to a left side of the panel 580 adjacent to each of the left set of articulating support wheels 610. Another plurality of right side lock release rod mount blocks 640 are attached to a right side of the panel 580 adjacent to each of the right sets of articulating support wheels 610.

Although, FIG. 46 shows 7 wheels and 7 blocks 640 on each side, the invention can be practiced with less or more as needed. A panel and wheel release hex head 620 with rod 650 runs down each of the left sets of mount blocks 640 and the right sets of mount blocks 640. A moveable panel L-shaped cam block 630 is attached to each of the bolt rods 620 next to each wheel mount bracket 670. A wheel toggle locking bar 680 is also attached to each of the rods 620 as well.

FIG. 47 is a top view of FIG. 41 along arrow 47Y of the primary door assembly 540 and secondary door assembly 550 installed into the secondary door frame 520 which is attached to the vault 10. FIG. 47A is an enlarged view of the lock mechanism detail of the primary door assembly 540 of FIG. 47 shown with cam locks 630 engaged and foam rubber seal 700 attached to one side of the panel 580 that is pressed against the inside wall 692 of the frame 690.

FIG. 47B is an enlarged view of the lock mechanism detail of the primary door assembly 540 of FIG. 47 shown with wheels 610 locked and engaged with the frame 520 for ease of door removal.

FIG. 48 is a rear perspective view of the primary door assembly 540 of the preceding figures, that shows the seal 700 in a U shape running down the left side, bottom side and right side of the panel 580.

FIG. 49 is a top view of the primary door assembly 540 of FIG. 48 showing the lifting handle 570 on upper panel stiffener brace 590, and top of the rotatable hex heads 620 of the rods (not shown). The seal 700 is shown on one side of the panel 580. FIG. 50 is a bottom view of the primary door assembly 540 of FIG. 48 showing the bottom panel stiffener brace 590, with the seal 700 along the outside of the panel 580.

FIG. 51 is a side view of the primary door assembly 540 of FIG. 48 showing the exterior sides of the wheels 610 with panel centering bushing 600. Both the left and right side of the primary door assembly include panel centering bushings 600 which are used to center the primary panel 580 in the secondary door frame assembly 550. Similar to the previous embodiment, the wheels 610 are positioned in cut-outs arranged along the right and left sides of the primary door assembly 540.

Referring to FIGS. 41-51, the operation of these components is similar to those in the previous embodiments described above. Turning the hex head 620 on rod 650 clockwise (FIG. 46B) with a wrench locks the panels 580 to the frame 690 and seals the panel 580 by the cam lock 630 abutting against an inner wall 692 of the door frame(FIG. 47A) while disengaging the wheels 610 from the frame 690 (FIG. 47A). Turning the hex head 620 counter-clockwise (FIG. 46A) unseals the panel 580 and locks the rotatable wheels down so that they engage the frame allowing the panel 580 to be easily lifted from the frame 690(FIG. 47B). The turning directions can be reversed when viewing on the opposite side of the panel 580.

FIG. 52 is a front perspective view of the secondary door assembly 550 of the preceding figures without the primary door 540. A plurality of horizontally arranged secondary door panel and frame stiffeners 730 extend across the secondary opening in the door assembly 550. The primary door frame 690 mounted to the secondary door assembly 550. The primary door frame 690 can be a U-shaped and runs down a left side, bottom side and right side of the secondary opening in the door assembly 550. FIG. 52A is an enlarged view of the lock mechanism detail of the secondary door assembly 550 of FIG. 52 shown in a "door sealed" condition. FIG. 52B is an enlarged view of the lock mechanism detail of the secondary door assembly 550 of FIG. 52 shown in the "door unsealed" condition.

Referring to FIGS. 52, 52A and 52B, a hex head 750 is shown on the top end of a panel lock rod 740. The rod(s) 740 are rotatably held in place by a plurality of lock release rod mount blocks 640 that are attached to the left side and right side of the secondary damper panel 710. L shaped panel cam locks 630 are attached to the rods 740 adjacent to each of the secondary door gussets 760. On at least an upper and lower side edge of the panels 710 can be panel centering bushings 720 which can be used to help center the panel 710 in the secondary door frame 520.

FIG. 53 is a top view of FIG. 41 along arrow 53Y of the primary door assembly 540 and secondary door assembly 550 installed into the secondary door frame 520 which is attached to the vault 10.

FIGS. 53A and 53B show details how the secondary door assembly 550 locks and unlocks. FIG. 53A is an enlarged view of the lock mechanism detail of the secondary door assembly 550 of FIG. 53 shown with cam locks 630 engaged and foam rubber seal 700 pressed against the inside wall 522 of the frame 520. FIG. 53B is an enlarged view of the lock mechanism detail of the secondary door assembly 550 of FIG. 53 shown with the cam locks 630 disengaged from the frame 690. The door is ready to remove.

FIG. 54 is a rear perspective view of the secondary door assembly 550 of the previous figures showing the seal 700 along the outer left side, bottom side, and right side, and the horizontal secondary door panel and frame stiffeners 730 across the opening in the secondary door assembly 550. FIG. 55 is a top view of the secondary door assembly 550 of FIG. 54 showing the primary door frame 690 mounted to the secondary door panel 710. FIG. 56 is a bottom view of the secondary door assembly 550 of FIG. 54, showing the secondary door gussets 760 underneath the primary door frame 690.

Referring to FIGS. 52-56, the operation is similar to the previous embodiments. Turning the hex head 750 counter-clockwise FIG. 52A with a wrench type tool locks the panel 710 into the secondary door frame 520(FIG. 53A) and seals the panel 710 by the compressed seal 700 by the cam lock 30 is rotated to abut against an inner side of frame 520. Turning the hex head 750 clockwise unlocks the panel 710 from the frame 520 allowing the panel 710 to be easily lifted from the frame 520.

Half-Panel Door Damper System

FIG. 57 is a front perspective view of a half-panel door damper system 770. FIG. 58 is a rear perspective view of the half-panel door damper system 770 of FIG. 57 with a half storm water inflow opening 560B cut into the vault 10.

FIG. 59 is a front perspective of the half-panel system 770 of FIG. 57 showing the door assembly 780 locked half up to reveal an underflow passage 560A for storm water flow. The size of this passage 860A can be adjusted by locking the door assembly 780 in different positions.

FIG. 60 is a front perspective view of the half-panel system 770 of FIG. 57 showing the door assembly 780 locked half down to reveal an overflow passage 860B for storm water flow. Like the underflow passage 860A, the size of the overflow passage 860B can be adjusted by locking the door assembly 780 in different positions.

FIG. 61 is a front perspective view of the half-panel system 770 of FIG. 57 showing the door assembly 780 all the way down to reveal maximum overflow passage 860B for storm water flow through a half panel opening 560B.

FIG. 62 is a front perspective view of the half-panel system 770 of FIG. 57 showing the door assembly 780 removed from the frame 790. Similar to the previous embodiments, a generally U-shaped frame 790 can be used. Here, two vertical U-shaped frames 790, can each be bolted to a respective left side and respective right side of an half opening 560B with the frames 790 running to the floor of the vault 10. Articulating wheels 610 mounted to the left and right sides of the door assembly 780, can roll into and out of the left and right side U-shaped configured frames 790.

FIG. 63 is a front perspective view of the half-panel panel door assembly 780 of FIG. 57. Similar to the previous embodiments, hex heads 810 can be located on top of rods 650, where the rods can be rotatably held to the half-panel damper panel 820 by a plurality of lock release rod mount blocks 640. Attached to each of the rods 650 can be L-shaped cam locks 630 and wheel toggle locking bars 680. Articulating wheels 610 can be mounted to left and right sides of the half-panel damper panel 820 by hinge 660 attached brackets 670.

FIG. 63A is an enlarged view of the lock and wheel mechanism of FIG. 63 in an unlocked position. FIG. 63B is an enlarged view of the lock and wheel mechanism of FIG. 63 in a locked position.

FIG. 64 is a top view of the half-panel door assembly 780 of FIG. 58 along arrow 64Y locked into the frame 790. FIG. 64A is an enlarged view of the lock and wheel mechanism detail of the half-panel door assembly 780 of FIG. 64 shown with cam locks 630 engaged and foam rubber seal 700 pressed against the inside 792 of the frame 790. FIG. 64B is an enlarged view of the lock and wheel mechanism detail of the half door assembly 780 of FIG. 64 shown with wheels 610 locked and engaged with the frame 790 for ease of door removal.

FIG. 65 is a rear perspective view of the half-panel door assembly 780 of FIG. 57. Similar to the previous embodiments a handle 570 can be used to lift the half-panel damper panel 820 when needed.

FIG. 66 is a top view of the half-panel door assembly 780 of FIG. 65. FIG. 67 is a bottom view of the half-panel door assembly 780 of FIG. 65. FIG. 68 is a side view of the half-panel door assembly 780 of FIG. 65. The articulating wheels 610 and related components function similarly to those of the previous embodiments.

Referring to FIGS. 57-68, turning the hex head 810 counter-clockwise with a wrench type tool locks the panel 820 into the half-panel frame 790 (FIG. 64A and FIG. 63B) by rotating the panel cam lock 630 to abut against an inner side of the frame 790. The seal 800 is compressed to form a similar water tight seal to the seals previously described in the other embodiments above. Turning the hex head 810 counter-clockwise unlocks the panel 820 from the frame 790 (FIG. 64B and FIG. 63A) and allow the door assembly 780 to be removed.

Concrete Channel Installation

FIG. 69 is a front perspective view of a concrete channel damper system 870 using the primary door assembly 540 of the previous embodiment of FIGS. 40-51 installed into a concrete channel 830 with the frame 840 inserted into the concrete itself. FIG. 70 is a rear perspective view of the channel damper system 870 with the primary door assembly 540 of FIG. 69 installed into a concrete channel 830. FIG. 71 is a front perspective view of the primary door assembly 540 of FIG. 69 showing the door assembly 540 locked half up to reveal an underflow passage 860 for storm water flow. The size of this passage 860 can be adjusted by locking the door in different positions. FIG. 72 is a front perspective view of the primary door assembly 540 of FIG. 69 showing the door assembly 540 removed from channels 830. FIG. 73 is a front perspective exploded view of the channel damper system 870 showing door assembly 540 and frame 850 removed.

The primary door assembly 540 functions similarly to that disclosed above in regards to FIGS. 40-51. FIG. 74 is a top view of the channel damper system 870 of FIG. 69. FIG. 74A is an enlarged view of the lock and wheel mechanism detail of the channel damper door assembly 870 of FIG. 74 shown with cam locks 630 engaged to abut against inner wall 842 of frame 840 and foam rubber seal 700 pressed against the opposite inside wall of the frame 840. FIG. 74B is an enlarged view of the lock and wheel mechanism detail of the channel damper door assembly 870 of FIG. 74 shown with wheels 610 locked and rotatably engaged with the frame 840 for ease of door removal.

Although the invention is described for use with storm water treatment vaults and structures, the invention can have other applications, such as but not limited to being used in dam type applications, and the like for ponds, lakes, pools, waterfalls, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A double door damper system for storm water conveyance structures, comprising:

a first door having outer side edges slidable within first tracks in a first frame about a passage through a water conveyance opening, the first door having a length and width that is sized to substantially close off the passage through the conveyance opening, the first door having a first opening therethrough for defining a smaller passage than the passage through the water conveyance opening, at least one vertical bar member rotatable mounted to at the least one bar mount adjacent to at least one of the outer side edges of the first door;

a plurality of spaced apart first moveable members along at least one vertical bar member for pushing the front door against an interior portion inside the first tracks, wherein rotating the vertical bar member rotates the first moveable members in a horizontal axis from a loose position where the first door is loosely seated in the first tracks to a closed position where the first door is pushed against the interior portion of the primary tracks, wherein the closed position prevents the water from passing about the outer sides edges of the first door, wherein the first moveable members lock the first door to different height positions in the first frame, the different height positions for adjusting size of the passage through the water conveyance opening; and a secondary door slidable within a second frame on the first door, the secondary door having a length and width that is sized to substantially close off the first opening in the first door.

2. The double door damper system of claim 1, wherein the second frame includes secondary tracks.

3. The double door damper system of claim 2, wherein the secondary door includes second locking members for locking the secondary door to different height positions in the secondary tracks in the second frame, the different height positions for adjusting size of the first opening through the first door.

4. The double door damper system of claim 3, wherein the second locking members include:

second moveable members along one side face of the secondary door for pushing the secondary door against portions of the secondary tracks to seal the secondary door against water intrusion when the secondary door is in a closed position, and to lock the secondary door to different height positions.

5. The double door damper system of claim 4, wherein the second moveable members include:

second rotatable cams along perimeters of outer side edges of the secondary door, the second cams having an unlocked position where the secondary door is loosely seated in the secondary tracks and has a locked position where the secondary door is pushed against one side of the secondary tracks, wherein the locked position prevents water from passing about edges of the secondary door.

6. The double door damper system of claim 1, wherein the first moveable members in the first door includes first wheels along the outer side edges, the first wheels being slidably received within the first tracks, and the secondary door includes secondary wheels being slidably received within secondary tracks.

7. The double door damper system of claim 1, wherein the first moveable members include:

first rotatable cams along perimeters of the outer side edges of the first door, the first cams having an unlocked position where the first door is loosely seated in the first tracks and a locked position where the first door is pushed against one side of the first tracks, wherein the locked position prevents water from passing about edges of the first door.

8. A half panel door damper system for storm water conveyance structures, comprising:

a first track attached to a left side of a storm water conveyance opening, the first track having a lower end adjacent to a floor, and an upper end adjacent to a top end of the storm water conveyance opening;

a second track attached to a right side of an opening, the second track having a lower end adjacent to the floor, and an upper end adjacent to the top end of the storm water conveyance opening;

a main door slidable within the first track and the second track, the main door having an upper position, which substantially closes off the storm water conveyance opening, and a lower position, which is located below the opening in the storm water conveyance opening, the main door being adjustable to different height positions to block part of the storm water conveyance opening at the different height positions;

at least one vertical bar member rotatably mounted to at least one bar mount adjacent to at least one outer side edge of the main door; and a plurality of spaced apart moveable members along the at least one vertical bar member for pushing the main door against an interior portion inside at least one of the first track and the second track, wherein rotating the vertical bar member rotates the moveable members in a horizontal axis from a loose position where the main door is loosely seated in the first track or the second track to a closed position where the main door is pushed against the interior portion of the first track or the second track, wherein the closed position prevents the water from passing about the outer sides edges of the main door, wherein the moveable members lock the main door to different height positions in the first track or the second track, the different height positions for adjusting size of the passage through the water conveyance opening.

9. The half panel door damper system of claim 8, wherein the main door includes:

rotatable wheels, which allow for the main door to rotatably slide up and down in the first track and the second track.

10. A channel damper system for storm water conveyance structures, comprising:

a storm water conveyance structure having a wall with a storm water conveyance opening therethrough, the opening having a left side and a right side;

a first track attached to the left side of the opening in the wall;

a second track attached to the right side of the opening in the wall;

a main door slidable within the first track and the second track, the door having a lower position, which substantially closes off the opening in the wall, and an upper position which allows water flow through the opening in the wall, the door being adjustable to different height positions to block part of the opening in the wall at the different height positions;

at least one vertical bar member rotatably mounted to at least one bar mount adjacent to at least one outer side edge of the main door;

a plurality of spaced apart moveable members along the at least one vertical bar member for pushing the main door against an interior portion inside at least one of the first track and the second track, wherein rotating the vertical bar member rotates the moveable members in a horizontal axis from a loose position where the main door is loosely seated in the first track or the second track to a closed position where the main door is pushed against the interior portion of the first track or the second track, wherein the closed position prevents the water from passing about the outer sides edges of the main door, wherein the moveable members lock the main door to different height positions in the first track or the second track, the different height positions for adjusting size of the passage through the water conveyance opening.

11. The channel damper system of claim 10, wherein the conveyance structure is a concrete vault.

12. The channel damper system of claim 10, wherein the left side of the opening in the wall and the right side of the opening in the wall each include a generally U-shaped groove.

13. The channel damper system of claim 10, wherein the door includes:

rotatable wheels, which allow for the door to rotatably slide up and down in the first track and the second track; and first and second locking members for locking door to the different height positions in the first track and the second track.

14. A double door damper system for storm water conveyance structures, comprising:

a first door having outer side edges slidable within first tracks in a first frame about a passage through a water conveyance opening, the first door having a length and width that is sized to substantially close off the passage through the conveyance opening, the first door having a first opening therethrough for defining a smaller passage than the passage through the water conveyance opening;

a secondary door having outer side edges slidable within second tracks of a second frame on the first door, the secondary door having a length and width that is sized to substantially close off the first opening in the first door;

at least one vertical bar member rotatably mounted to at least one bar mount adjacent to at least one of the outer side edges of the second door; and a plurality of spaced apart moveable members along the at least one vertical bar member for pushing the secondary door against an interior portion inside the second tracks, wherein rotating the at least one vertical bar member rotates the moveable members in a horizontal axis from a loose position where the secondary door is loosely seated in the second tracks to a closed position where the secondary door is pushed against the interior portion of the second tracks, wherein a closed position prevents the water from passing about the outer sides edges of the secondary door, wherein the moveable members lock the secondary door to different height positions, the different height positions for adjusting size of the passage through the water conveyance opening.

15. The double door damper system of claim 14, wherein the moveable members in the secondary door includes wheels along the outer side edges of the secondary door, the wheels being slidably received within the secondary tracks.

16. The double door damper system of claim 14, wherein the moveable members include:

rotatable cams along perimeters of the outer side edges of the secondary door, the first cams having an unlocked position where the secondary door is loosely seated in the first tracks and a locked position where the secondary door is pushed against one side of the first tracks, wherein the locked position prevents water from passing about the outer side edges of the secondary door.

* * * * *